US012559338B2

(12) United States Patent
Nakata et al.

(10) Patent No.: US 12,559,338 B2
(45) Date of Patent: Feb. 24, 2026

(54) RECORDING DEVICE

(71) Applicant: SEIKO EPSON CORPORATION, Tokyo (JP)

(72) Inventors: Satoshi Nakata, Matsumoto (JP); Katsumi Yamada, Matsumoto (JP); Hirokazu Anada, Matsumoto (JP); Masanari Tanaka, Shiojiri (JP); Kanji Momose, Matsumoto (JP); Yusuke Komiyama, Matsumoto (JP); Daisuke Kanuma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 274 days.

(21) Appl. No.: 18/517,319

(22) Filed: Nov. 22, 2023

(65) Prior Publication Data

US 2024/0174474 A1 May 30, 2024

(30) Foreign Application Priority Data

Nov. 25, 2022 (JP) ..... 2022-188384
Nov. 25, 2022 (JP) ..... 2022-188385

(51) Int. Cl.
*B65H 31/00* (2006.01)

(52) U.S. Cl.
CPC ..... *B65H 31/00* (2013.01); *B65H 2405/324* (2013.01)

(58) Field of Classification Search
CPC ..... B65H 31/02; B65H 2405/324; B65H 2551/00
See application file for complete search history.

(56) References Cited

U.S. PATENT DOCUMENTS 10,124,615 B2 * 11/2018 Matsumoto ..... B65H 31/00
11,718,493 B2 * 8/2023 Iwata ..... B65H 31/20 271/207
2018/0029393 A1 2/2018 Matsumoto
2025/0126214 A1 * 4/2025 Namiki ..... H04N 1/00602

FOREIGN PATENT DOCUMENTS

JP 2018-016480 A 2/2018

* cited by examiner

*Primary Examiner* — Howard J Sanders
(74) *Attorney, Agent, or Firm* — WORKMAN NYDEGGER

(57) ABSTRACT

A recording device in which an operating unit is provided to be pivotable to a parallel state and an inclined state with respect to a housing, a discharge tray includes a placement portion displaceable to an accommodation position and a use position, and an extension portion displaceable to a retracted state and an extended state, the extension portion protrudes to the outside of the housing when the placement portion is at the accommodation position and the extension portion is in the extended state, at least the extension portion in the extended state overlaps the operating unit in the parallel state, and a force in a first direction in which the extension portion is displaced from the extended state to the retracted state is applied when a back surface of the operating unit abuts on a tip of the extension portion.

18 Claims, 24 Drawing Sheets

RECORDING DEVICE

The present application is based on, and claims priority from JP Application Serial Number 2022-188385, filed Nov. 25, 2022, and 2022-188384, filed Nov. 25, 2022, the disclosures of which are hereby incorporated by reference herein in its entirety.

BACKGROUND

1. Technical Field

The present disclosure relates to a recording device.

2. Related Art

A recording device that records an image on a medium is known.

The recording device is, for example, an inkjet printer.

In a recording device described in JP-A-2018-016480, an operation panel can swing between a retracting position and a deployed position, and a discharge tray can advance and retreat between the retracting position and the deployed position (See JP-A-2018-016480). The operation panel at a retracting position and a discharge tray at the retracting position have a region overlapping in a height direction when viewed from the side.

However, in the related art, when a discharge tray has a main discharge tray, and an extension tray which is a sub-discharge tray that can be retracted in the main discharge tray, even when the main discharge tray is retracted to a retracting position, the extension tray extends, and this may cause interference between an operation panel and the extension tray.

For example, in a configuration of the recording device described in JP-A-2018-016480, when an extension tray is provided, when the extension tray is not retracted and a discharge tray is retracted to the retracting position, a user is likely to try to close the operation panel without noticing that the extension tray is not retracted. In this case, there is possibility that the operation panel will come into contact with the extension tray and the device will be damaged.

As well as when the discharge tray automatically advances or retreats, even when the user manually retracts the discharge tray, a similar problem may occur when the user tries to close the operation panel in a state in which the extension tray is not retracted and only a main tray is retracted.

SUMMARY

An aspect to solve the above problems is a recording device including a recording unit configured to perform recording on a medium, a discharge tray from which the medium after recording by the recording unit is discharged, an operating unit configured to be performed an operation related to a device, and a housing configured to accommodate the recording unit, wherein the operating unit is provided to be pivotable, with respect to the first surface of the housing, to a parallel state along a first surface and an inclined state intersecting the first surface, the discharge tray includes a placement portion displaceable to an accommodation position at which the placement portion is accommodated inside the housing, and a use position at which the placement portion protrudes from the first surface of the housing to the outside, and an extension portion configured to be displaceable to a retracted state in which the extension portion is retracted in the placement portion and an extended state in which the extension portion protrudes with respect to the placement portion, the extension portion protrudes to the outside of the housing when the placement portion is at the accommodation position and the extension portion is in the extended state, at least the extension portion in the extended state overlaps the operating unit in the parallel state when viewed in a direction perpendicular to the first surface, and a force in a first direction in which the extension portion is displaced from the extended state to the retracted state is applied when a back surface of the operating unit facing the first surface in the parallel state abuts on a tip of the extension portion.

DESCRIPTION OF EMBODIMENTS

Hereinafter, embodiments will be described with reference to the drawings.

An overview of a recording device 1 according to an embodiment will be described with reference to FIGS. 1 to 6.

Figure 1:
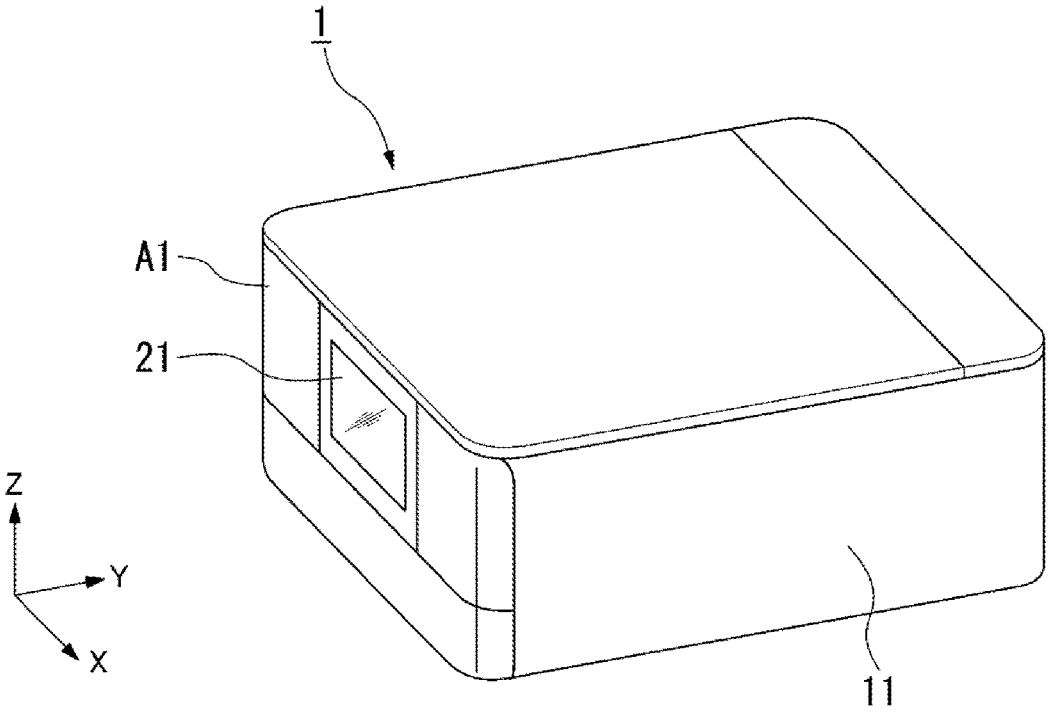
FIG. 1 is an external perspective view illustrating an example of a recording device according to an embodiment.

FIG. 1 is an external perspective view illustrating an example of the recording device 1 according to the embodiment.

In FIG. 1, XYZ orthogonal coordinate axes which are three-dimensional orthogonal coordinate axes are illustrated for convenience of description.

In the present embodiment, a direction parallel to the X-axis corresponds to a width direction of the recording device 1, a direction parallel to a Y-axis corresponds to a front-rear direction which is a depth direction of the recording device 1, and a direction parallel to the Z-axis corresponds to an up-down direction which is a height direction of the recording device 1.

In the description of the present embodiment, a surface of the recording device 1 on the negative side of the Y-axis is referred to as a front surface.

In the present embodiment, the recording device 1 is an inkjet printer including a scanner that reads a document placed on a placement table. Such a recording device 1 may be referred to as a multi-function device. An automatic document feeding type scanner that reads a document while feeding the document may be provided in addition to the scanner or instead of the scanner. Further, a printer without a scanner may also be provided.

Here, the printer is not necessarily limited to an inkjet printer, and a laser printer may be used.

In the present embodiment, a medium that is a printing target is paper, and may also be referred to as paper. The medium that is a printing target does not necessarily have to be paper, and for example, a Compact Disc Recordable (CD-R) disc may be used as the medium by using an auxiliary tray.

A detailed description of the scanner will be omitted.

The recording device 1 includes a housing 11 and an operating unit 21.

For convenience of description, a front surface of the housing 11 of the recording device 1 is also referred to as a first surface A1.

In the present embodiment, the operating unit 21 has a panel shape and may be referred to as a panel unit. The operating unit 21 constitutes part of an upper surface of the front surface in an up-down direction.

The example of FIG. 1 shows a parallel state in which the surface of the operating unit 21 is parallel to the first surface A1.

In an example of FIG. 1, since a placement portion 41 of the paper discharge tray 31 is at a retracting position, the placement portion 41 that is not visible due to the housing 11 is not illustrated.

Here, the operating unit 21 may include, for example, a liquid crystal portion in a central portion in the width direction, and may have a configuration for receiving operations from a user through a touch panel.

Further, the operating unit 21 may have a configuration in which, for example, physical keys or buttons are included and used to receive operations from the user.

Figure 2:
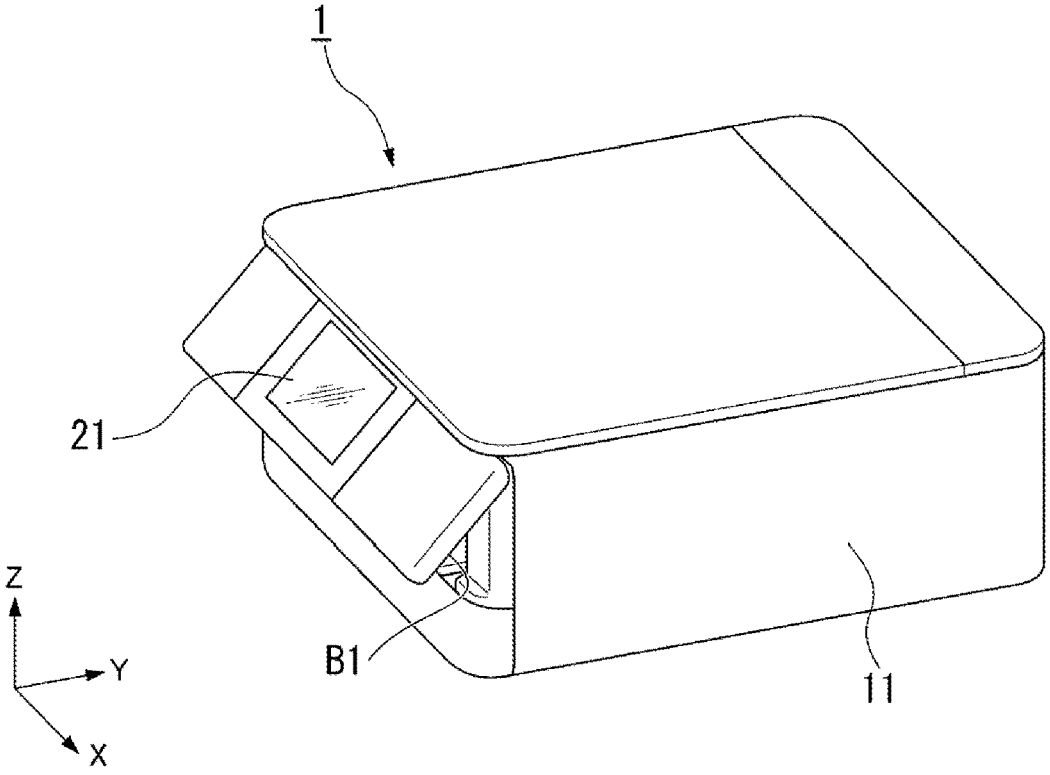
FIG. 2 is an external perspective view illustrating an example of a state in which an operating unit of the recording device is opened 45 degrees according to the present embodiment.

FIG. 2 is an external perspective view illustrating an example of a state in which the operating unit 21 of the recording device 1 according to the present embodiment is opened 45 degrees.

In FIG. 2, XYZ orthogonal coordinate axes similar to those in FIG. 1 are illustrated.

The example of FIG. 2 shows an inclined state in which the surface of the operating unit 21 intersects with the first surface A1.

Specifically, a rotation shaft that is parallel to the first surface A1 and extends in the width direction is provided near an upper end of the surface of the operating unit 21. The operating unit 21 is pivotable about the rotation shaft as a central shaft. In an example of FIG. 2, the operating unit 21 is pivoted 45 degrees so that a lower end of the operating unit 21 protrudes forward.

In an example of FIG. 2, the placement portion 41 of the paper discharge tray 31 is at the retracting position.

FIG. 2 illustrates the back surface B1, which is a surface opposite to a front surface of the operating unit 21.

The operating unit 21 is perpendicular to the installation surface of the recording device 1 and constitutes a front surface of the recording device 1 when the operating unit 21 is in a retracted state as illustrated in FIG. 1. On the other hand, it is possible to change the operating unit 21 to have an inclination at an arbitrary angle so that the user can easily operate the operating unit, as illustrated in FIG. 2, when the operating unit 21 is used.

Here, in the present embodiment, the operating unit 21 is configured to stop in an inclined state at an arbitrary angle.

In the present embodiment, opening and closing of the operating unit 21 may be performed manually, or may be performed automatically by the recording device 1.

Figure 3:
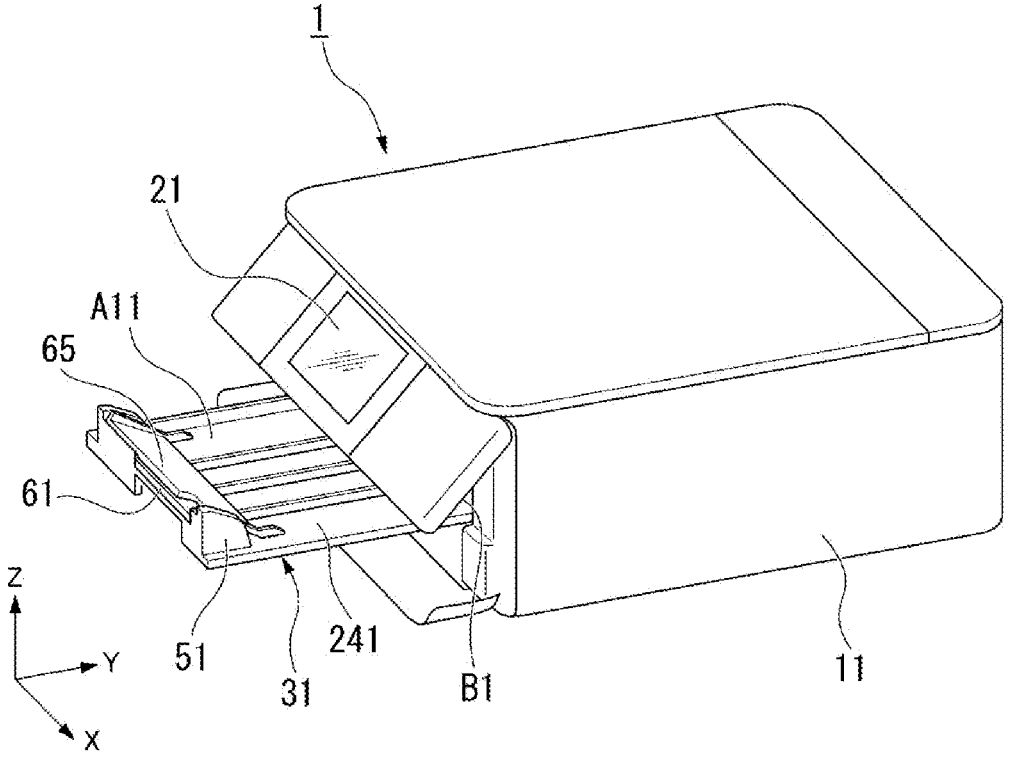
FIG. 3 is an external perspective view illustrating an example of a state in which a paper discharge tray of the recording device is pulled out according to the present embodiment.

FIG. 3 is an external perspective view illustrating an example of a state in which the paper discharge tray 31 of the recording device 1 according to the present embodiment is pulled out.

In FIG. 3, XYZ orthogonal coordinate axes similar to those in FIG. 1 are illustrated.

An example of FIG. 3 shows an inclined state in which the surface of the operating unit 21 intersects with the first surface A1.

In an example of FIG. 3, the placement portion 41 of the paper discharge tray 31 is at the use position. In the present embodiment, when printing is not performed, the placement portion 41 is at the accommodation position and accommodated inside the housing 11, so that a space occupied by the recording device 1 can be reduced.

In the present embodiment, a disposition at which the operating unit 21 is located above the paper discharge tray 31 in the up-down direction is used.

The paper discharge tray 31 includes a placement portion 41 and a stopper 61.

The placement portion 41 includes, on the front, an inclined portion 51 that prevents the medium from falling. The inclined portion 51 is provided at a tip portion of the placement portion 41 of the paper discharge tray 31, and has an upward angled inclined surface so that the discharged paper does not fall.

The placement portion 41 has a placement surface A11 as a top surface. The placement surface A11 is often formed with a large size in order to hold most of an area including a centroid of the paper, for example.

The placement portion 41 may be referred to as a main paper discharge tray or the like. The main paper discharge tray is an example of a main discharge tray.

The stopper 61 may be referred to as a sub paper discharge tray or the like. The sub paper discharge tray is an example of a sub discharge tray.

In the example of FIG. 3, the retracted state in which the stopper 61 is retracted is illustrated.

Here, the paper discharge tray 31 makes it easy for the user to take out the paper printed by the recording unit 111 of the recording device 1 when the paper is discharged.

Since the paper discharge tray 31 protrudes to a front of the recording device 1, the paper discharge tray 31 is configured to be retracted when the paper discharge tray 31 is not in use. The paper discharge tray 31 is hidden behind the operating unit 21 when the paper discharge tray 31 is retracted, and is moved to the use position when the paper discharge tray 31 is used.

As a configuration in which the paper discharge tray 31 is moved, for example, a configuration in which the paper discharge tray 31 is moved manually by the user may be used, or a configuration in which the paper discharge tray 31 is moved automatically by the recording device 1 may be used. As the configuration in which the paper discharge tray 31 is moved automatically by the recording device 1, for example, one or both of a configuration in which the paper discharge tray 31 is automatically pulled out from the retracting position to the use position, and a configuration in which the paper discharge tray 31 is automatically pulled out from the use position to the retracting position may be used.

Figure 4:
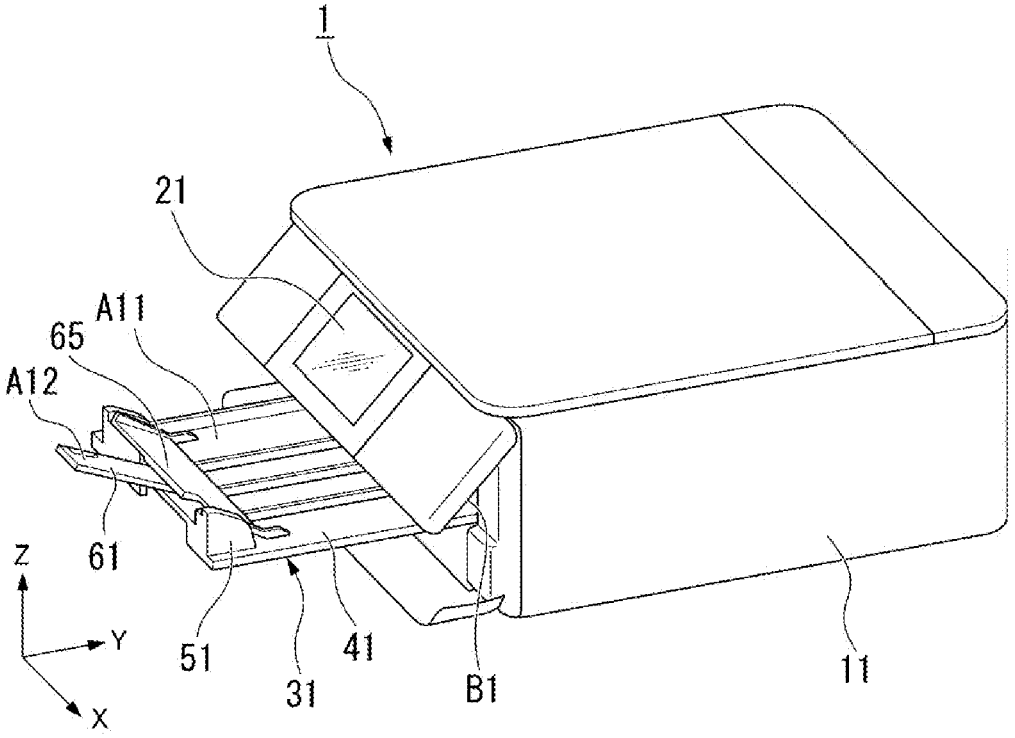
FIG. 4 is an external perspective view illustrating an example of a state in which the paper discharge tray and a stopper of the recording device are pulled out according to the present embodiment.

FIG. 4 is an external perspective view illustrating an example of a state in which the paper discharge tray 31 and the stopper 61 of the recording device 1 according to the present embodiment are pulled out.

In FIG. 4, XYZ orthogonal coordinate axes similar to those in FIG. 1 are illustrated.

In the example of FIG. 4, an inclined state in which the surface of the operating unit 21 intersects with the first surface A1 is illustrated.

In an example of FIG. 4, the placement portion 41 of the paper discharge tray 31 is at the use position.

In the example of FIG. 4, an extended state in which the stopper 61 is extended is illustrated.

In the present embodiment, the stopper 61 provided at the tip of the placement portion 41 of the paper discharge tray 31 supports light paper such as A4 plain paper so that the paper does not fall and scatter from the recording device 1, for example, when the paper is printed on at high speed and discharged. The stopper 61 is used, for example, at a predetermined angle with respect to a surface of the placement portion 41.

Figure 5:
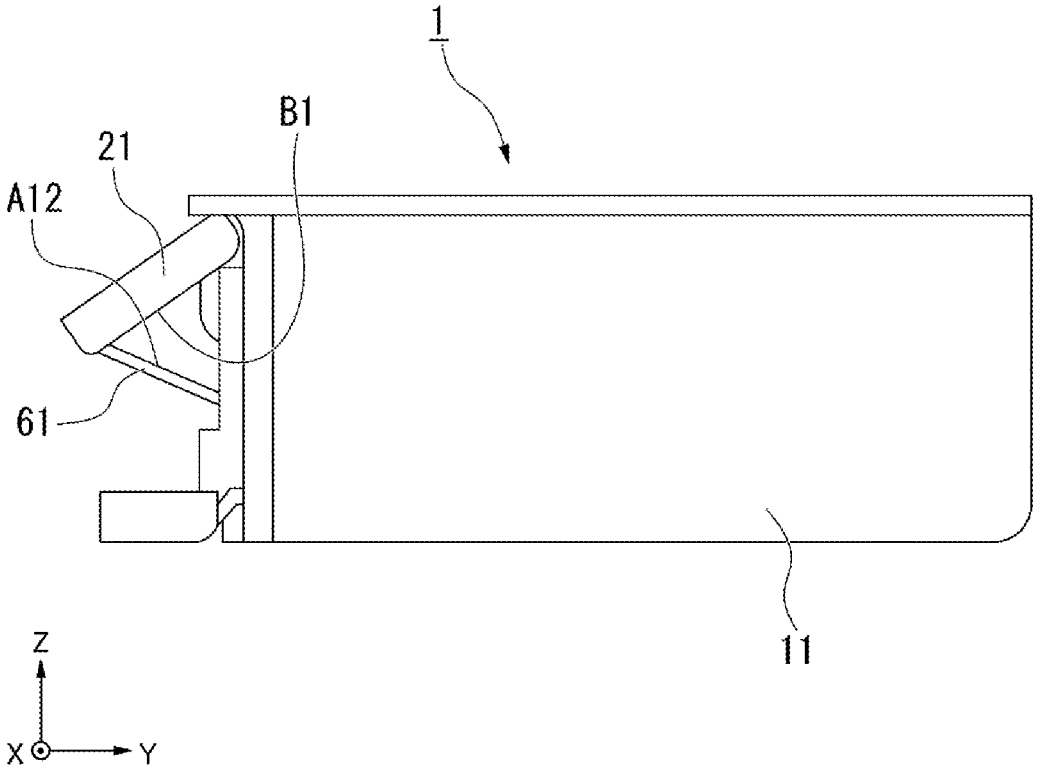
FIG. 5 is a diagram illustrating interference between the operating unit and the stopper in the recording device according to the present embodiment.

FIG. 5 is a diagram illustrating interference between the operating unit 21 and the stopper 61 in the recording device 1 according to the present embodiment.

In FIG. 5, XYZ orthogonal coordinate axes similar to those in FIG. 1 are illustrated.

In an example of FIG. 5, a side surface of the recording device 1 when viewed from a positive side to a negative side of an X-axis is shown.

As illustrated in FIG. 5, in the present embodiment, when the placement portion 41 is pulled out or retracted in a state in which the stopper 61 is pulled out, the stopper 61 and the operating unit 21 is likely to interfere and be damaged depending on a position of the operating unit 21.

As a specific example, in a configuration in which the user manually displaces the stopper 61 between a retracted state and the extended state, the operating unit 21 is likely to be closed from an inclined state to a parallel state in a state in which the placement portion 41 is retracted with the stopper 61 being in the extended state.

Figure 6:
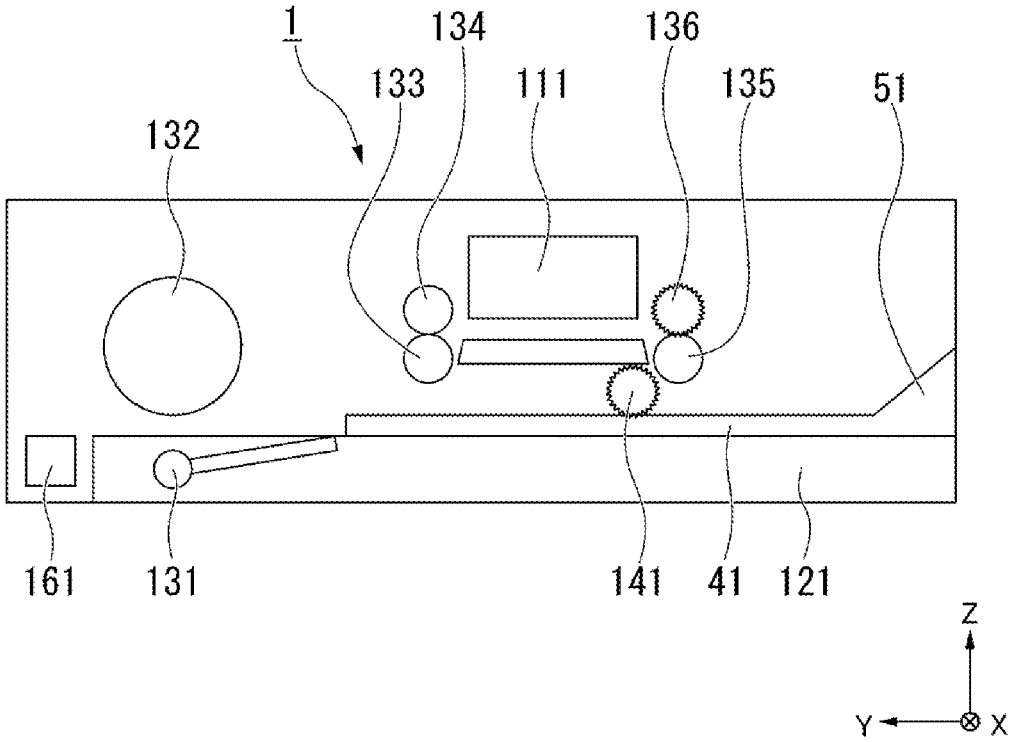
FIG. 6 is a diagram illustrating an example of a schematic internal configuration of the recording device according to the present embodiment.

FIG. 6 is a diagram illustrating an example of a schematic internal configuration of the recording device 1 according to the present embodiment.

In FIG. 6, XYZ orthogonal coordinate axes similar to those in FIG. 1 are illustrated.

The recording device 1 includes the recording unit 111, a cassette 121, a paper feed roller 131, a reversing roller 132, a paper feed roller 133, a driven roller 134, a paper discharge roller 135, a driven serrated roller 136, a discharge tray drive pinion 141, and a drive source 161.

Here, the paper feed roller 133 on the lower side and the driven roller 134 on the upper side are combined.

The paper discharge roller 135 on the lower side and the driven serrated roller 136 on the upper side are combined. In the present embodiment, the paper feed roller 131, the reversing roller 132, the paper feed roller 133, the driven roller 134, the paper discharge roller 135, and the driven serrated roller 136 constitute a transport roller.

The drive source 161 includes, for example, a motor.

The drive source 161 drives the transport roller.

Further, the drive source 161 may also be used to drive components other than the transport roller. For example, the drive source 161 may drive the transport roller and the paper discharge tray 31. In this case, an operation of the paper discharge tray 31 is automated in the recording device 1.

In the present embodiment, the side on which the medium is transported is referred to as downstream, and an opposite side is referred to as upstream. That is, the medium is transported from upstream to downstream.

The medium retracted in the cassette 121 is taken out by the paper feed roller 131 and discharged to the placement surface A11 of the paper discharge tray 31 via the reversing roller 132, the paper feed roller 133, the driven roller 134, the paper discharge roller 135, and the driven serrated roller 136.

The recording unit 111 is disposed between positions of the paper feed roller 133 and the driven roller 134 and positions of the paper discharge roller 135 and the driven serrated roller 136.

The recording unit 111 prints a printing target image on a medium.

The recording unit 111 is mounted on a carriage, for example, and moves with the movement of the carriage to perform printing on a predetermined range of the medium.

The recording unit 111 may be referred to as, for example, a printing unit.

The recording unit 111 performs recording on the medium.

The paper discharge tray 31 is an example of a discharge tray from which the medium after recording by the recording unit 111 is discharged.

The operating unit 21 is performed an operation related to the device.

The housing 11 accommodates the recording unit 111.

The operating unit 21 is provided to be pivotable with respect to the first surface A1 of the housing 11 to a parallel state along the first surface A1 and an inclined state intersecting the first surface A1.

The placement portion 41 of the paper discharge tray 31 can be displaced to an accommodation position at which the placement portion 41 is accommodated inside the housing 11 and a use position at which the placement portion 41 protrudes from the first surface A1 of the housing 11 to the outside.

The stopper 61 of the paper discharge tray 31 is an example of an extension portion that can be displaced between a retracted state in which the stopper 61 is retracted in the placement portion 41 and an extended state in which stopper 61 protrudes from the placement portion 41.

When the placement portion 41 is at the accommodation position and the stopper 61 is in the extended state, the stopper 61 protrudes to the outside of the housing 11.

Further, at least the stopper 61 in the extended state overlaps the operating unit 21 in the parallel state, when viewed in a Y direction which is a direction perpendicular to the first surface A1.

Since the stopper 61 interferes with the operating unit 21, "a case in which the operating unit 21 is in the parallel state, the placement portion 41 is at the accommodation position, and the stopper 61 is in the extended state" does not actually occur, this case has been described herein in order to describe a positional relationship between the stopper 61 and the operating unit 21. That is, when the placement portion 41 is at the retracting position and the stopper 61 is in the extended state, the operating unit 21 cannot be put in the parallel state, but this is description of a virtual disposition relationship between the stopper 61 and the operating unit 21. Further, in the present embodiment configured so that the stopper 61 is put into the retracted state when the operating unit 21 is in the parallel state and the placement portion 41 is at the accommodation position, "the case in which the operating unit 21 is in the parallel state, the placement portion 41 is at the accommodation position, and the stopper 61 is in the extended state" does not actually occur.

The recording device 1 includes a drive source 161 that displaces the placement portion 41 to the accommodation position and the use position.

Other configurations thereof may be used.

The placement portion 41 has the inclined portion 51 that is inclined so that the downstream in a medium discharge direction is upward and performs support. The stopper 61 is retracted in the inclined portion 51 in the retracted state.

Other configurations thereof may be used.

The placement surface A11 on which the medium is mounted in the placement portion 41 intersects with the support surface A12 that supports the medium in the stopper 61.

Other configurations thereof may be used.

In each embodiment below, a recording device in which a characteristic configuration according to each embodiment is applied to the recording device 1 illustrated in FIGS. 1 to 6 will be described as an example.

Therefore, in each of the following embodiments, the same components as in the recording device 1 illustrated in FIGS. 1 to 6 will be denoted by the same reference signs and described.

Further, in each of the following embodiments, illustration of reference signs may be omitted for portions that are not referred to in the description of characteristic configurations according to each embodiment.

Further, in each of the following embodiments, for convenience of description, numerals such as first and second may be used to distinguish constituent portions having the same name. The name of each component is for convenience of description, and may be referred to as other names.

A first embodiment will be described.

A first recording device 201 according to the first embodiment will be described with reference to FIG. 7.

Figure 7:
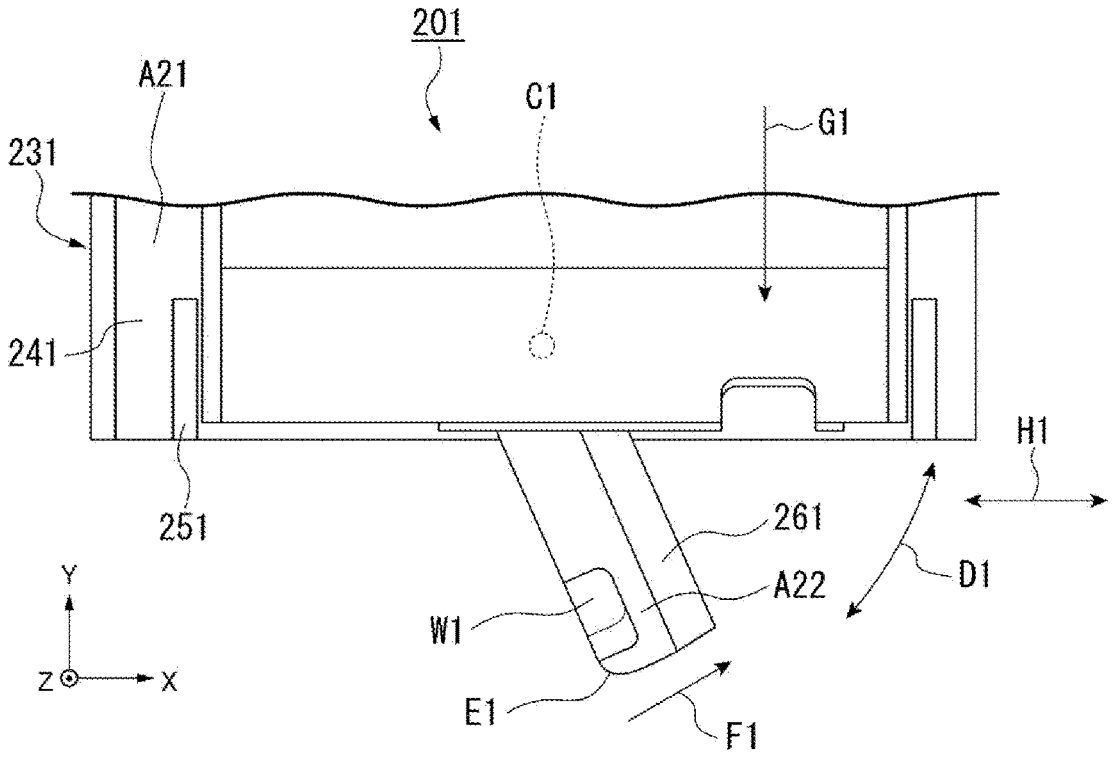
FIG. 7 is a diagram illustrating an example of a configuration of a first stopper of a first recording device according to a first embodiment.

FIG. 7 is a diagram illustrating an example of a configuration of the first stopper 261 of the first recording device 201 according to the first embodiment.

In FIG. 7, XYZ orthogonal coordinate axes similar to those in FIG. 1 are illustrated.

In the example of FIG. 7, only a front portion of the first paper discharge tray 231 in the first recording device 201 is illustrated. In the present embodiment, other portions of the first recording device 201 are the same as those in the examples of FIGS. 1 to 6, and detailed description thereof will be omitted.

The first stopper 261 has a plate-like shape parallel to the inclined surface at a location of the first inclined portion 251 of the first placement portion 241 in which the first stopper 261 is provided.

In FIG. 7, a position of the first pivoting shaft C1 of the first stopper 261 is illustrated.

When viewed in a line of sight along an up-down direction, the first stopper 261 has a rectangular shape, and the vicinity of one end of the rectangular shape is configured to be pivotable with respect to the first placement portion 241 with the first pivoting shaft C1 as a central shaft. This makes it possible for the first stopper 261 to be switched between the retracted state and the extended state by pivoting.

In FIG. 7, a first pivoting direction DI which is a pivoting direction of the first stopper 261 is illustrated.

The first stopper 261 includes a first handle portion W1 at a position near the tip.

The first handle portion W1 can be hooked by a finger of the user.

Although the first handle portion W1 has, for example, a concave shape, but may have another shape.

In the present embodiment, a long side direction of the first stopper 261 intersects a direction perpendicular to the first surface A1 in a state in which the first stopper 261 is pulled out to the maximum. That is, the long side direction intersects the first surface A1 at an angle of less than 90 degrees.

Thus, when the first stopper 261 is in the extended state, the long side direction of the first stopper 261 has a predetermined angle greater than 0 with respect to the discharge direction.

Force in a first direction F1 in which the first stopper 261 is displaced from the extended state to the retracted state is applied when a back surface B1 facing the first surface A1 abuts on a first tip E1 of the first stopper 261 in the parallel state in the operating unit 21.

With this force, even when the user does not manually put the first stopper 261 into the retracted state, the first stopper 261 is automatically displaced from the extended state to the retracted state when the first placement portion 241 is at the retracting position and the operating unit 21 is changed from the inclined state to the parallel state.

Therefore, when the back surface B1 of the operating unit 21 abuts on the first tip E1 of the first stopper 261, the force in the first direction F1 in which the first stopper 261 is displaced from the extended state to the retracted state is applied, so that the first stopper 261 can be displaced in a retracting direction by the force of closing the operating unit 21, and damage can be curbed.

Here, in the present embodiment, for example, a shape of one or both of the back surface B1 of the operating unit 21 and the first tip E1 of the first stopper 261 is formed so that the force in the first direction F1 in which the first stopper 261 is displaced from the extended state to the retracted state is applied when the back surface B1 of the operating unit 21 abuts on the first tip E1 of the first stopper 261.

Further, when the back surface B1 of the operating unit 21 abuts on the first tip E1 of the first stopper 261, the force in the first direction F1 in which the first stopper 261 is displaced from the extended state to the retracted state indicates, for example, force in a displacement direction when the first stopper 261 breaks an equilibrium state in the extended state, but may be force including the force in the displacement direction as force component in another example.

In such a configuration, since the first stopper 261 has a predetermined angle with respect to the discharge direction, force when the operating unit 21 is moved downward is divided into force in the first pivoting direction DI so that the first stopper 261 can be retracted, when the operating unit 21 is closed and the operating unit 21 and the first stopper 261 interfere with each other.

At least one of a surface of the back surface B1 of the operating unit 21 abutting on the first tip E1 and a surface of the first tip E1 abutting on the back surface B1 intersects the first direction F1.

Therefore, it is possible to easily realize displacement of the first stopper 261 in a retracting direction using the force for closing the operating unit 21, only by changing at least one of a shape of the abutting surface of the back surface B1 of the operating unit 21 and a shape of the abutting surface of the first tip E1 of the first stopper 261.

The first stopper 261 can be displaced to the retracted state and the extended state by pivoting about the first pivoting shaft C1.

Therefore, for the first stopper 261 that is retracted through pivoting, it is possible to displace the first stopper 261 in the retracting direction using the force of closing the operating unit 21. With a configuration in which the first stopper 261 is retracted through pivoting, it is possible to reduce a retraction area in a transport direction. Therefore, it is possible to increase a degree of freedom in design, such as a design in which a tip portion of the first placement portion 241 is inclined upward.

The first stopper 261 protrudes in a direction intersecting the medium discharge direction in the extended state.

Therefore, since the first stopper 261 receives the medium in an inclined state, it is possible to support a wide range in the width direction. Since the first stopper 261 is disposed obliquely and abuts on a back surface of the operating unit 21 at a corner of the first stopper 261, the force can be applied in the first direction F1.

The first recording device 201 includes a biasing portion that biases the first stopper 261 toward the extended state.

In an example of FIG. 7, a first biasing direction G1 of the biasing portion is shown. The biasing portion may be configured using, for example, a torsion spring.

Therefore, since the first stopper 261 is biased toward the extended state, the user does not need to extend the first stopper 261 because the first stopper 261 is put into the extended state when the first stopper 261 is not in the retracted state by the operating unit 21.

Other configurations thereof may be used.

For example, the first placement portion 241 has the first inclined portion 251 that is inclined so that the downstream in the medium discharge direction is upward and performs support.

The first stopper 261 is retracted in the first inclined portion 251 in the retracted state.

Therefore, the presence of the first inclined portion 251 can curb jumping-out of the discharged medium. Further, the first stopper 261 is retracted in the first inclined portion 251, so that the size of the device can be reduced.

Other configurations thereof may be used.

Here, for example, the first inclined portion 251 is located upward from upstream to downstream, that is, located in a direction opposite to gravity from the upstream to the downstream.

For example, the first placement surface A21 on which the medium is placed in the first placement portion 241 intersects with the first support surface A22 that supports the medium in the first stopper 261.

Therefore, since the first stopper 261 is inclined with respect to the first placement surface A21, it is possible to curb jumping-out of the medium.

Other configurations thereof may be used.

For example, the first recording device 201 may include the drive source 161 that displaces the first placement portion 241 to the accommodation position and the use position.

Therefore, the first paper discharge tray 231 is automatically moved, so that usability is improved. For example, when the first paper discharge tray 231 is automatically retracted with the first stopper 261 being in the extended state, the user is highly likely to close the operating unit 21 without noticing that the first stopper 261 is in the extended state, but even in such a case, it is possible to curb the damage.

In this regard, other configurations may be used.

Here, a drive source for the first placement portion 241 does not necessarily have to be the same as the drive source 161 of the transport roller, and the first recording device 201 may include another drive source.

As described above, in the first recording device 201 according to the present embodiment, it is possible to prevent the device from being damaged when the operating unit 21 is closed in a state in which the first placement portion 241 is accommodated without the first stopper 261 provided on the first paper discharge tray 231 being retracted.

In the first recording device 201 according to the present embodiment, in such a case, the first stopper 261 that has not been retracted is retracted by force of closing the operating unit 21.

Thus, the first recording device 201 according to the present embodiment has a configuration in which the first stopper 261 which is located at the tip of the first paper discharge tray 231 and prevents the paper from falling is retracted in conjunction with a movement in which the operating unit 21 is closed. In the present embodiment, the first stopper 261 has a predetermined angle with respect to the medium discharge direction in the extended state in which the first stopper 261 is used.

In the present embodiment, for example, since the first stopper 261 is retracted without the user being aware of this, it is possible to prevent the first stopper 261 that the user has forgotten to retract and the operating unit 21 to be closed from being damaged due to interference therebetween. Further, in the present embodiment, for example, it is possible to eliminate a need for power for retraction of the first stopper 261, and to displace the first stopper 261 to the retracting position with a simple mechanism.

The 1*a*-th recording device 201*a* according to the 1*a*-th embodiment will be described with reference to FIG. 8.

Figure 8:
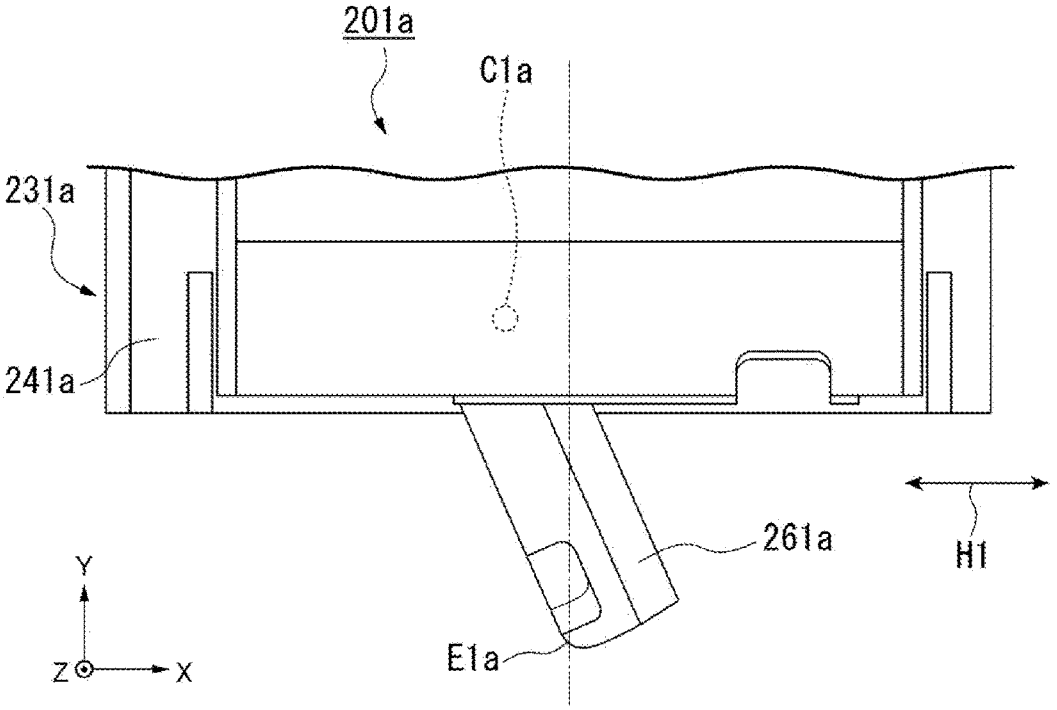
FIG. 8 is a diagram illustrating another example of a configuration of a 1*a*-th stopper of a 1*a*-th recording device according to a 1*a*-th embodiment.

FIG. 8 is a diagram illustrating another example of the configuration of the 1*a*-th stopper 261*a* of the 1*a*-th recording device 201*a* according to the 1*a*-th embodiment.

In FIG. 8, XYZ orthogonal coordinate axes similar to those in FIG. 1 are illustrated.

In the example of FIG. 8, only a front portion of the 1*a*-th paper discharge tray 231*a* in the 1*a*-th recording device 201*a* is illustrated. In the present embodiment, other portions of the 1*a*-th recording device 201*a* are the same as those in the examples of FIGS. 1 to 6, and detailed description thereof will be omitted.

The 1*a*-th recording device 201*a* is a modification example of the first recording device 201 illustrated in FIG. 7.

Differences between the 1*a*-th recording device 201*a* and the first recording device 201 illustrated in FIG. 7 will be described.

A 1*a*-th tip Ela of the 1*a*-th stopper 261*a* is located at a center of an area in which the medium is discharged in a first width direction H1 intersecting the medium discharge direction.

Therefore, since the 1*a*-th tip Ela of the 1*a*-th stopper 261*a* is located at the center of the medium in the first width direction H1, the 1*a*-th stopper 261*a* can reliably support the medium.

Here, in an example of FIG. 8, when the 1*a*-th stopper 261*a* is in the extended state in which the 1*a*-th stopper 261*a* is pulled out to the maximum with respect to the 1*a*-th placement portion 241*a*, the 1*a*-th tip Ela of the 1*a*-th stopper 261*a* is located at the center of the area in which the medium is discharged in the first width direction H1 intersecting the medium discharge direction.

Thus, the 1*a*-th tip Ela of the 1*a*-th stopper 261*a*, which has a predetermined angle with respect to the discharge direction, matches the center of the first width direction H1 or the vicinity thereof, thereby making it possible to hold a large paper at or near the center in the width direction of the paper by the 1*a*-th stopper 261*a* when the paper is discharged.

In FIG. 8, a position of a 1*a*-th pivoting shaft C1*a* of the 1*a*-th stopper 261*a* is also illustrated. In FIG. 7, the first pivoting shaft C1 of the first stopper 261 is located at the center of the area in which the medium is discharged in the first width direction H1, whereas in FIG. 8, the 1*a*-th pivoting shaft C1*a* of the 1*a*-th stopper 261*a* is located at a position shifted from the center of the area in which the medium is discharged in the first width direction H1.

As described above, in the 1*a*-th recording device 201*a* according to the present embodiment, it is possible to prevent the device from being damaged when the operating unit 21 is closed in a state in which the 1*a*-th placement portion 241*a* is accommodated without the 1*a*-th stopper 261*a* provided on the 1*a*-th paper discharge tray 231*a* being retracted.

In the 1*a*-th recording device 201*a* according to the present embodiment, in such a case, the 1*a*-th stopper 261*a* that has not been retracted is retracted by force of closing the operating unit 21.

A second embodiment will be described.

A second recording device 301 according to the second embodiment will be described with reference to FIG. 9.

Figure 9:
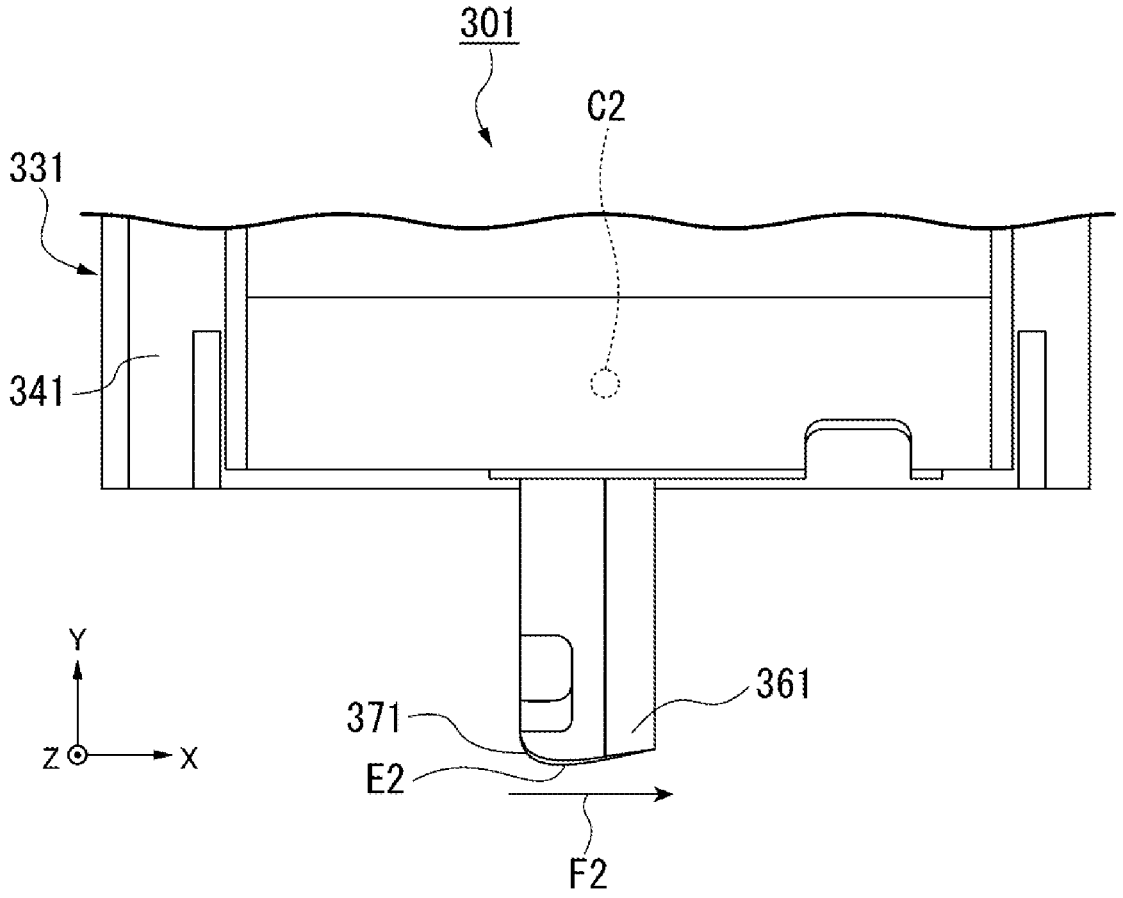
FIG. 9 is a diagram illustrating an example of a configuration of a second stopper of a second recording device according to a second embodiment.

FIG. 9 is a diagram illustrating an example of a configuration of a second stopper 361 of the second recording device 301 according to the second embodiment.

In FIG. 9, XYZ orthogonal coordinate axes similar to those in FIG. 1 are illustrated.

In the example of FIG. 9, only a front portion of the second paper discharge tray 331 in the second recording device 301 is illustrated. In the present embodiment, other portions of the second recording device 301 are the same as those in the examples of FIGS. 1 to 6, and detailed description thereof will be omitted.

Differences between the second recording device 301 and the first recording device 201 illustrated in FIG. 7 will be described.

A configuration of the present embodiment may be applied, for example, to each of the first embodiment and the 1*a*-th embodiment.

The second stopper 361 protrudes in the same direction as the medium discharge direction in the extended state. An abutting surface 371 of the second stopper 361, which is a surface of the second tip E2 abutting on the back surface B1, intersects the second direction F2.

Here, the second direction F2 is a direction in which the second stopper 361 is displaced from the extended state to the retracted state when the back surface B1 of the operating unit 21 abuts on the second tip E2 of the second stopper 361.

In an example of FIG. 9, the abutting surface 371 of the second stopper 361 with respect to the second tip E2 is located on the negative side of the X-axis, but may be located on the positive side of the X-axis as another example, and in this case, a pivoting direction when the second stopper 361 is displaced from the extended state to the retracted state is reversed.

Thus, the second stopper 361 has a shape of an inclined surface with a predetermined angle or a shape with a curvature as a shape of the second tip E2. This allows the second stopper 361 to change force in a direction in which the operating unit 21 is closed into force in the second direction F2. The second direction F2 is, for example, a direction parallel to the width direction, and is a direction in which the second stopper 361 in the extended state is displaced toward the retracted state.

In an example of FIG. 9, when the second stopper 361 is in the extended state, a long side direction of the second stopper 361 is parallel to the discharge direction.

In FIG. 9, a second placement portion 341, and a second pivoting shaft C2 of the second stopper 361 are also illustrated.

As described above, in the second recording device 301 according to the present embodiment, it is possible to prevent the device from being damaged when the operating unit 21 is closed in a state in which the second placement portion 341 is accommodated without the second stopper 361 provided in the second paper discharge tray 331 being retracted.

In the second recording device 301 according to the present embodiment, in such a case, the second stopper 361 that has not been retracted is retracted by the force of closing the operating unit 21.

Thus, in the second recording device 301 according to the present embodiment, the second stopper 361 which is located at a tip of the second paper discharge tray 331 and prevents the paper from falling is retracted in conjunction with a movement in which the operating unit 21 is closed. In the present embodiment, a shape of the tip of the second stopper 361 has a predetermined angle with respect to the discharge direction of the medium in the extended state in which the second stopper 361 is used.

A third embodiment will be described.

A third recording device 401 according to the third embodiment will be described with reference to FIGS. 10 to 12.

Figure 10:
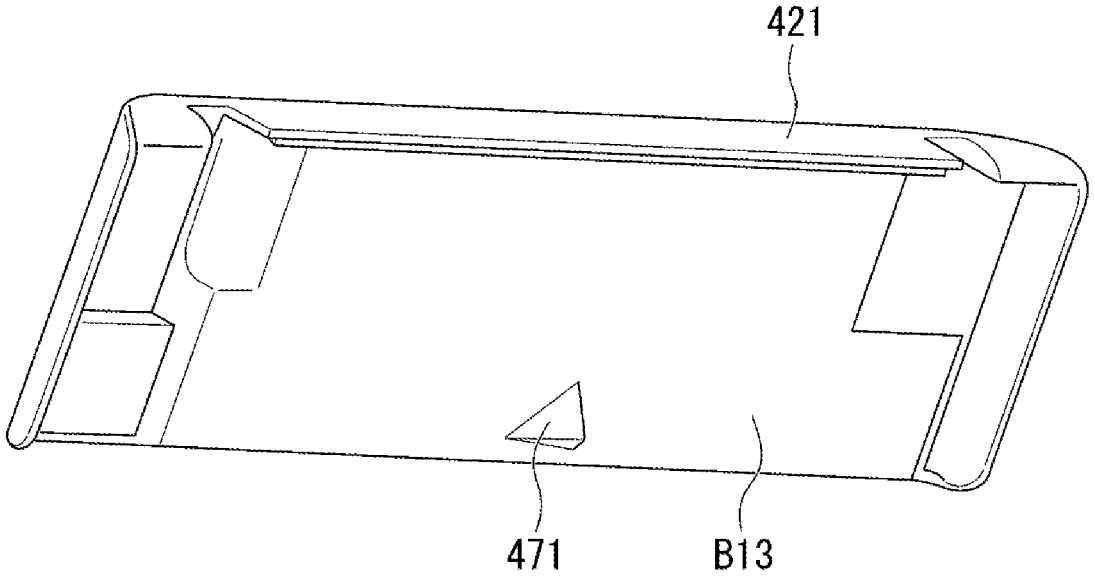
FIG. 10 is a diagram illustrating an example of a configuration of a third operating unit of a third recording device according to a third embodiment.

FIG. 10 is a diagram illustrating an example of a configuration of a third operating unit 421 of the third recording device 401 according to the third embodiment.

Figure 11:
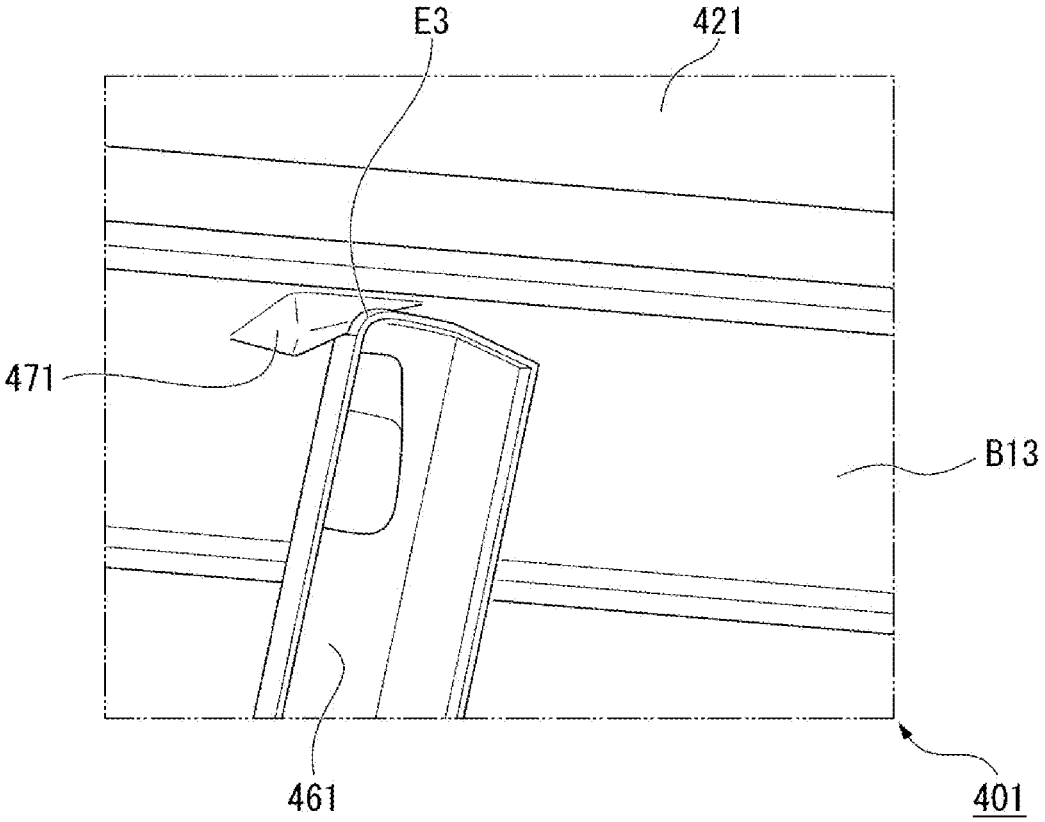
FIG. 11 is a diagram illustrating an example of a configuration of the third operating unit and a third stopper of the third recording device according to the third embodiment.

FIG. 11 is a diagram illustrating an example of a configuration of the third operating unit 421 and a third stopper 461 of the third recording device 401 according to the third embodiment.

Figure 12:
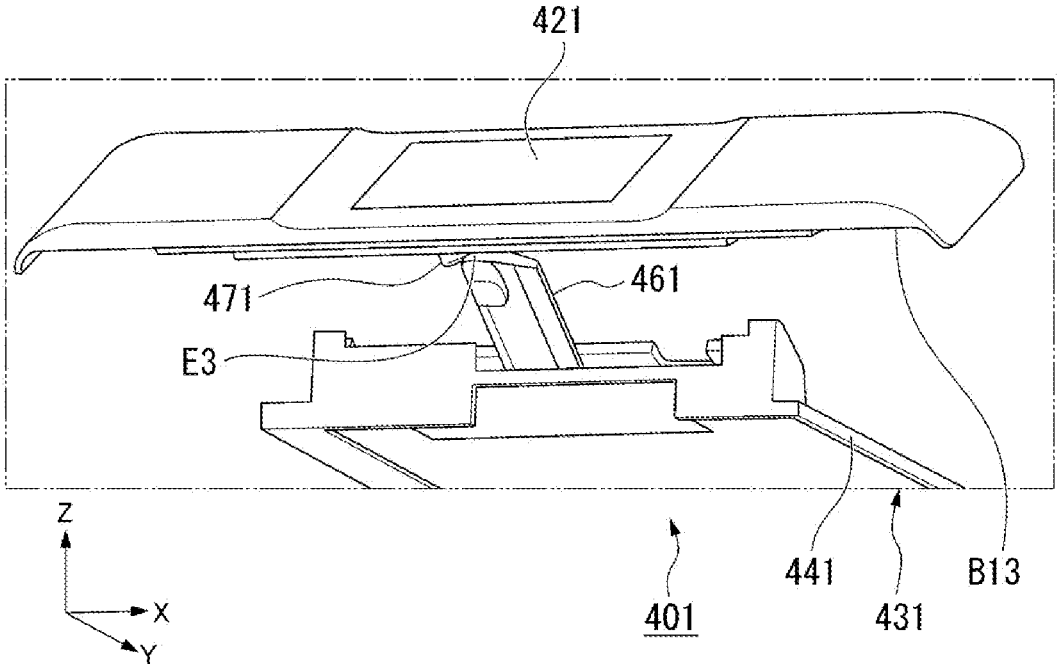
FIG. 12 is a diagram illustrating an example of a configuration of the third operating unit and the third stopper of the third recording device according to the third embodiment.

FIG. 12 is a diagram illustrating an example of a configuration of the third operating unit 421 and the third stopper 461 of the third recording device 401 according to the third embodiment.

In FIG. 12, XYZ orthogonal coordinate axes similar to those in FIG. 1 are illustrated.

In the examples of FIGS. 10 to 12, only a front portion of the third paper discharge tray 431 and the third operating unit 421 in the third recording device 401 are illustrated. In the present embodiment, other portions of the third recording device 401 are the same as those in the examples of FIGS. 1 to 6, and detailed description thereof will be omitted.

Differences between the third recording device 401 and the first recording device 201 illustrated in FIG. 7, the 1*a*-th recording device 201*a* illustrated in FIG. 8, or the second recording device 301 illustrated in FIG. 9 will be described.

An abutment portion 471 of a third back surface B13 of the third operating unit 421 that abuts on a third tip E3 obliquely protrudes.

Therefore, it is possible to easily realize displacement of the third stopper 461 in a retracting direction using the force for closing the third operating unit 421 only by providing the inclined abutment portion 471 on the third back surface B13 of the third operating unit 421.

In FIG. 12, a positional relationship between the third operating unit 421 and the third stopper 461 when the third placement portion 441 of the third paper discharge tray 431 is in the accommodation position and the third stopper 461 is in the extended state is illustrated.

In a state illustrated in FIG. 12, when the third operating unit 421 is displaced from the inclined state to the parallel state, the abutment portion 471 of the third back surface B13 of the third operating unit 421 collides with the third tip E3 of the third stopper 461, so that the third stopper 461 can be displaced in a retracting direction.

Thus, on the third back surface B13 of the third operating unit 421, an abutment portion 471 having an inclined surface that changes force in a direction in which the third operating unit 421 is closed into force in a direction in which the third stopper 461 is retracted is provided at a position at which interference with the third stopper 461 occurs.

In an example of FIG. 11, the abutment portion 471 having a higher protrusion on the negative side of the X-axis and a lower protrusion toward the positive side of the X-axis is provided. An inclined surface of the abutment portion 471 makes it possible to pivot the third stopper 461 in a direction with a greater angle with respect to the discharge direction when the third operating unit 421 is closed.

As described above, in the third recording device 401 according to the present embodiment, it is possible to prevent the device from being damaged when the third operating unit 421 is closed in a state in which the third stopper 461 provided in the third paper discharge tray 431 is not retracted and the third placement portion 441 is accommodated.

In the third recording device 401 according to the present embodiment, in such a case, the third stopper 461 that has not been retracted is retracted by force that closes the third operating unit 421.

Thus, the third recording device 401 according to the present embodiment has a configuration in which the third stopper 461 which is located at the tip of the third paper discharge tray 431 and prevents the paper from falling is retracted in conjunction with a movement in which the third operating unit 421 is closed. In the present embodiment, the inclined surface that changes the force in a direction in which the third operating unit 421 is closed into the force in a direction in which the third stopper 461 is retracted is provided at a position at which interference with the third stopper 461 occurs on the back surface of the third operating unit 421.

A fourth embodiment will be described.

A fourth recording device 501 according to the fourth embodiment will be described with reference to FIGS. 13 to 16.

Figure 13:
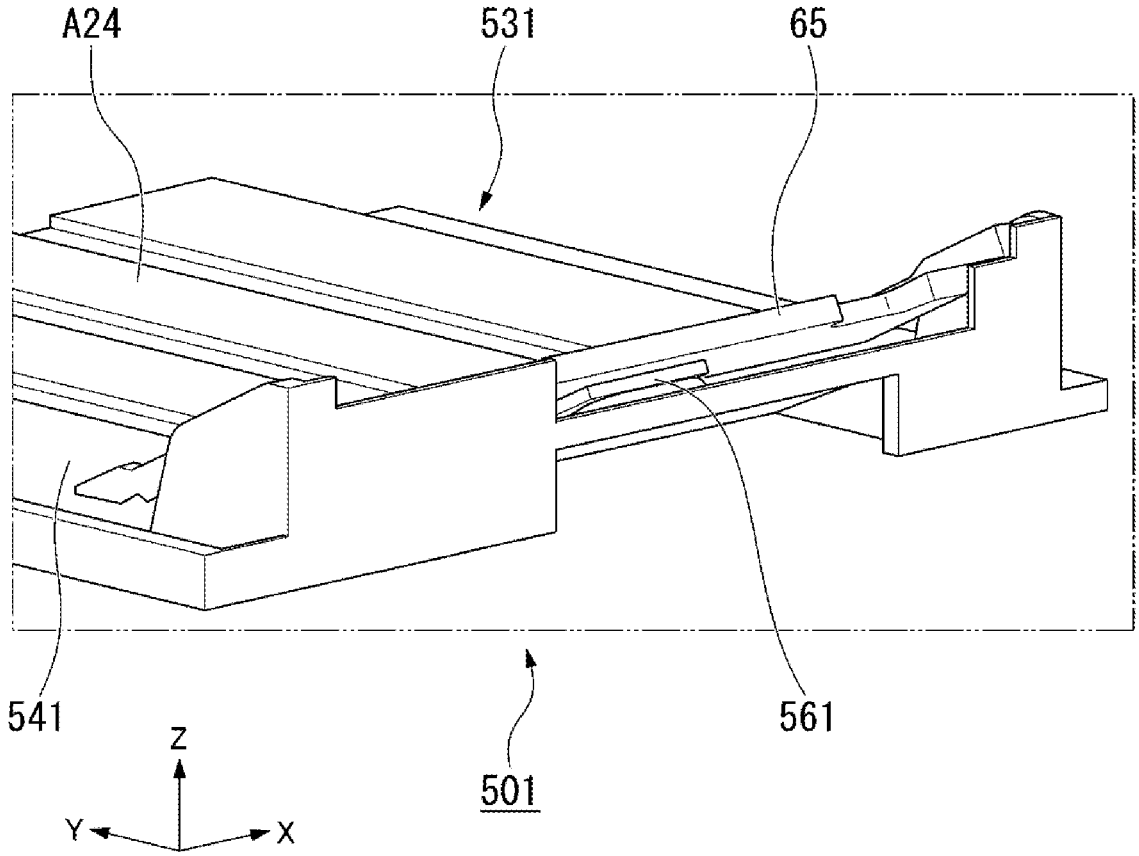
FIG. 13 is an external perspective view illustrating an example of a state in which a fourth stopper of a fourth recording device is retracted according to a fourth embodiment.

FIG. 13 is an external perspective view illustrating an example of a state in which a fourth stopper 561 of the fourth recording device 501 is retracted according to the fourth embodiment.

Figure 14:
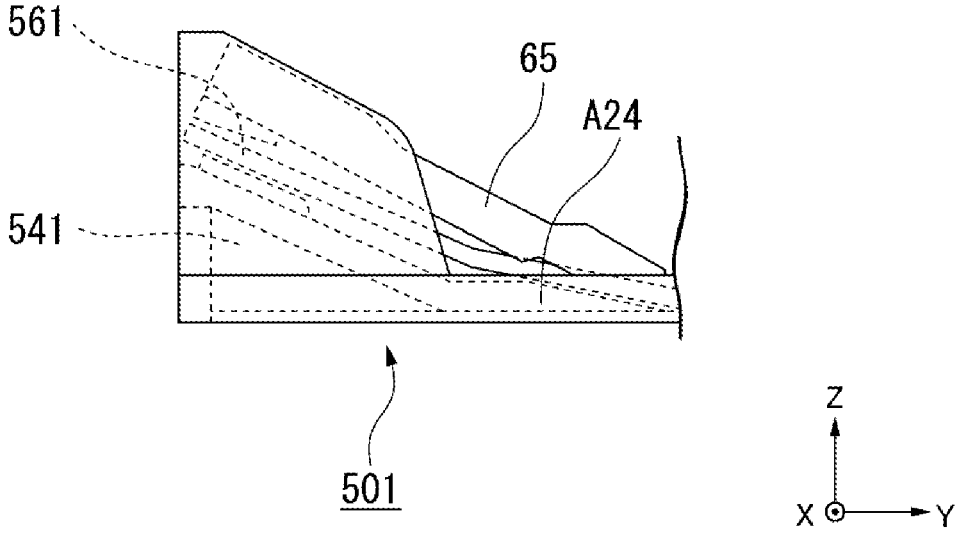
FIG. 14 is a cross-sectional view illustrating an example of the state in which the fourth stopper of the fourth recording device is retracted according to the fourth embodiment.

FIG. 14 is a cross-sectional view illustrating the example of the state in which the fourth stopper 561 of the fourth recording device 501 is retracted according to the fourth embodiment.

Figure 15:
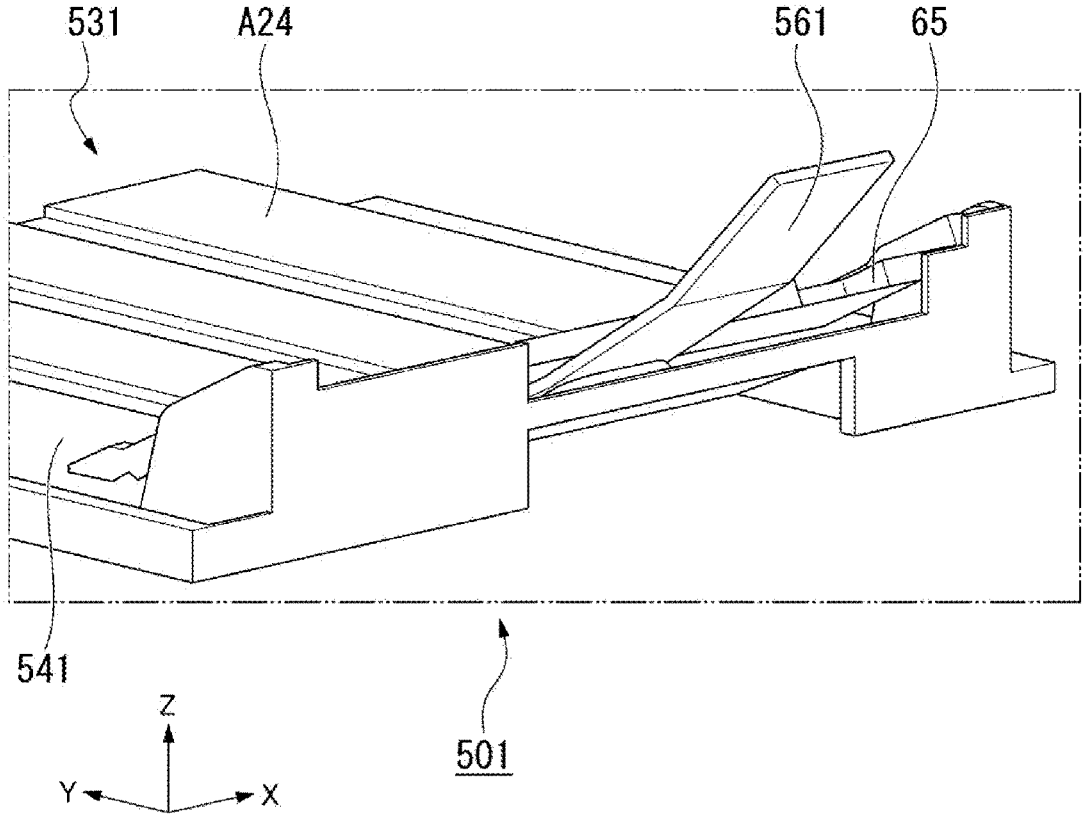
FIG. 15 is an external perspective view illustrating an example of a state in which the fourth stopper of the fourth recording device is pulled out according to the fourth embodiment.

FIG. 15 is an external perspective view illustrating an example of a state in which the fourth stopper 561 of the fourth recording device 501 is pulled out according to the fourth embodiment.

Figure 16:
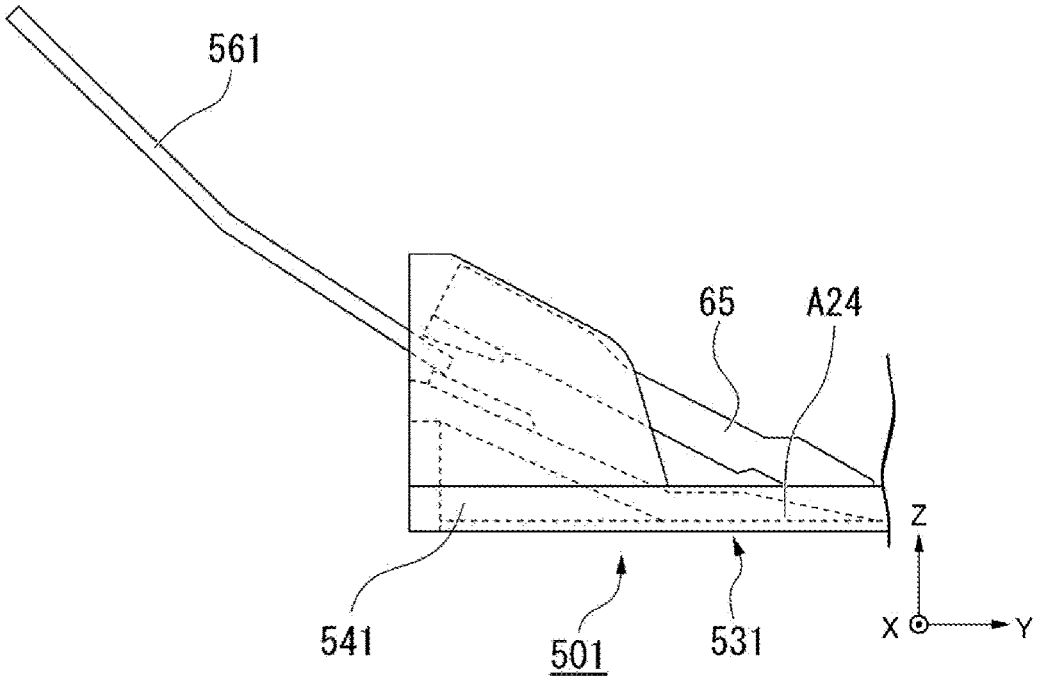
FIG. 16 is a side view illustrating an example of the state in which the fourth stopper of the fourth recording device is pulled out according to the fourth embodiment.

FIG. 16 is a side view illustrating the example of the state in which the fourth stopper 561 of the fourth recording device 501 is pulled out according to the fourth embodiment.

In each of FIGS. 13 to 16, XYZ orthogonal coordinate axes similar to those in FIG. 1 are illustrated.

In the examples of FIGS. 13 to 16, only a front portion of the fourth paper discharge tray 531 in the fourth recording device 501 is illustrated. In the present embodiment, other portions of the fourth recording device 501 are the same as those in the examples of FIGS. 1 to 6, and detailed description thereof will be omitted.

A configuration of the fourth stopper 561 according to the present embodiment is different from the first embodiment, the 1*a*-th embodiment, the second embodiment, or the third embodiment, for example, in that the fourth stopper 561 is not a pivoting mechanism and a mechanism capable of moving in an extension direction is used.

In FIG. 13, a positional relationship among the fourth placement portion 541, the fourth stopper 561, and the guide portion 65 when the fourth stopper 561 is in the retracted state is illustrated.

In FIG. 14, an example of this state in which a cross section near a center in the width direction of the fourth placement portion 541 is viewed with a viewpoint from the positive side to the negative side of the X-axis is illustrated. The cross section is a surface parallel to a YZ plane.

As illustrated in FIG. 14, the fourth stopper 561 is retracted between the fourth placement portion 541 and the guide portion 65.

In FIG. 15, a positional relationship among the fourth placement portion 541, the fourth stopper 561, and the guide portion 65 when the fourth stopper 561 is in the extended state is illustrated.

In FIG. 16, an example of this state in which the fourth placement portion 541, the fourth stopper 561, and the guide portion 65 are viewed with a viewpoint from the positive side to the negative side of the X-axis is illustrated.

Here, a shape of the fourth stopper 561 in the extension direction is a shape according to a shape of a cavity between a fourth placement surface of the fourth placement portion 541 and the guide portion 65, which is a portion that accommodates the fourth stopper 561, and in the present embodiment, the shape of the fourth stopper 561 is an arc shape corresponding to a cavity between the fourth placement surface of the fourth placement portion 541 and a bottom surface of the guide portion 65. That is, the fourth stopper 561 may have a shape that can be accommodated in the cavity, and may have a shape similar to the shape of the cavity, for example.

The fourth stopper 561 is capable of parallel translation.

Therefore, it is possible to easily realize displacement of the fourth stopper 561 in a retracting direction using the force for closing the operating unit 21 with respect to the fourth stopper 561 retracted in a movement direction of the fourth paper discharge tray 531.

Here, in the present embodiment, a shape close to an arc is used as the shape of the extension direction of the fourth stopper 561, but other shapes may be used and, for example, a shape according to the shape of the cavity between the fourth placement portion 541 and the guide portion 65, which is a portion that accommodates the fourth stopper 561, may be used.

The shape in the extending direction of the fourth stopper 561 may not necessarily be a shape having a curvature, and for example, a straight line shape or a combination of two or more straight lines may be used.

In the present embodiment, the shape in the extending direction of the fourth stopper 561 is an arc shape, and the fourth stopper 561 can be retracted in a thickness portion between a top surface of the fourth placement portion 541 and the bottom surface of the guide portion 65 of the fourth paper discharge tray 531.

For example, the fourth stopper 561 may be pulled out to the extended state, and then, a position at which the fourth stopper 561 is pulled out to the extended state may be held by a predetermined semi-fixing scheme. When the operating unit 21 is closed, semi-fixing by the semi-fixing scheme is released, and the fourth stopper 561 is retracted along the arc, thereby preventing the fourth stopper 561 from being damaged.

The semi-fixed scheme is not particularly limited, and various schemes methods may be used.

Here, the fourth recording device 501 may include a biasing portion that biases the fourth stopper 561 toward the extended state.

In this case, since the fourth stopper 561 is biased toward the extended state, the fourth stopper 561 is put into the extended state when the fourth stopper 561 is not in the retracted state by the operating unit 21 or the like, and thus, the user does not need to extend the fourth stopper 561. The biasing portion may be configured using a spring or the like, for example.

Other configurations thereof may be used.

As described above, in the fourth recording device 501 according to the present embodiment, it is possible to prevent the device from being damaged when the operating unit 21 is closed in a state in which the fourth placement portion 541 is accommodated without the fourth stopper 561 provided on the fourth paper discharge tray 531 being retracted.

In the fourth recording device 501 according to the present embodiment, in such a case, the fourth stopper 561 that has not been retracted is retracted by the force of closing the operating unit 21.

A fifth embodiment will be described.

A fifth recording device 601 according to the fifth embodiment will be described with reference to FIGS. 17 to 27.

Figure 17:
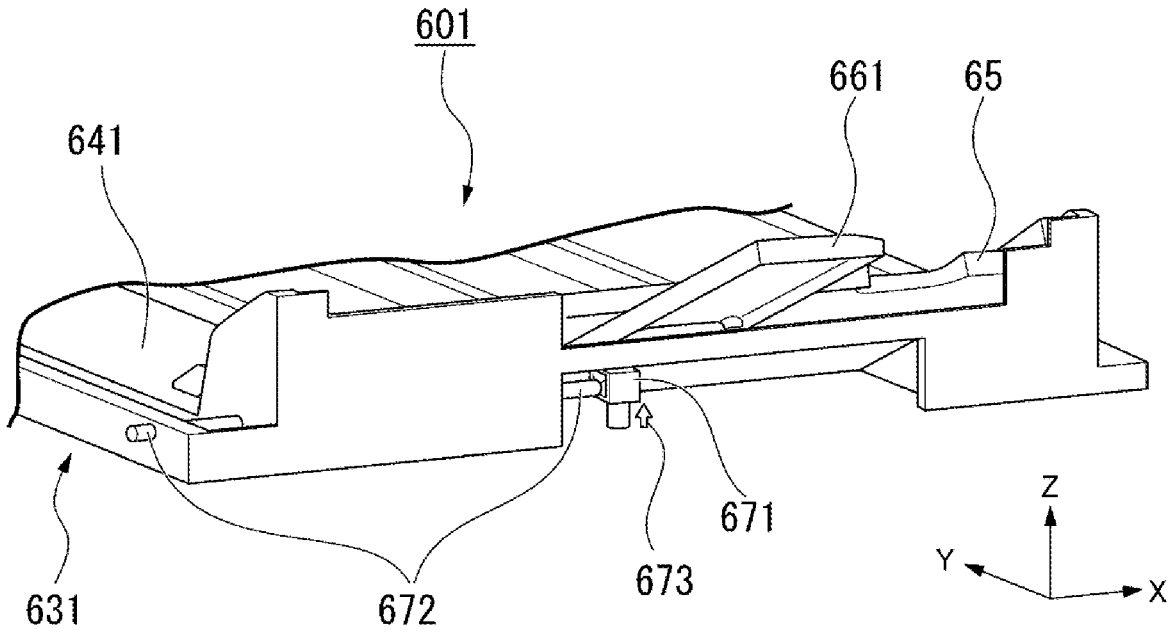
FIG. 17 is an external perspective view illustrating an example of a state in which a fifth stopper of a fifth recording device is pulled out according to a fifth embodiment.

FIG. 17 is an external perspective view illustrating an example of a state in which the fifth stopper 661 of the fifth recording device 601 is pulled out according to the fifth embodiment.

Figure 18:
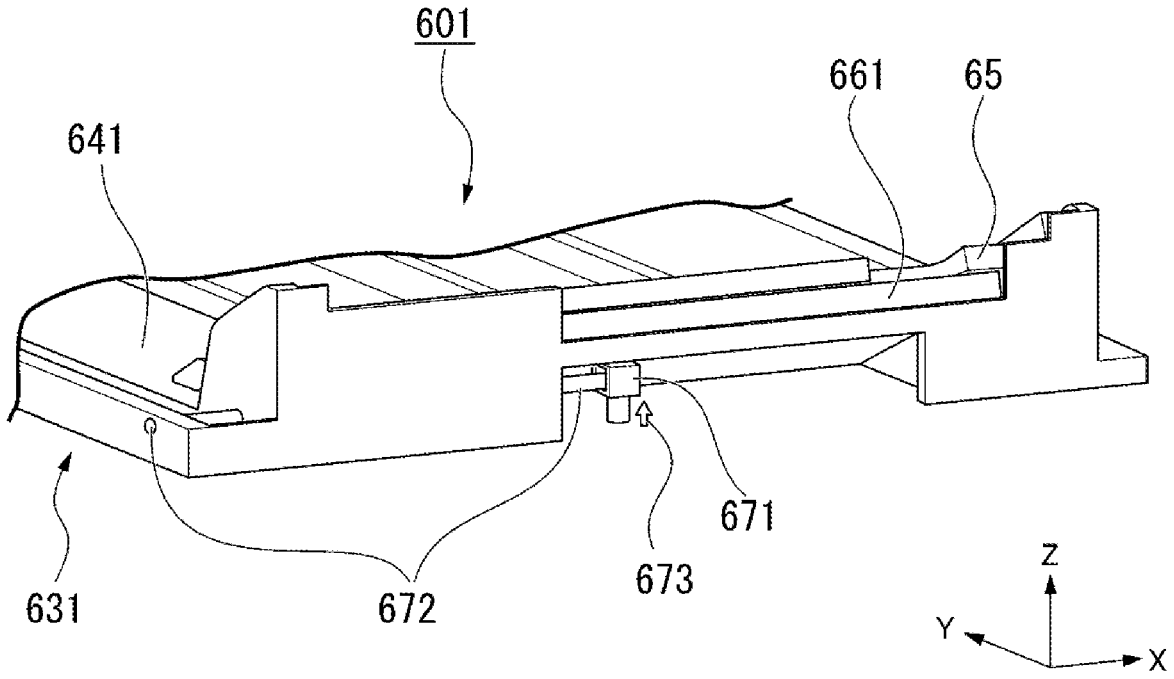
FIG. 18 is an external perspective view illustrating an example of a state in which the fifth stopper of the fifth recording device is retracted according to the fifth embodiment.

FIG. 18 is an external perspective view illustrating an example of a state in which the fifth stopper 661 of the fifth recording device 601 is retracted according to the fifth embodiment.

Figure 19:
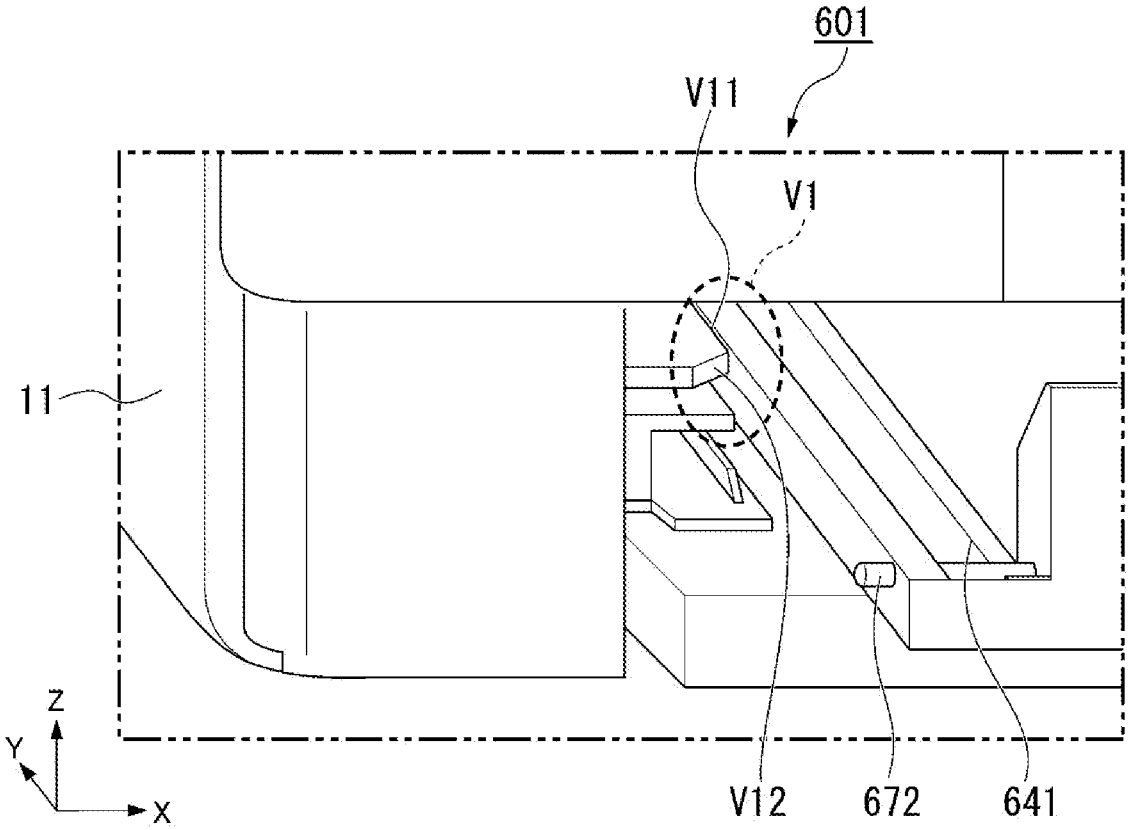
FIG. 19 is an external perspective view illustrating an example of a configuration regarding movement of a switching portion of the fifth recording device according to the fifth embodiment.

FIG. 19 is an external perspective view illustrating an example of a configuration regarding a movement of a switching portion 672 of the fifth recording device 601 according to the fifth embodiment.

Figure 20:
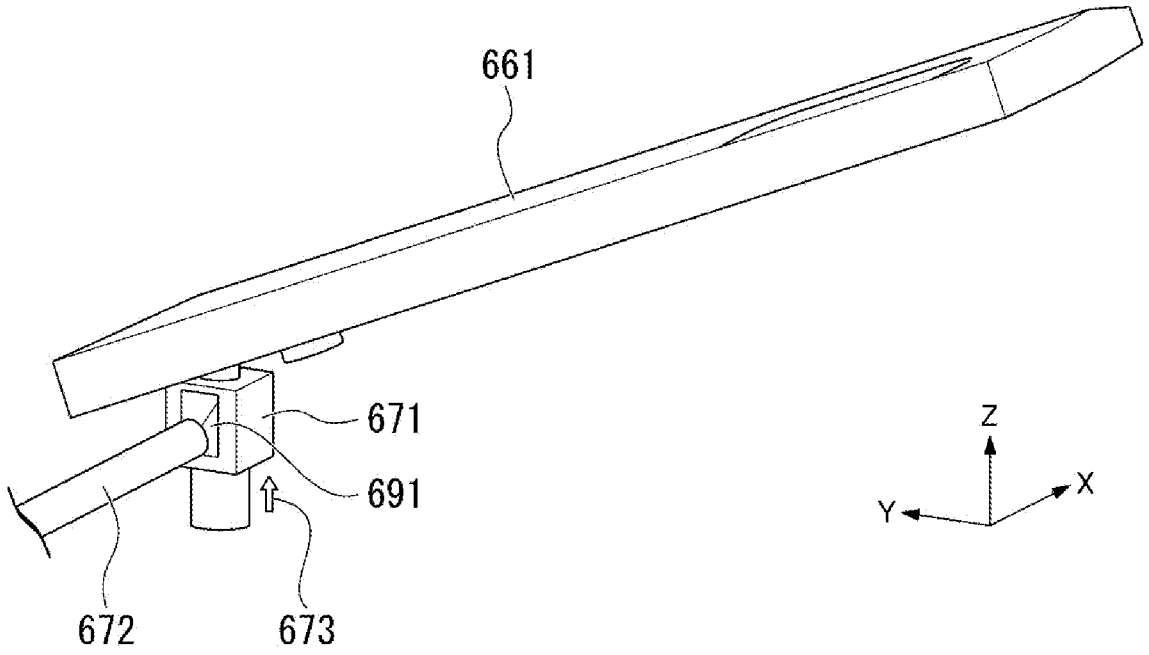
FIG. 20 is an external perspective view illustrating the example of the state in which the fifth stopper of the fifth recording device is pulled out according to the fifth embodiment.

FIG. 20 is an external perspective view illustrating an example of a state in which the fifth stopper 661 of the fifth recording device 601 is pulled out according to the fifth embodiment.

Figure 21:
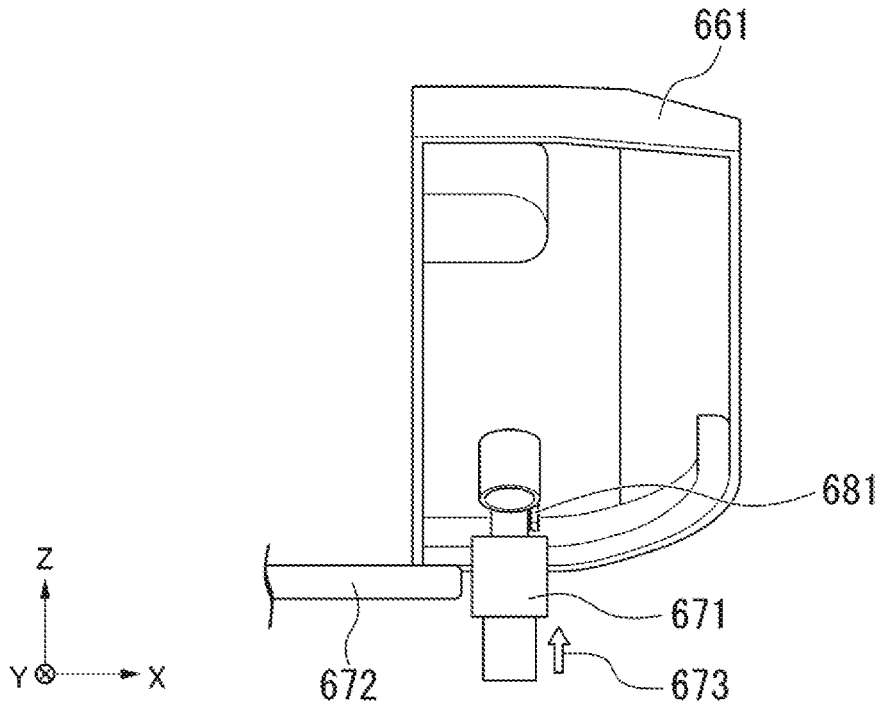
FIG. 21 is an external perspective view illustrating an example of a back side in a state in which the fifth stopper of the fifth recording device is pulled out according to the fifth embodiment.

FIG. 21 is an external perspective view illustrating an example of a back side in a state in which the fifth stopper 661 of the fifth recording device 601 is pulled out according to the fifth embodiment.

Figure 22:
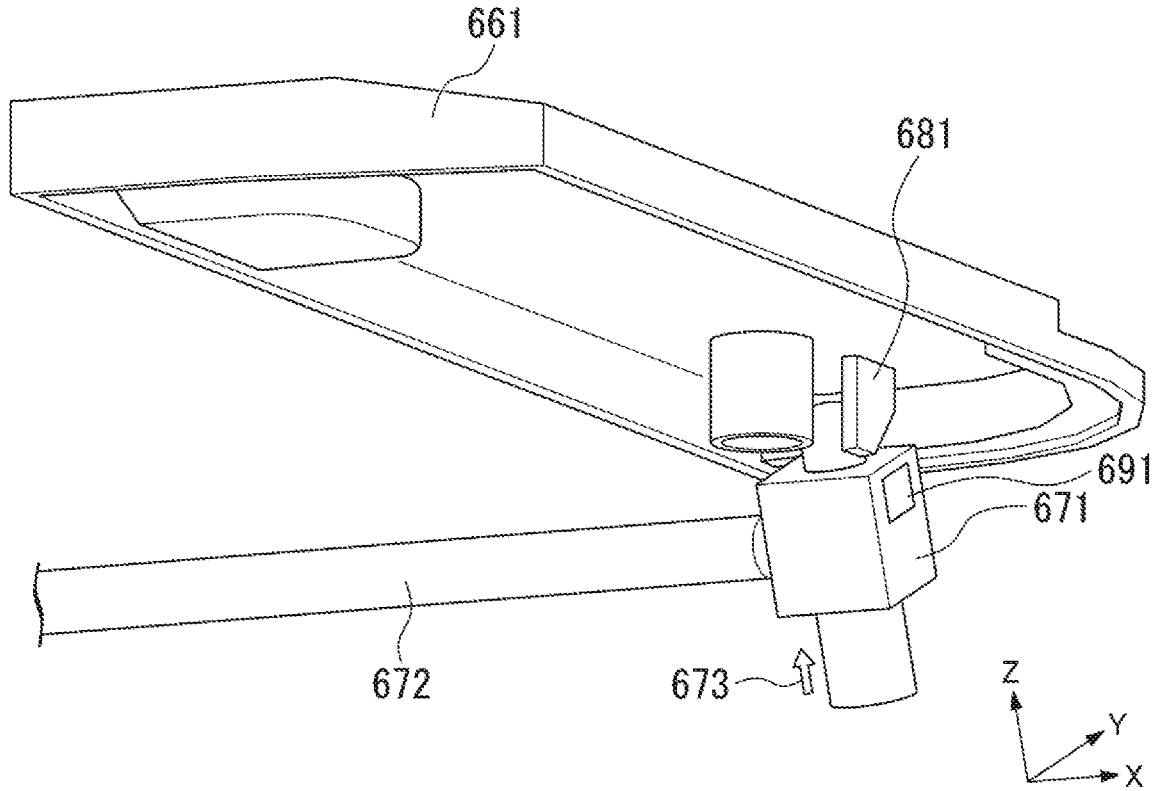
FIG. 22 is an external perspective view illustrating an example of a back side in a state in which the fifth stopper of the fifth recording device is pulled out according to the fifth embodiment.

FIG. 22 is an external perspective view illustrating an example of the back side in the state in which the fifth stopper 661 of the fifth recording device 601 is pulled out according to the fifth embodiment.

Figure 23:
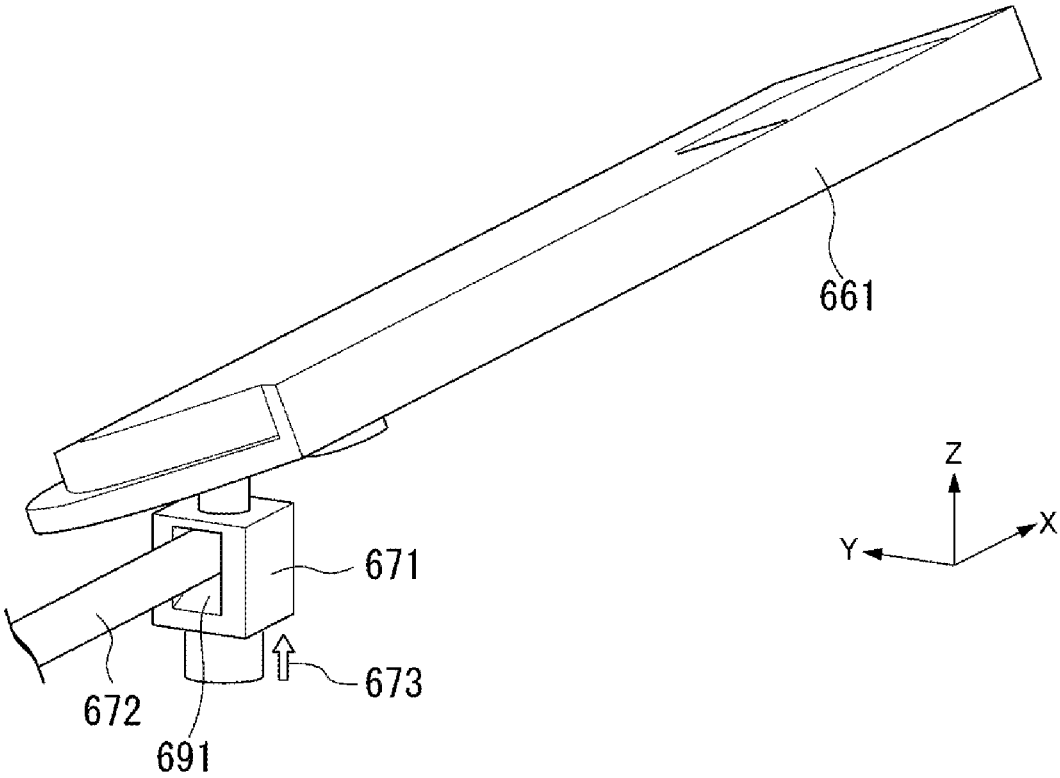
FIG. 23 is an external perspective view illustrating the example of the state in which the fifth stopper of the fifth recording device is retracted according to the fifth embodiment.

FIG. 23 is an external perspective view illustrating an example of a state in which the fifth stopper 661 of the fifth recording device 601 is retracted according to the fifth embodiment.

Figure 24:
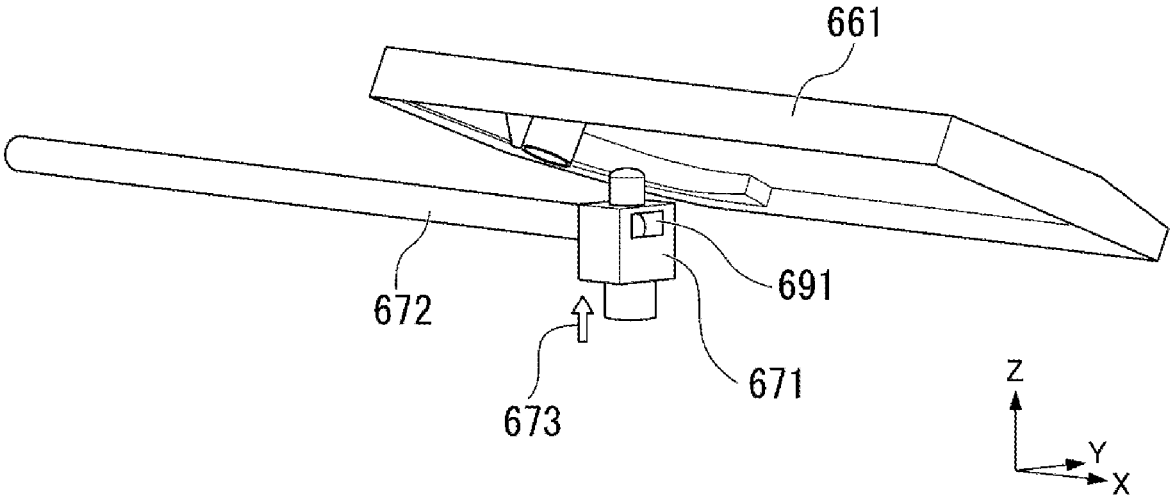
FIG. 24 is an external perspective view illustrating an example of a back side in the state in which the fifth stopper of the fifth recording device is retracted according to the fifth embodiment.

FIG. 24 is an external perspective view illustrating an example of a back side in the state in which the fifth stopper 661 of the fifth recording device 601 is retracted according to the fifth embodiment.

Figure 25:
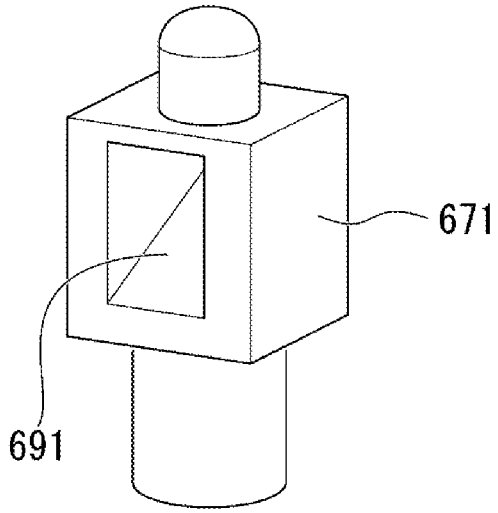
FIG. 25 is an external perspective view illustrating an example of a fifth holding portion of the fifth recording device according to the fifth embodiment.

FIG. 25 is an external perspective view illustrating an example of a fifth holding portion 671 of the fifth recording device 601 according to the fifth embodiment.

Figure 26:
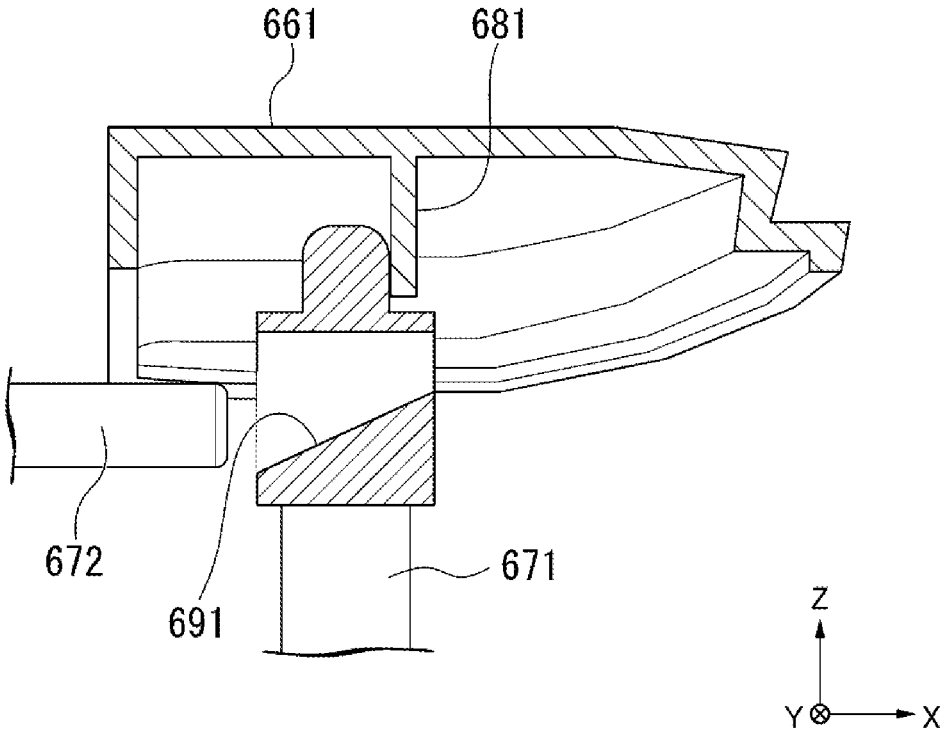
FIG. 26 is a cross-sectional view illustrating an example of a state in which the fifth stopper of the fifth recording device is pulled out according to the fifth embodiment.

FIG. 26 is a cross-sectional view illustrating an example of a state in which the fifth stopper 661 of the fifth recording device 601 is pulled out according to the fifth embodiment.

Figure 27:
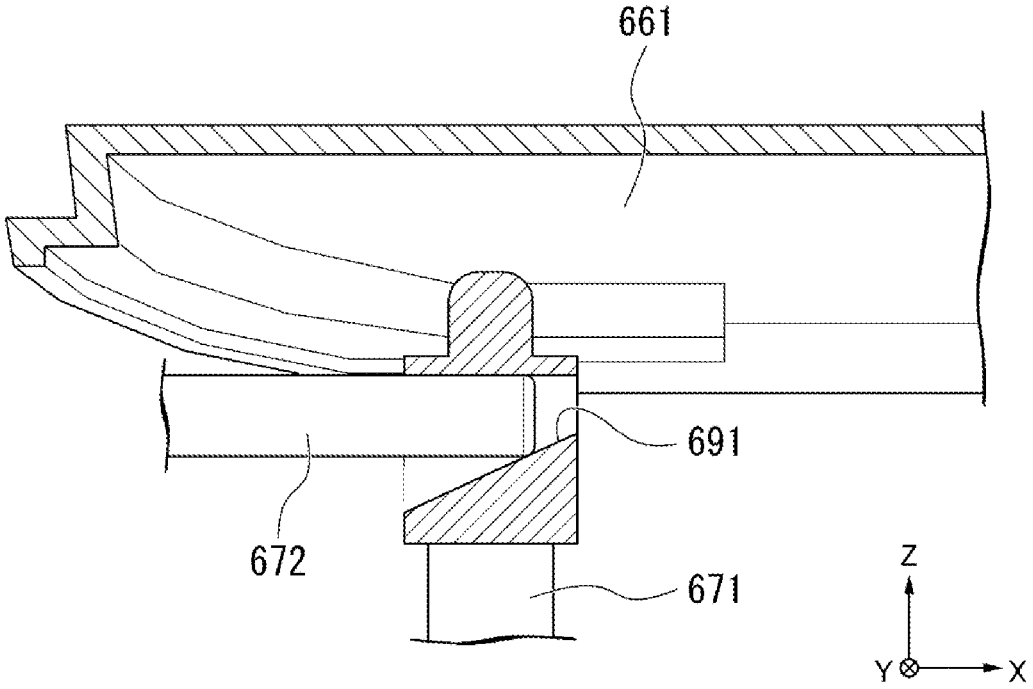
FIG. 27 is a cross-sectional view illustrating the example of the state in which the fifth stopper of the fifth recording device is retracted according to the fifth embodiment.

FIG. 27 is a cross-sectional view illustrating an example of a state in which the fifth stopper 661 of the fifth recording device 601 is retracted according to the fifth embodiment.

In FIGS. 17 to 24 and 26 and 27, XYZ orthogonal coordinate axes similar to those in FIG. 1 are illustrated.

In the examples of FIGS. 17 to 27, only portions regarding the configuration of the fifth stopper 661, the fifth holding portion 671 and the switching portion 672 of the fifth recording device 601 are shown. In the present embodiment, other portions of the fifth recording device 601 are the same as those in the examples of FIGS. 1 to 6, and detailed description thereof will be omitted.

The fifth recording device 601 includes a fifth holding portion 671, a switching portion 672, and a lock biasing spring (not illustrated).

The lock biasing spring is a spring that biases the fifth holding portion 671 in a lock biasing direction 673 that is an upward direction.

The fifth holding portion 671 moves up and down according to the position of the switching portion 672.

The fifth holding portion 671 restricts pivoting of the fifth stopper 661 when the fifth holding portion 671 is located upward by the lock biasing spring according to the position of the switching portion 672.

The fifth holding portion 671 may be referred to as, for example, a lock. Further, the switching portion 672 may be referred to as, for example, a lock shaft.

The fifth stopper 661 is biased by a biasing portion (not illustrated) in a direction in which the fifth stopper 661 is pivoted and displaced from the extended state to the retracted state. The biasing portion may be configured using, for example, a torsion spring.

A rotation prevention wall 681 that is a wall that prevents pivoting is provided at a predetermined portion on a surface on the lower side of the fifth stopper 661.

As illustrated in FIGS. 17, 20, 21, 22 and 26, when the fifth placement portion 641 is at the use position and the fifth stopper 661 is in the extended state, the switching portion 672 does not contact with the fifth holding portion 671 and the fifth holding portion 671 is biased in the lock biasing direction 673 by the lock biasing spring. The fifth holding portion 671 is located near the rotation prevention wall 681 from a lower side of the fifth stopper 661 and collides with the rotation prevention wall 681 of the fifth stopper 661 which is about to be displaced to the retracted state, thereby realizing a lock that maintains the extended state of the fifth stopper 661.

On the other hand, when the fifth stopper 661 is in the extended state and the fifth placement portion 641 is displaced from the use position to the accommodation position, the switching portion 672 comes into contact with the fifth holding portion 671 as illustrated in FIGS. 18, 23, 24, and 27, and the fifth holding portion 671 is moved downward. The fifth holding portion 671 is moved downward relative to the rotation prevention wall 681 of the fifth stopper 661, the lock is released, and the fifth stopper 661 is displaced to the retracted state.

As illustrated in FIGS. 24 and 25 and the like, in the present embodiment, the switching portion 672 has a rod shape and is movable in the direction parallel to the X-axis.

Further, the fifth holding portion 671 has an inclined recessed portion 691 having an inclined surface directed upward from the bottom inside a recessed portion. In the present embodiment, the inclined recessed portion 691 penetrates.

In the present embodiment, the switching portion 672 is biased by a biasing portion (not illustrated) in a direction opposite to a direction in which there is the fifth holding portion 671 with respect to the switching portion 672. The biasing direction of the biasing portion is the direction from the positive side to the negative side of the X-axis. The biasing portion may be configured using a spring, for example.

As illustrated in FIG. 26, the fifth holding portion 671 is biased upward when a tip of the switching portion 672 is not inserted into inclined recessed portion 691 of the fifth holding portion 671.

That is, when the fifth stopper 661 is used, the switching portion 672 is biased to the side opposite to the fifth holding portion 671 and is separated from the fifth holding portion 671, and therefore, the fifth holding portion 671 protrudes upward by force in the lock biasing direction 673 of the lock biasing spring. The fifth holding portion 671 projecting upwardly and the rotation prevention wall 681 of the fifth stopper 661 interfere with each other, so that a use position of the fifth stopper 661 is held against force biasing the fifth stopper 661 in the retracting direction.

Also, as illustrated in FIG. 27, when the tip of the switching portion 672 is inserted into inclined recessed portion 691 of the fifth holding portion 671, the fifth holding portion 671 is moved downward. Accordingly, the locking of the fifth stopper 661 is released, and the fifth stopper 661 is displaced to the retracted state.

Thus, as the fifth placement portion 641 is accommodated, the switching portion 672 moves toward the fifth holding portion 671 and pushes the fifth holding portion 671 downward so that interference between the fifth holding portion 671 and the rotation prevention wall 681 is released and the fifth stopper 661 is displaced to the retracted state.

Here, although the fifth holding portion 671 is disposed on the positive side of the X-axis with respect to the switching portion 672 in the direction parallel to the X-axis in the present embodiment, a configuration in which the fifth holding portion 671 is disposed on the negative side of the X-axis with respect to the switching portion 672 may be used as another example.

As illustrated in FIG. 19, in the present embodiment, a configuration in which, when the fifth placement portion 641 is displaced from the use position to the accommodation position, the switching portion 672 collides with a predetermined portion of the fifth recording device 601, and the switching portion 672 is moved in the direction toward the fifth holding portion 671 is adopted. On the other hand, when the fifth placement portion 641 is displaced from the accommodation position to the use position, the switching portion 672 is released and moves away from the fifth holding portion 671. Thus, the locking of the fifth stopper 661 is released by an operation in which the fifth placement portion 641 is accommodated, so that the fifth stopper 661 is pivoted and retracted.

In an example of FIG. 19, the fifth placement portion 641 is displaced between the accommodation position and the use position along a first guide surface V11 of a guide portion V1, which is a predetermined portion of the fifth recording device 601. A structure in which, when the fifth placement portion 641 is at the use position, a part of the switching portion 672 can protrude from the fifth placement portion 641 toward the negative side of the X-axis, and the part of the switching portion 672 is gradually moved to the positive side of the X-axis as the fifth placement portion 641 is displaced to the accommodation position is adopted.

Specifically, the guide portion V1 has the first guide surface V11 extending in a direction parallel to the Y-axis, and a second guide surface V12 provided continuously in front of the first guide surface V11. The second guide surface V12 is a surface that is inclined with respect to the first guide surface V11, and is a surface that is inclined toward the negative side of the X-axis from the rear side to the front side in an example of FIG. 19.

In a process in which the fifth placement portion 641 is displaced from the use position to the accommodation position, first, an end of the switching portion 672 protruding from the fifth placement portion 641 comes into contact with the second guide surface V12 and moves along the second guide surface V12, and then, the end portion reaches the first guide surface V11 and abuts on the first guide surface V11. In this process, the switching portion 672 is pushed to the positive side of the X-axis by the guide portion V1.

At least the fifth stopper 661 in the extended state overlaps the operating unit 21 in the parallel state when viewed in a direction perpendicular to the first surface A1.

When a configuration in which the fifth stopper 661 is put into the retracted state when the fifth placement portion 641 is at the accommodation position is adopted, a case in which the fifth placement portion 641 is at the accommodation position and the fifth stopper 661 is in the extended state does not occur, but this case has been described in order to describe interference between the fifth stopper 661 and the operating unit 21.

Further, as a disposition relationship, the fifth stopper 661 protrudes to the outside of the housing 11 when the fifth placement portion 641 is at the accommodation position and the fifth stopper 661 is in the extended state.

When the fifth placement portion 641 is displaced from the use position to the accommodation position, the fifth stopper 661 is put into the retracted state.

Therefore, since the fifth stopper 661 is put into the retracted state when the fifth placement portion 641 is accommodated, it is possible to curb the damage more reliably without forgetting the retraction of the fifth stopper 661.

Thus, the fifth placement portion 641 interlocks with the fifth stopper 661.

The fifth recording device 601 includes the biasing portion that biases the fifth stopper 661 toward the retracted state, the fifth holding portion 671 that holds the fifth stopper 661 in the extended state, and the switching portion 672 capable of switching the fifth holding portion 671 to a held state in which the fifth stopper 661 is held and a released state in which holding of the fifth stopper 661 is released.

When the fifth placement portion 641 is displaced from the use position to the accommodation position, the switching portion 672 brings the fifth holding portion 671 into the released state.

Therefore, the fifth stopper 661 is biased toward the retracted state so that the fifth stopper 661 is retracted when the lock is released. Since the lock is released when the fifth placement portion 641 is accommodated, it is possible to retract the fifth stopper 661 with a simple configuration. Further, since the presence of the lock provides a click feeling when the user extends the fifth stopper 661, the usability is improved.

Other configurations thereof may be used.

Here, in the present embodiment, since a locking mechanism is provided in a concave portion on the back side of the fifth stopper 661, for example, it is possible to reduce a size of a product in a height direction.

The fifth holding portion 671 holds the fifth stopper 661 when the fifth stopper 661 is put into the extended state when the fifth placement portion 641 is at the use position.

Therefore, when the fifth stopper 661 is put into the extended state by the user, the fifth holding portion 671 locks the fifth stopper 661 in the extended state, and the fifth stopper 661 is put into the retracted state due to the biasing portion when not unnecessary, and thus, it is possible to curb the fifth stopper 661 becoming an obstacle when the fifth stopper 661 is not used.

Here, when the fifth placement portion 641 is at the use position, the fifth stopper 661 may not necessarily be in the extended state, and may be at the retracting position.

For example, the fifth placement portion 641 has the inclined portion 51 that is inclined so that the downstream in the medium discharge direction is upward and performs support.

The fifth stopper 661 is retracted in the inclined portion 51 in the retracted state.

Therefore, the presence of the inclined portion 51 can curb jumping-out of the discharged medium. Further, the fifth stopper 661 is retracted in the inclined portion 51, making it possible to reduce a size of the device.

Other configurations thereof may be used.

For example, the placement surface A11 on which the medium is placed in the fifth placement portion 641 intersects with the support surface A12 that supports the medium in the fifth stopper 661.

Therefore, since the fifth stopper 661 is inclined with respect to the placement surface A11, it is possible to curb jumping-out of the medium.

Other configurations thereof may be used.

For example, the fifth recording device 601 may include a drive source 161 that displaces the fifth placement portion 641 to the accommodation position and the use position.

Therefore, the fifth paper discharge tray 631 is automatically moved, so that usability is improved. When the fifth paper discharge tray 631 is automatically retracted with the fifth stopper 661 being in the extended state, the user is highly likely to close the operating unit 21 without noticing that the fifth stopper 661 is in the extended state, but even in such a case, it is possible to curb the damage. Other configurations thereof may be used.

Here, a drive source for the fifth placement portion 641 does not necessarily have to be the same as the drive source 161 of the transport roller, and the fifth recording device 601 may include another drive source.

As described above, in the fifth recording device 601 according to the present embodiment, it is possible to prevent the device from being damaged when the operating unit 21 is closed in a state in which the fifth placement portion 641 is retracted without the fifth stopper 661 provided on the fifth paper discharge tray 631 being retracted.

In a sixth recording device 701 according to the present embodiment, the fifth stopper 661 is retracted in conjunction with the accommodation of the fifth placement portion 641, thereby avoiding a situation in which only the fifth placement portion 641 is accommodated without the fifth stopper 661 being retracted.

A sixth embodiment will be described.

The sixth recording device 701 according to the sixth embodiment will be described with reference to FIGS. 28 to 31.

Figure 28:
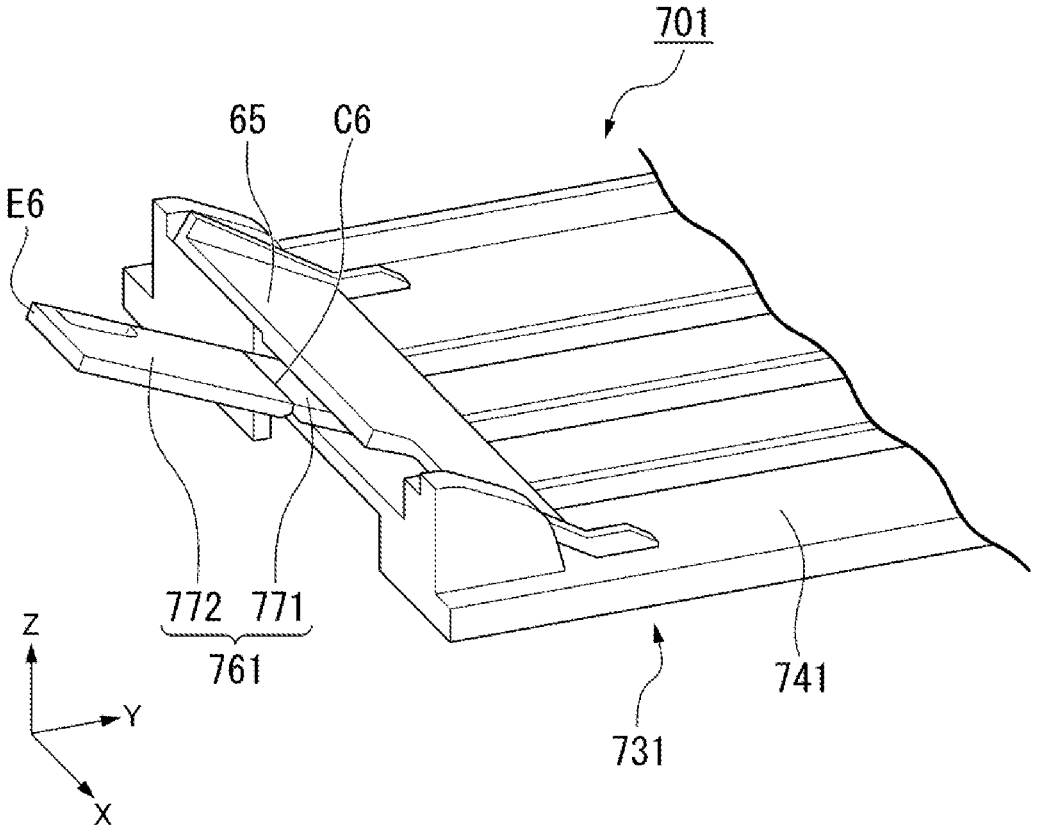
FIG. 28 is an external perspective view illustrating an example of a configuration of a sixth stopper of a sixth recording device according to a sixth embodiment.

FIG. 28 is an external perspective view illustrating an example of a configuration of a sixth stopper 761 of the sixth recording device 701 according to the sixth embodiment.

Figure 29:
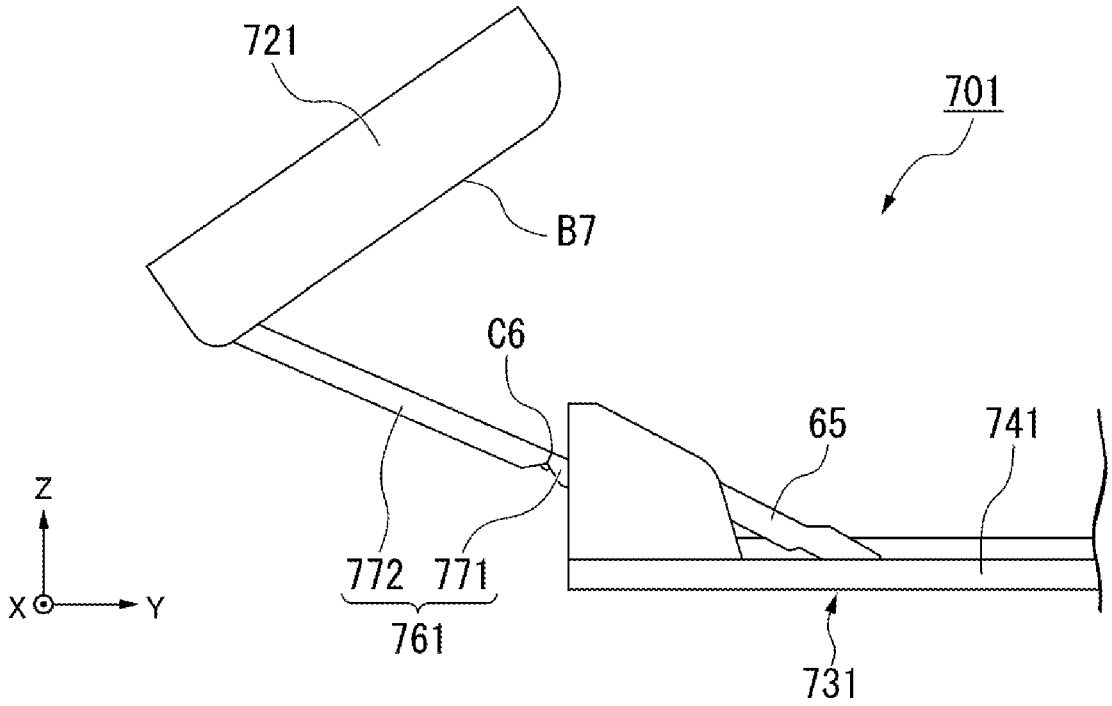
FIG. 29 is a side view illustrating an example of the configuration of the sixth stopper of the sixth recording device according to the sixth embodiment.

FIG. 29 is a side view illustrating an example of the configuration of the sixth stopper 761 of the sixth recording device 701 according to the sixth embodiment.

Figure 30:
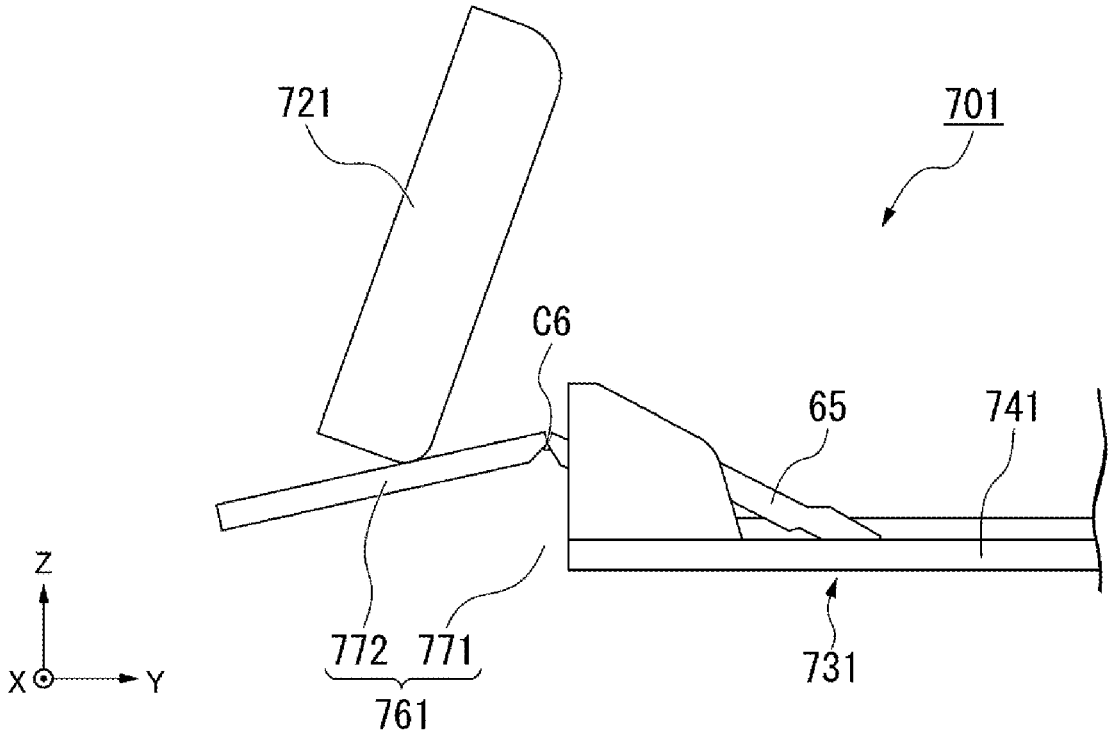
FIG. 30 is a side view illustrating an example of the configuration of the sixth stopper of the sixth recording device according to the sixth embodiment.

FIG. 30 is a side view illustrating an example of the configuration of the sixth stopper 761 of the sixth recording device 701 according to the sixth embodiment.

Figure 31:
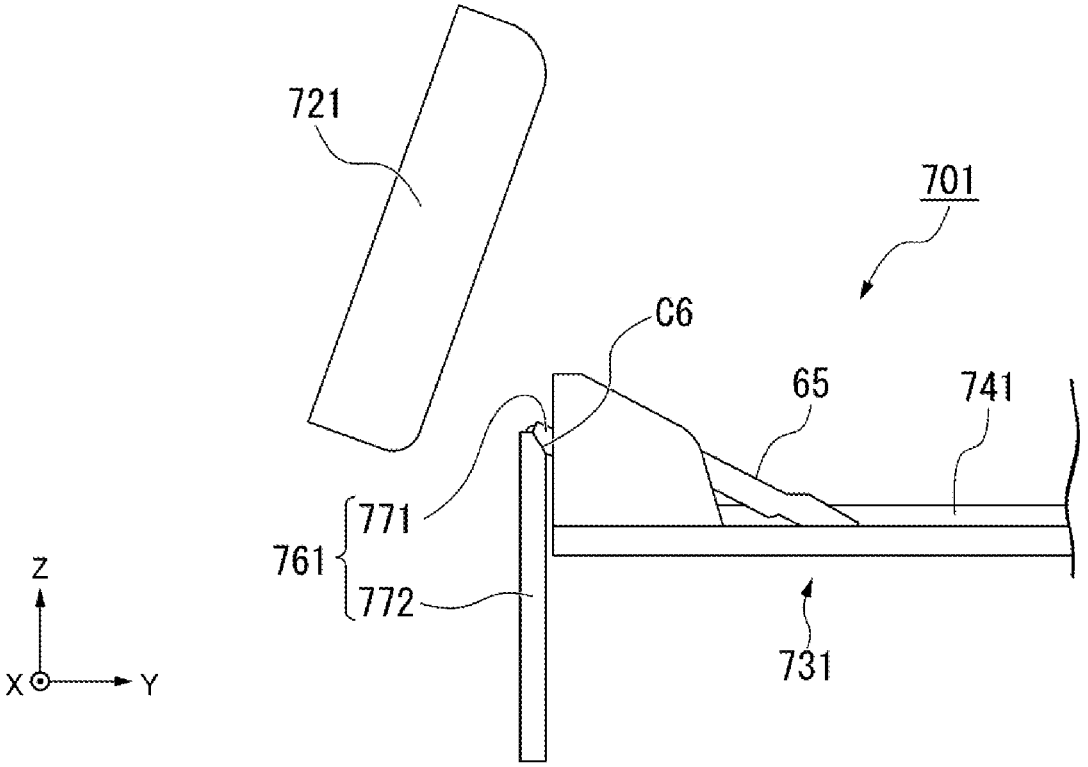
FIG. 31 is a side view illustrating an example of the configuration of the sixth stopper of the sixth recording device according to the sixth embodiment.

FIG. 31 is a side view illustrating an example of the configuration of the sixth stopper 761 of the sixth recording device 701 according to the sixth embodiment.

In FIGS. 28 to 31, XYZ orthogonal coordinate axes similar to those in FIG. 1 are illustrated.

In the examples of FIGS. 28 to 31, only a front portion of the sixth paper discharge tray 731 in the sixth recording device 701 is illustrated. In the present embodiment, other portions of the sixth recording device 701 are the same as those in the examples of FIGS. 1 to 6, and detailed description thereof will be omitted.

The configuration according to the present embodiment may be applied to, for example, each of the first embodiment, the 1*a*-th embodiment, and the second to fifth embodiments, or may be implemented independently of these.

The sixth stopper 761 includes a first extension portion 771 that is displaced with respect to the sixth placement portion 741 and a second extension portion 772 that pivots about the sixth pivoting shaft C6 with respect to the first extension portion 771.

The sixth pivoting shaft C6 extends parallel to the first surface A1.

Therefore, when a back surface B7 of the sixth operating unit 721 abuts on the sixth tip E6 of the sixth stopper 761, the second extension portion 772 pivots about the sixth pivoting shaft C6 parallel to the first surface A1, making it possible to curb damage of the sixth stopper 761.

Here, in the present embodiment, a configuration in that, in an extension direction of the sixth stopper 761, the sixth stopper 761 is divided into a first extension portion 771 and a second extension portion 772, and the second extension portion 772 on the side in which the sixth tip E6 is present can be bent by pivoting is adopted. In the present embodiment, the sixth pivoting shaft C6 is a tiltable shaft that is perpendicular to the discharge direction and extends in a horizontal direction. The sixth pivoting shaft C6 may be a shaft extending in a direction intersecting the horizontal direction as long as the sixth pivoting shaft C6 extends toward the first surface A1.

Thus, in the present embodiment, the sixth stopper 761 is configured using two parts, that is, the first extension portion 771 and the second extension portion 772, and are integrated so that the first extension portion 771 and the second extension portion 772 extend linearly, for example, a projection portion (not illustrated), when used.

As in an example of FIG. 29, an example of FIG. 30, and an example of FIG. 31, for example, when the sixth operating unit 721 contacts the sixth stopper 761 when closed and the user applies force to close the sixth operating unit 721 with a predetermined load or more, a protrusion portion (not illustrated) comes off, and the second extension portion 772 at the tip is bent around the sixth pivoting shaft C6 not to resist the force of the user.

Although the case in which the second extension portion 772 can be bent downward has been described in the present embodiment, a configuration in which the second extension portion 772 can be bent upward may be used as another example.

At least a portion of the second extension portion 772 pivoting about the sixth pivoting shaft C6 does not overlap the operating unit 21 in the parallel state when viewed in the direction perpendicular to the first surface A1.

Therefore, since the second extension portion 772 bent around the sixth pivoting shaft C6 does not overlap the sixth operating unit 721 and can be visually recognized, the user can notice that the retraction of the sixth stopper 761 has been forgotten.

Other configurations thereof may be used.

In the present embodiment, it is possible to remind the user that the retraction of the sixth stopper 761 has been forgotten without damaging the sixth stopper 761, and request the user to retract the sixth stopper 761.

As described above, in the sixth recording device 701 according to the present embodiment, it is possible to prevent the device from being damaged when the operating unit 21 is closed in a state in which the sixth placement portion 741 is accommodated without the sixth stopper 761 provided on the sixth paper discharge tray 731 being retracted.

In the sixth recording device 701 according to the present embodiment, in such a case, the second extension portion 772 of the sixth stopper 761 that has not been retracted is retracted by the force of closing the operating unit 21. Such displacement of the second extension portion 772 makes it possible to remind the user that the sixth stopper 761 is not retracted.

A seventh embodiment will be described.

A seventh recording device 801 according to the seventh embodiment will be described with reference to FIGS. 32 to 41.

Figure 32:
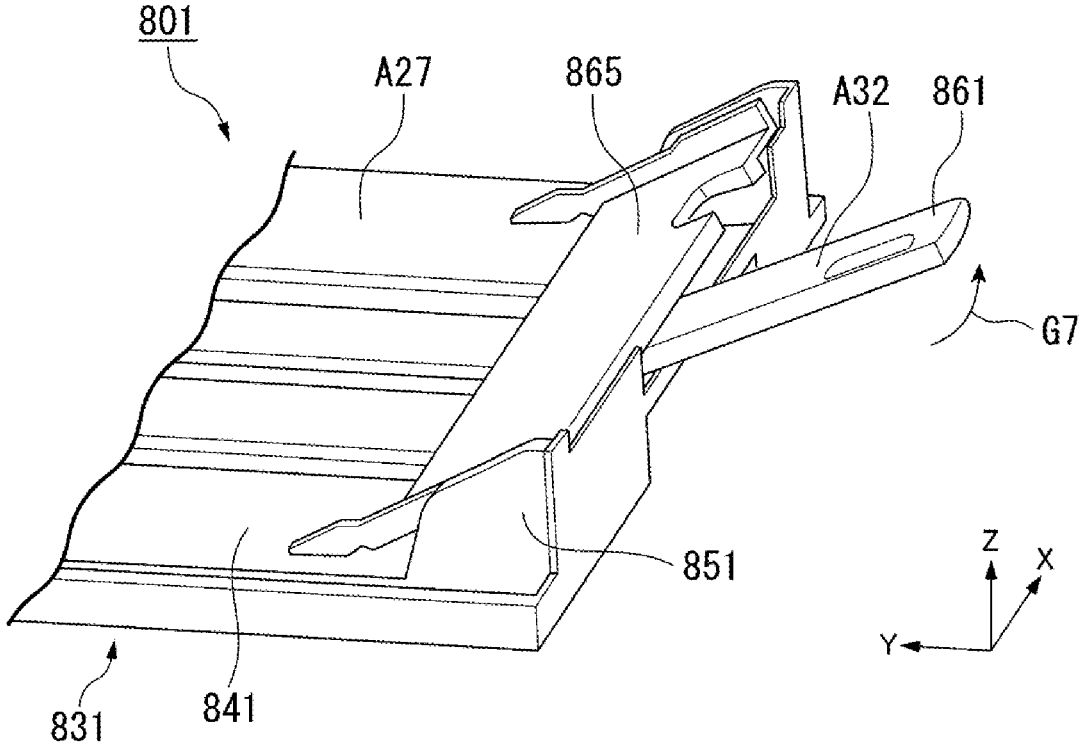
FIG. 32 is an external perspective view illustrating an example of a state in which a seventh paper discharge tray of a seventh recording device is pulled out and a seventh stopper is pulled out according to a seventh embodiment.

FIG. 32 is an external perspective view illustrating an example of a state in which the seventh paper discharge tray 831 of the seventh recording device 801 according to the seventh embodiment is pulled out and the seventh stopper 861 is pulled out.

Figure 33:
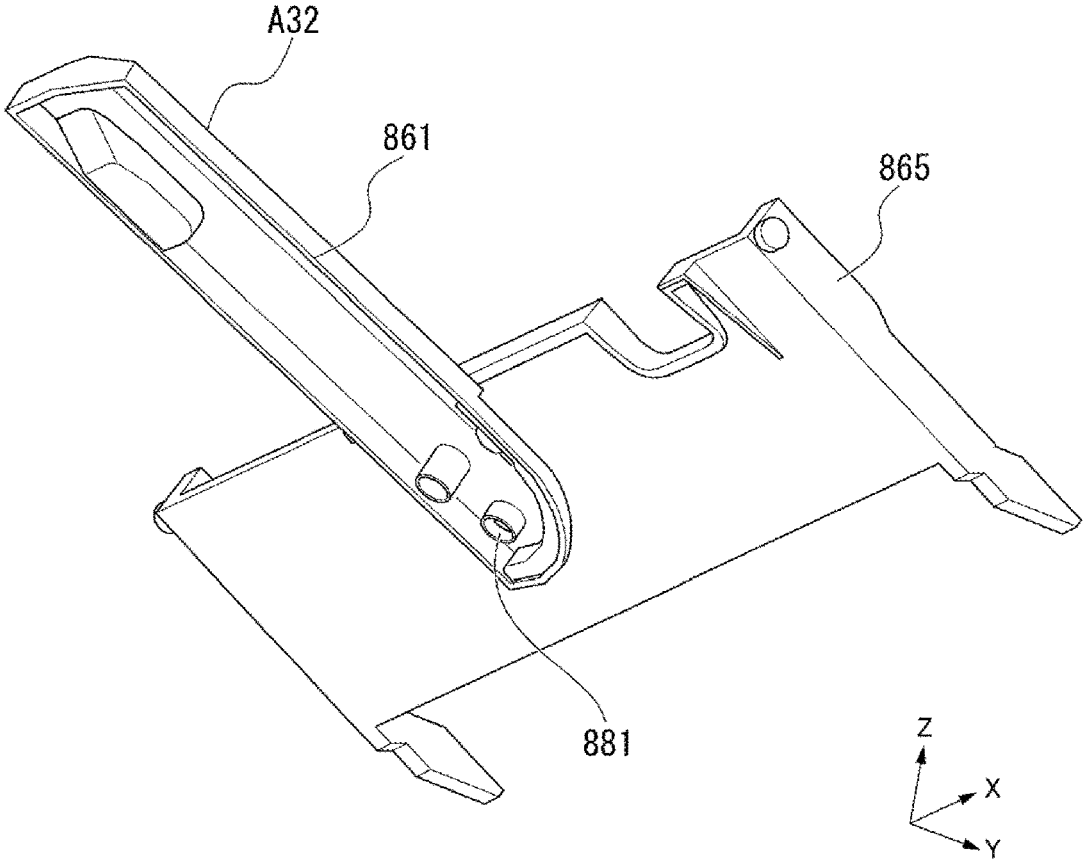
FIG. 33 is an external perspective view illustrating an example of a back side in the state in which the seventh paper discharge tray of the seventh recording device is pulled out and the seventh stopper is pulled out according to the seventh embodiment.

FIG. 33 is an external perspective view illustrating an example of a back side in the state in which the seventh paper discharge tray 831 of the seventh recording device 801 according to the seventh embodiment is pulled out and the seventh stopper 861 is pulled out.

Figure 34:
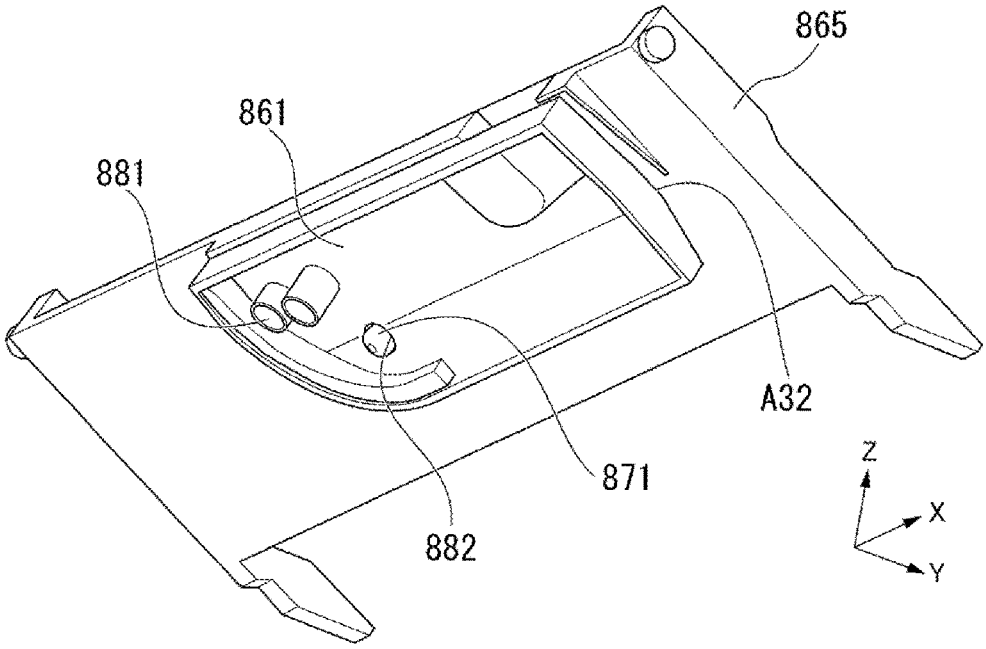
FIG. 34 is an external perspective view illustrating an example of a back side in the state in which the seventh paper discharge tray of the seventh recording device is pulled out and the seventh stopper is retracted according to the seventh embodiment.

FIG. 34 is an external perspective view illustrating an example of a back side in a state in which the seventh paper discharge tray 831 of the seventh recording device 801 according to the seventh embodiment is pulled out and the seventh stopper 861 is retracted.

Figure 35:
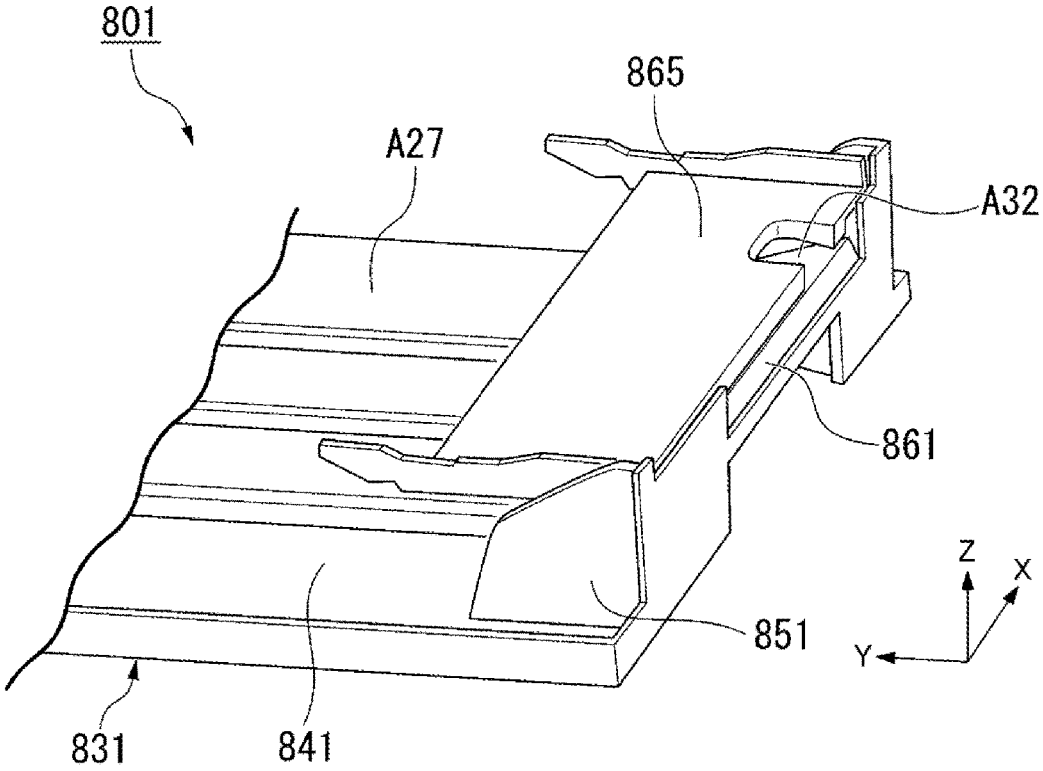
FIG. 35 is an external perspective view illustrating an example of a state in which the seventh paper discharge tray of the seventh recording device is retracted and the seventh stopper is retracted according to the seventh embodiment.

FIG. 35 is an external perspective view illustrating an example of a state in which the seventh paper discharge tray 831 of the seventh recording device 801 according to the seventh embodiment is retracted and the seventh stopper 861 is retracted.

Figure 36:
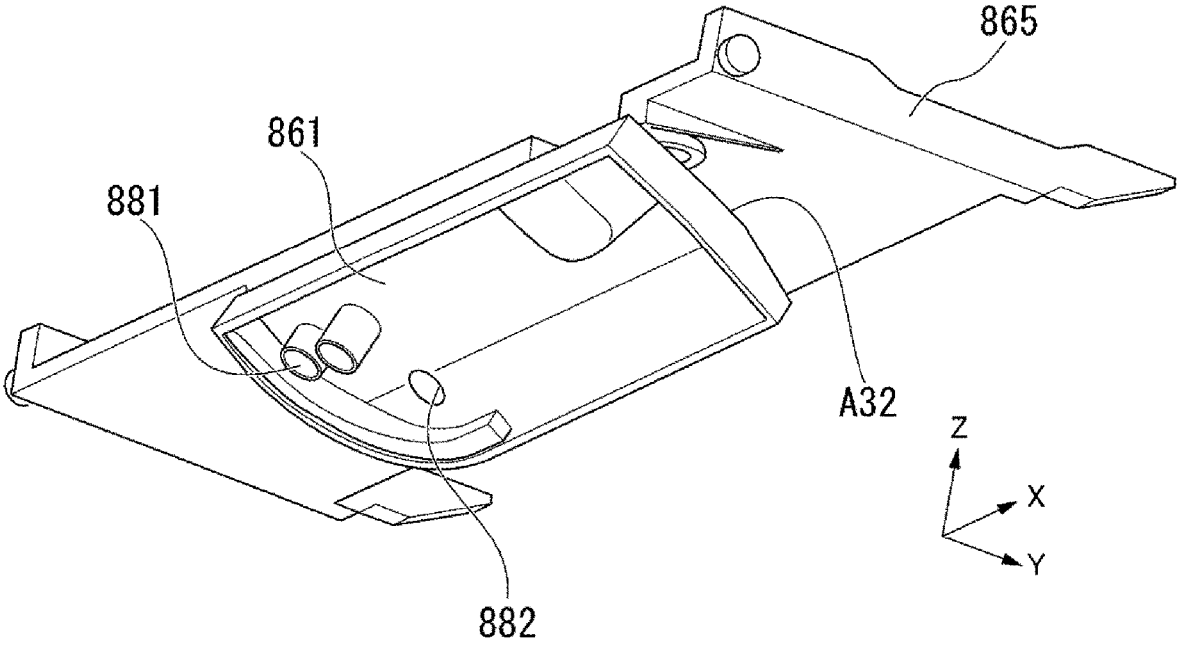
FIG. 36 is an external perspective view illustrating an example of a back surface in the state in which the seventh paper discharge tray of the seventh recording device is retracted and the seventh stopper is retracted according to the seventh embodiment.

FIG. 36 is an external perspective view illustrating an example of a back surface in the state in which the seventh paper discharge tray 831 of the seventh recording device 801 according to the seventh embodiment is retracted and the seventh stopper 861 is retracted.

Figure 37:
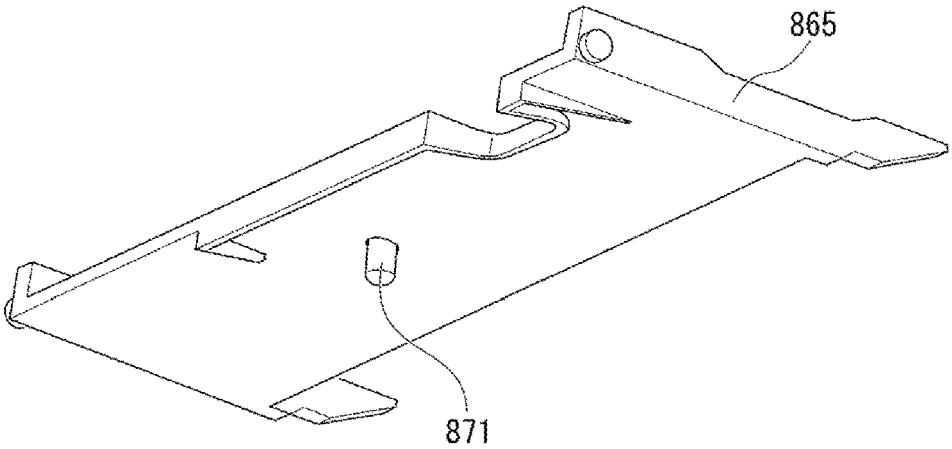
FIG. 37 is an external perspective view illustrating an example of a back surface of a seventh guide portion of the seventh recording device according to the seventh embodiment.

FIG. 37 is an external perspective view illustrating an example of a back surface of the seventh guide portion 865 of the seventh recording device 801 according to the seventh embodiment.

Figure 38:
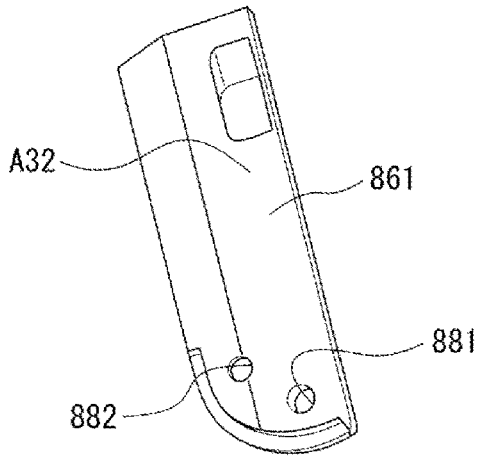
FIG. 38 is an external perspective view illustrating an example of the seventh stopper of the seventh recording device according to the seventh embodiment.

FIG. 38 is an external perspective view illustrating an example of the seventh stopper 861 of the seventh recording device 801 according to the seventh embodiment.

Figure 39:
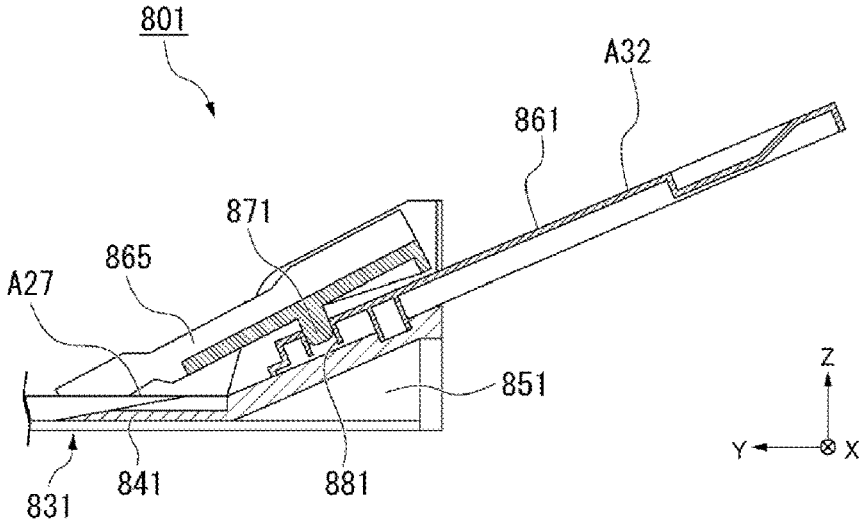
FIG. 39 is a side view illustrating an example of engagement between the seventh guide portion and the seventh stopper of the seventh recording device according to the seventh embodiment.

FIG. 39 is a side view illustrating an example of engagement between the seventh guide portion 865 and the seventh stopper 861 of the seventh recording device 801 according to the seventh embodiment.

Figure 40:
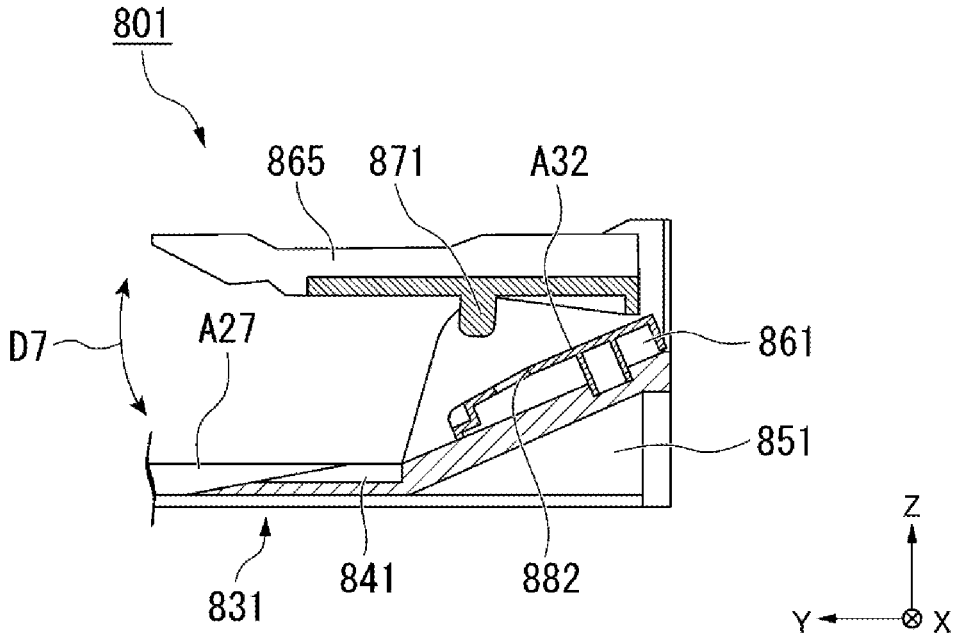
FIG. 40 is a side view illustrating an example of release of the engagement between the seventh guide portion and the seventh stopper of the seventh recording device according to the seventh embodiment.

FIG. 40 is a side view illustrating an example of release of the engagement between the seventh guide portion 865 and the seventh stopper 861 of the seventh recording device 801 according to the seventh embodiment.

Figure 41:
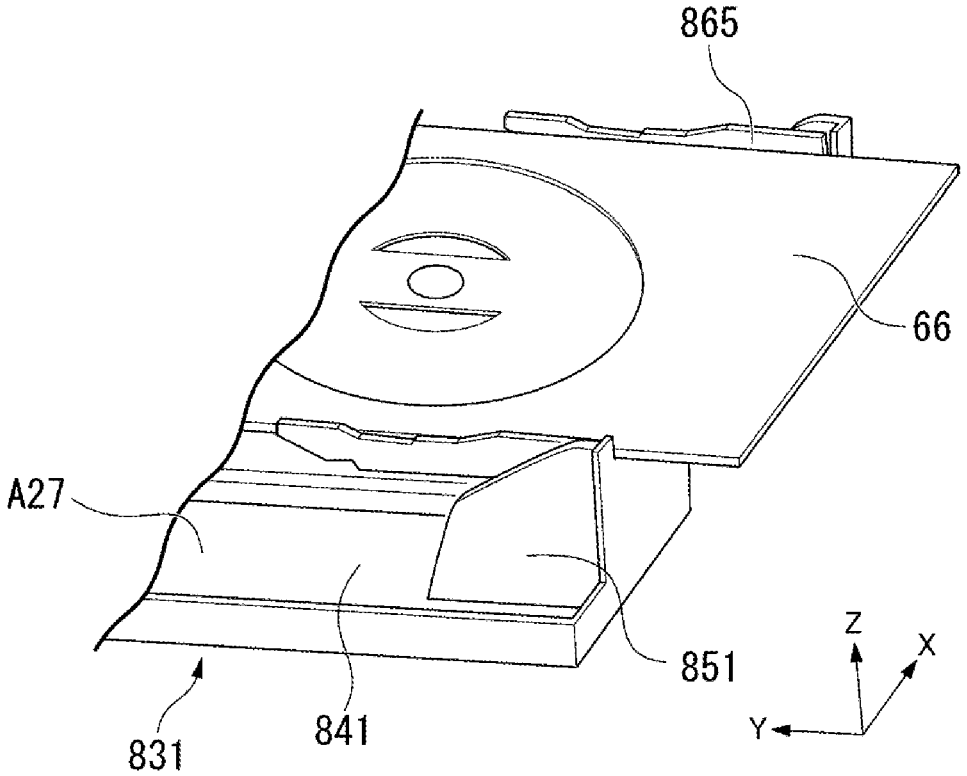
FIG. 41 is an external perspective view illustrating an example of an auxiliary tray of the seventh recording device according to the seventh embodiment.

FIG. 41 is an external perspective view illustrating an example of an auxiliary tray 66 of the seventh recording device 801 according to the seventh embodiment.

In FIGS. 32 to 36 and 39 to 41, XYZ orthogonal coordinate axes similar to those in FIG. 1 are illustrated.

In the examples of FIGS. 32 to 41, only examples of a front portion of the seventh paper discharge tray 831 and the auxiliary tray 66 in the seventh recording device 801 are illustrated. In the present embodiment, other portions of the seventh recording device 801 are the same as those in the examples of FIGS. 1 to 6, and detailed description thereof will be omitted.

The configuration according to the present embodiment may be used, for example, together with the configuration of the fifth embodiment or the sixth embodiment, or may be implemented independently of these.

In the seventh recording device 801, as illustrated in FIGS. 32 and 39, when the seventh placement portion 841 of the seventh paper discharge tray 831 is at the use position, a surface of the seventh guide portion 865 is put into a state in which the surface of the seventh guide portion 865 is inclined to be located upward from the downstream to the upstream along the seventh inclined portion 851 of the seventh placement portion 841.

That is, when the seventh placement portion 841 is at the use position, the seventh guide portion 865 forms an inclined surface with a predetermined angle with respect to the seventh placement surface A27, and a leading edge of the discharged paper is obliquely upward.

On the other hand, as illustrated in FIGS. 35 and 40, when the seventh placement portion 841 of the seventh paper discharge tray 831 is displaced from the use position to the accommodation position, the upstream of the surface of the seventh guide portion 865 is pivoted upward and the surface of the seventh guide portion 865 is substantially parallel to the seventh placement surface A27 of the seventh placement portion 841.

In this state, when the auxiliary tray 66 is used, the seventh guide portion 865 can support the auxiliary tray 66. Specifically, the surface of the seventh guide portion 865 serving as a guide member of the auxiliary tray 66 is substantially horizontal, and can support the auxiliary tray 66 inserted from the outside.

In FIG. 40, a seventh pivoting direction D7 that is a direction in which the upstream of the surface of the seventh guide portion 865 pivots is illustrated.

Here, the pivoting of the seventh guide portion 865 may be realized mechanically by the seventh recording device 801, or may be realized using a drive source, for example. The drive source may be, for example, the same as the drive source 161 of the transport roller, or a separate drive source may be included.

As illustrated in FIGS. 33 and 39, when the seventh placement portion 841 is at the use position and the seventh stopper 861 is in the extended state, a seventh holding portion 871 of the seventh guide portion 865 engages with the first hole portion 881 of the seventh stopper 861, so that the seventh stopper 861 is fixed in the extended state.

Further, as illustrated in FIG. 34, when the seventh placement portion 841 is at the use position and the seventh stopper 861 is in the retracted state, the seventh holding portion 871 of the seventh guide portion 865 engages with the second hole portion 882 of the seventh stopper 861, so that the seventh stopper 861 is fixed in the retracted state.

However, when the seventh holding portion 871 of the seventh guide portion 865 engages with the second hole portion 882 of the seventh stopper 861, the seventh stopper 861 may not be necessarily fixed. When the seventh placement portion 841 is at the use position and the seventh stopper 861 is in the retracted state, the second hole portion 882 need only to be provided so that the seventh holding portion 871 does not interfere with the seventh stopper 861.

Here, in the present embodiment, the seventh holding portion 871 of the seventh guide portion 865 is a protrusion portion that protrudes downward from a bottom surface of the seventh guide portion 865.

Further, as illustrated in FIG. 36, when the seventh placement portion 841 is at the accommodation position and the seventh stopper 861 is in the retracted state, the engagement between the seventh holding portion 871 of the seventh guide portion 865 and the second hole portion 882 of the seventh stopper 861 is released.

The engagement may also be referred to as fitting or the like. In the present embodiment, the projecting portion of the seventh holding portion 871 has a shape that fits into the first hole portion 881 and the second hole portion 882.

In FIG. 37, an appearance of the back surface of the seventh guide portion 865 is illustrated.

In FIG. 38, an appearance of the seventh stopper 861 having the first hole portion 881 and the second hole portion 882 is illustrated.

In the present embodiment, although a case in which the seventh stopper 861 has the first hole portion 881 and the second hole portion 882 is shown, a configuration in which the seventh stopper 861 includes any one of the first hole portion 881 and the second hole portion 882 may be used as another example.

The seventh recording device 801 includes a biasing portion that biases the seventh stopper 861 toward the retracted state. The biasing direction of the biasing portion is a seventh biasing direction G7. The biasing portion may be configured using, for example, a torsion spring.

The seventh paper discharge tray 831 has the seventh guide portion 865 that can guide the auxiliary tray 66 that supports a special medium, and support the medium.

The special medium is, for example, a CD-R. In this case, the auxiliary tray 66 is a tray into which the CD-R is fitted. The tray may be referred to as a CD tray or the like.

As the special medium and the auxiliary tray 66, other types of media and auxiliary trays may be used.

Thus, in the present embodiment, the seventh stopper 861 is biased to pivot in the retracting direction. For example, when the seventh placement portion 841 is at the use position and the seventh stopper 861 is pulled out by the user, the seventh holding portion 871 is fitted to the first hole portion 881, and the seventh stopper 861 is held at a position at which the seventh stopper 861 is pulled out.

On the other hand, when the seventh stopper 861 is in the extended state and the seventh placement portion 841 is accommodated, the upstream of the surface of the seventh guide portion 865 pivots away from the seventh placement surface A27, and the surface becomes substantially horizontal. In this case, the seventh holding portion 871 of the seventh guide portion 865 disengages from the first hole portion 881 of the seventh stopper 861, and the seventh stopper 861 is displaced to the retracted state.

The seventh guide portion 865 has the seventh holding portion 871 that holds the seventh stopper 861 in an extended state.

The seventh guide portion 865 is located at the guide position to which the auxiliary tray 66 is guided when the seventh placement portion 841 is at the accommodation position, and is located at a supporting position at which the medium is supported when the seventh placement portion 841 is at the use position.

The seventh holding portion 871 can hold the seventh stopper 861 in the extended state when the seventh guide portion 865 is at the supporting position, and can release holding of the seventh stopper 861 when the seventh guide portion 865 is at the guiding position.

Therefore, the seventh stopper 861 is biased toward the retracted state so that the seventh stopper 861 is retracted when the lock is released.

Since the lock is released when the seventh guide portion 865 moves up, the seventh stopper 861 can be retracted with a simple configuration.

Interlocking with the displacement of the seventh guide portion 865 makes it possible to realize the retraction of the seventh stopper 861 while curbing an increase in the number of parts.

Further, since the presence of the lock provides a click feeling when the user extends the seventh stopper 861, the usability is improved.

The seventh holding portion 871 holds the seventh stopper 861 when the seventh stopper 861 is in the retracted state and a case in which the seventh stopper 861 is in the extended state when the seventh placement portion 841 is at the use position.

Therefore, when the seventh stopper 861 is put into the extended state by the user, the seventh holding portion 871 locks the seventh stopper 861 in the extended state, and the seventh stopper 861 is put into the retracted state due to the biasing portion when not unnecessary and the seventh stopper 861 is locked in the retracted state, and thus, it is possible to curb the seventh stopper 861 becoming an obstacle when the seventh stopper 861 is not used.

Other configurations thereof may be used. For example, a configuration in which the seventh stopper 861 is held either a case in which the seventh stopper 861 is in the retracted state or when the seventh stopper 861 is in the extended state may be used.

For example, the seventh placement portion 841 has the seventh inclined portion 851 that is inclined so that the downstream in the medium discharge direction is upward and performs support.

The seventh stopper 861 is retracted in the seventh inclined portion 851 in the retracted state.

Therefore, the presence of the seventh inclined portion 851 can curb jumping-out of the discharged medium. Further, the seventh stopper 861 is retracted in the seventh inclined portion 851, so that the size of the device can be reduced.

Other configurations thereof may be used.

For example, the seventh placement surface A27 on which the medium is placed in the seventh placement portion 841 intersects with the seventh support surface A32 that supports the medium in the seventh stopper 861.

Therefore, since the seventh stopper 861 is inclined with respect to the seventh placement surface A27, it is possible to curb jumping-out of the medium.

Other configurations thereof may be used.

For example, the seventh recording device 801 may include a drive source 161 that displaces the seventh placement portion 841 to the accommodation position and the use position.

Therefore, the seventh paper discharge tray 831 is automatically moved, so that usability is improved. When the seventh paper discharge tray 831 is automatically retracted with the seventh stopper 861 being in the extended state, the user is highly likely to close the operating unit 21 without noticing that the seventh stopper 861 is in the extended state, but even in such a case, it is possible to curb the damage. Other configurations thereof may be used.

Here, a drive source for the seventh placement portion 841 does not necessarily have to be the same as the drive source 161 of the transport roller, and the seventh recording device 801 may include another drive source.

As described above, in the seventh recording device 801 according to the present embodiment, it is possible to prevent the device from being damaged when the operating unit 21 is closed in a state in which the seventh placement portion 841 is accommodated without the seventh stopper 861 provided on the seventh paper discharge tray 831 being retracted.

In the seventh recording device 801 according to the present embodiment, the seventh guide portion 865 is displaced in conjunction with the accommodation of the seventh placement portion 841 so that the seventh stopper 861 is retracted, thereby avoiding a situation in which only the seventh placement portion 841 is accommodated without the seventh stopper 861 being retracted.

The interlocking mechanism between the operating unit and the paper discharge tray will be described in detail with reference to FIGS. 42 to 47.

In FIGS. 42 to 47, for convenience of description, the eighth recording device 901 is shown for description.

Figure 42:
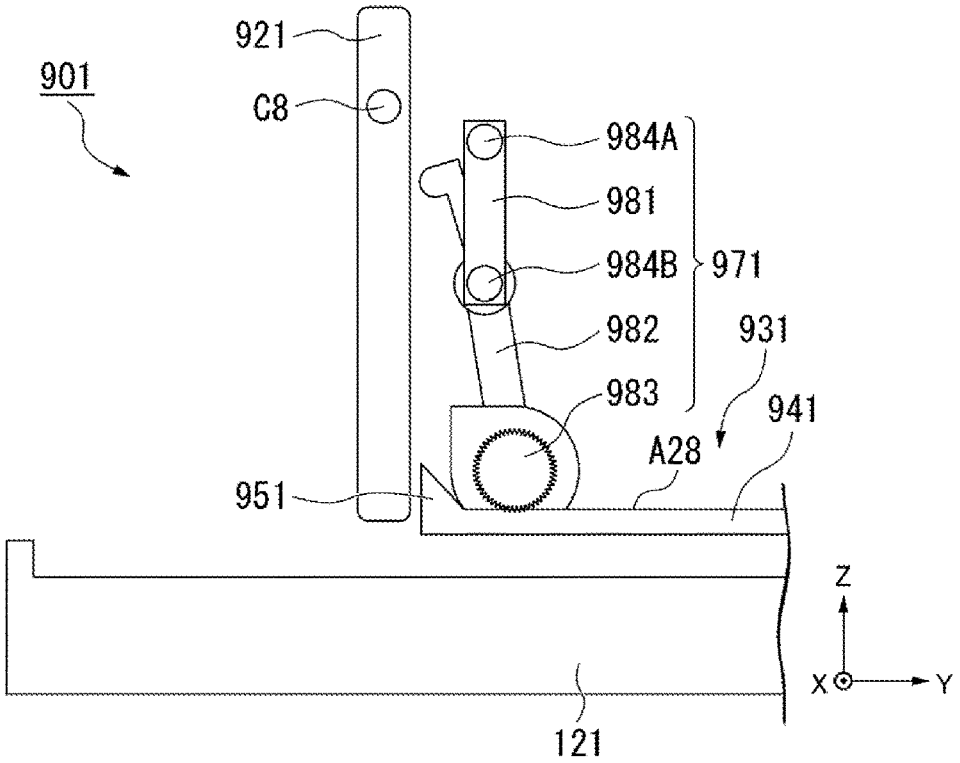
FIG. 42 is a diagram illustrating an interlocking mechanism between an eighth operating unit and an eighth paper discharge tray of the eighth recording device.

FIG. 42 is a diagram illustrating an interlocking mechanism between the eighth operating unit 921 and the eighth paper discharge tray 931 of the eighth recording device 901.

Figure 43:
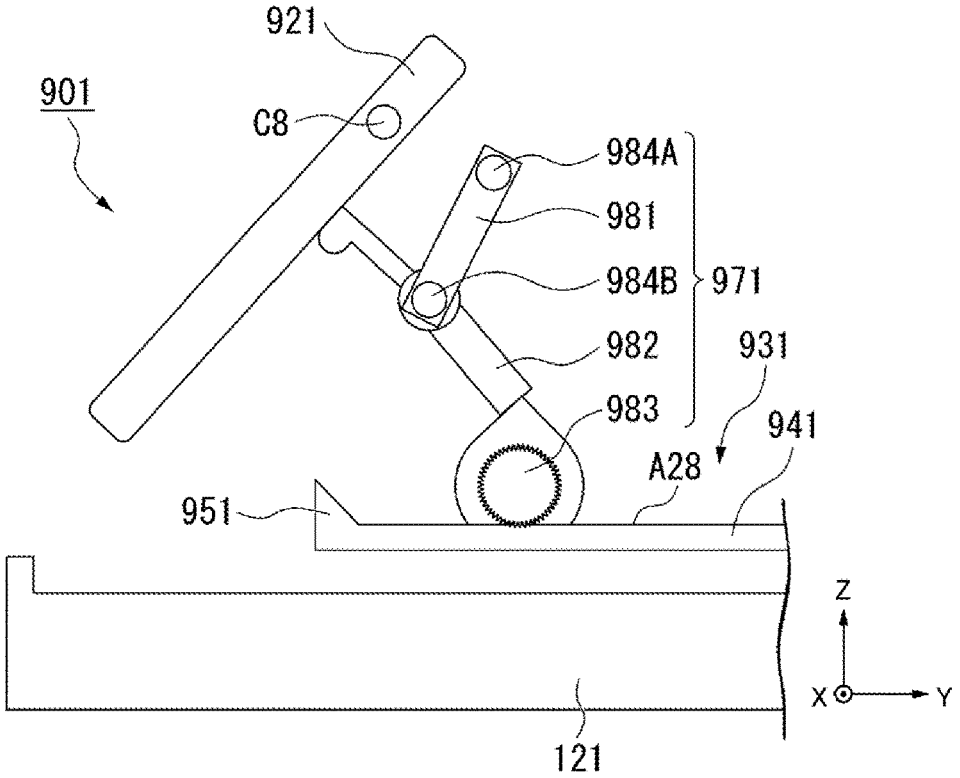
FIG. 43 is a diagram illustrating the interlocking mechanism between the eighth operating unit and the eighth paper discharge tray of the eighth recording device.

FIG. 43 is a diagram illustrating the interlocking mechanism between the eighth operating unit 921 and the eighth paper discharge tray 931 of the eighth recording device 901.

Figure 44:
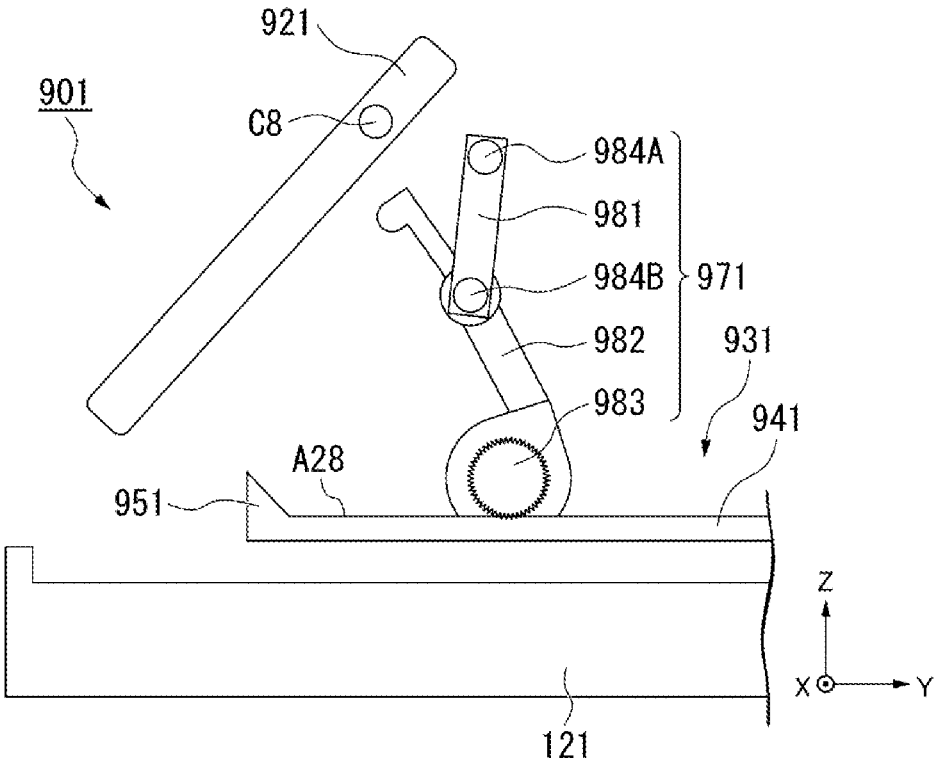
FIG. 44 is a diagram illustrating the interlocking mechanism between the eighth operating unit and the eighth paper discharge tray of the eighth recording device.

FIG. 44 is a diagram illustrating the interlocking mechanism between the eighth operating unit 921 and the eighth paper discharge tray 931 of the eighth recording device 901.

Figure 45:
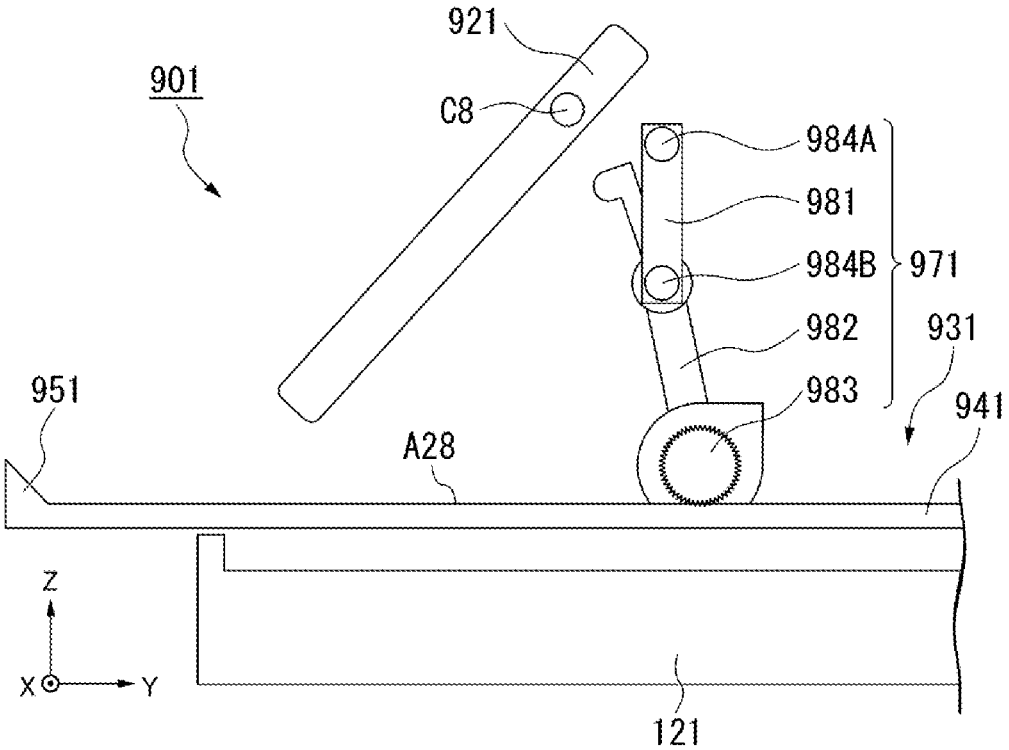
FIG. 45 is a diagram illustrating the interlocking mechanism between the eighth operating unit and the eighth paper discharge tray of the eighth recording device.

FIG. 45 is a diagram illustrating the interlocking mechanism between the eighth operating unit 921 and the eighth paper discharge tray 931 of the eighth recording device 901.

Figure 46:
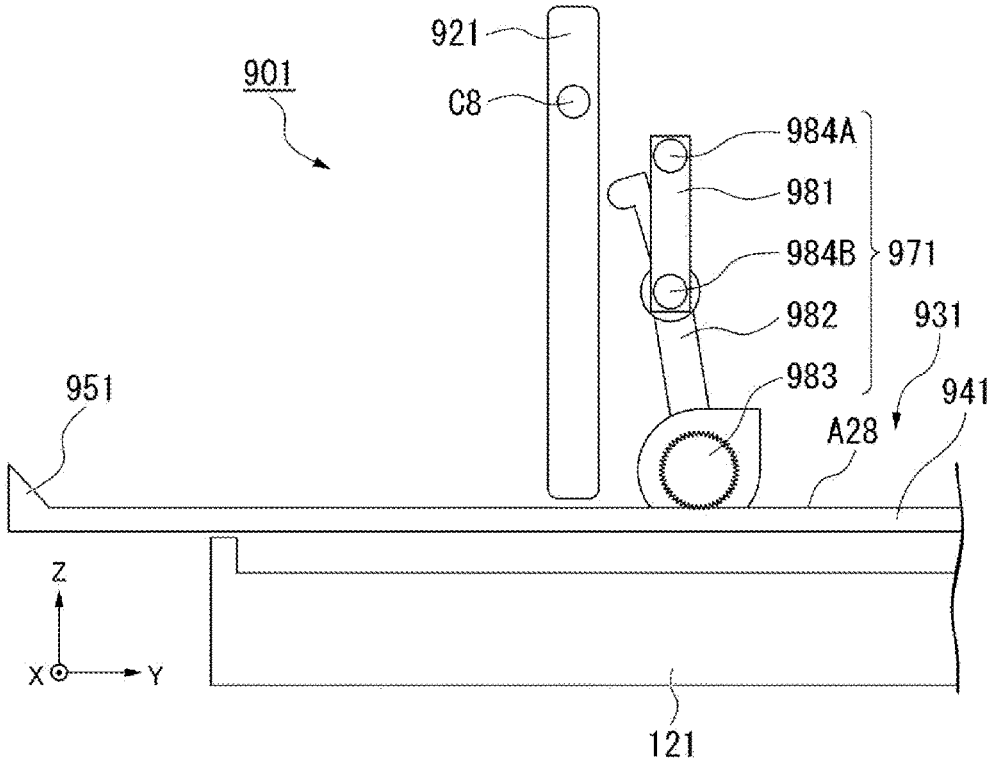
FIG. 46 is a diagram illustrating the interlocking mechanism between the eighth operating unit and the eighth paper discharge tray of the eighth recording device.

FIG. 46 is a diagram illustrating the interlocking mechanism between the eighth operating unit 921 and the eighth paper discharge tray 931 of the eighth recording device 901.

Figure 47:
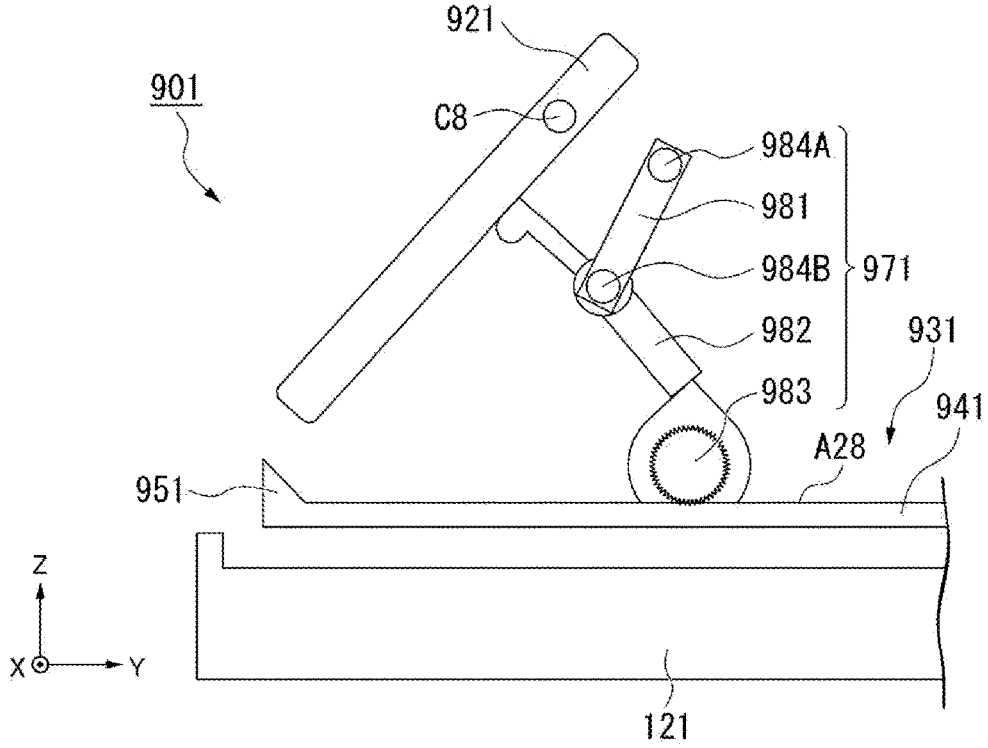
FIG. 47 is a diagram illustrating the interlocking mechanism between the eighth operating unit and the eighth paper discharge tray of the eighth recording device.

FIG. 47 is a diagram illustrating the interlocking mechanism between the eighth operating unit 921 and the eighth paper discharge tray 931 of the eighth recording device 901.

In FIGS. 42 to 47, XYZ orthogonal coordinate axes similar to those in FIG. 1 are illustrated.

In the examples of FIGS. 42 to 47, only portions regarding the interlocking mechanism between the eighth operating unit 921 and the eighth paper discharge tray 931 in the eighth recording device 901 is illustrated. In the present embodiment, other portions of the eighth recording device 901 are the same as those in the examples of FIGS. 1 to 6, and detailed description thereof will be omitted.

A configuration according to the present embodiment may be applied to, for example, each of the first embodiment, the 1*a*-th embodiment, and the second to seventh embodiments.

In the present embodiment, the drive source 161 is common to both the drive of the transport roller and the drive of the eighth paper discharge tray 931.

Interlocking between the eighth paper discharge tray 931 and the eighth operating unit 921 will be described with reference to FIGS. 42 to 47.

Here, an eighth interlocking portion 971 that performs the interlocking includes a first lever 981, a second lever 982, a gear-with-cam 983, an 8A-th rotation shaft 984A, and an 8B-th rotation shaft 984B.

In the present embodiment, the eighth placement surface A28 of the eighth placement portion 941 is provided with a rack for rotating the gear-with-cam 983.

The eighth paper discharge tray 931 and the eighth operating unit 921 are disposed above the cassette 121.

The eighth interlocking portion 971 is disposed above the eighth paper discharge tray 931.

The eighth operating unit 921 is displaced between the parallel state and the inclined state by pivoting about the eighth operating unit pivoting shaft C8 as a central shaft. The gear-with-cam 983 meshes with a rack (not illustrated) provided on the outer side relative to a placement area in which the medium is placed, in the eighth placement surface A28 of the eighth paper discharge tray 931.

The gear-with-cam 983 is rotatably coupled to one end of the second lever 982.

One end of the first lever 981 is pivotably coupled to a position on a rod shape of the second lever 982 by an 8B-th rotation shaft 984B.

The other end of the first lever 981 is rotatably fixed at a predetermined position of the eighth recording device 901 by the 8A-th rotation shaft 984A.

In an example of FIG. 42, the eighth operating unit 921 is in the parallel state, and the eighth placement portion 941 is at the accommodation position. In this state, when the eighth operating unit 921 is in the parallel state, an eighth inclined portion 951 of the eighth placement portion 941 interferes with a lower end of the eighth operating unit 921.

In the present embodiment, when the eighth placement portion 941 is pulled out toward the use position from this state, the gear-with-cam 983 pivots in a predetermined direction, so that the eighth operating unit 921 is gradually displaced from the parallel state to the inclined state, as in the example of FIG. 43, from the example of FIG. 42.

In the present embodiment, an operation in which the eighth operating unit 921 is displaced from the parallel state to the inclined state is performed from the state illustrated in FIG. 42 to the state illustrated in FIG. 43. In the state illustrated in FIG. 43, an upper end of the second lever 982 abuts on the eighth operating unit 921.

When the eighth placement portion 941 is further pulled out toward the use position from the state illustrated in FIG. 43, the second lever 982 moves away from the eighth operating unit 921 as illustrated in an example of FIG. 44 and the eighth placement portion 941 is pulled out and put into the state illustrated in an example of FIG. 45.

Here, in the state illustrated in FIG. 45, a posture of the second lever 982 becomes the same as that in the state illustrated in FIG. 42. In this posture, it is possible to arbitrarily change an inclination angle of the eighth operating unit 921.

In an example of FIG. 46, the eighth operating unit 921 is in the parallel state, and the eighth placement portion 941 is at the use position. In this state, when the eighth operating unit 921 is in the parallel state, an eighth inclined portion 951 of the eighth placement portion 941 interferes with the lower end of the eighth operating unit 921.

In the present embodiment, when the eighth placement portion 941 is directed the accommodation position from this state, the gear-with-cam 983 pivots in a direction opposite to the predetermined direction, so that the eighth operating unit 921 is gradually displaced from the parallel state to the inclined state, as in the example of FIG. 47.

In the examples of FIGS. 42 to 47, the lower end of the eighth operating unit 921 does not exceed a tip of the cassette 121 when the eighth operating unit 921 is in the inclined state.

The eighth recording device 901 includes the eighth interlocking portion 971 that pivots the eighth operating unit 921 according to the displacement of the eighth placement portion 941.

The eighth placement portion 941 has the eighth inclined portion 951 that is inclined so that the downstream in the medium discharge direction is upward and performs support. The eighth inclined portion 951 overlaps the eighth operating unit 921 in the parallel state when viewed in a direction intersecting the first surface A1.

Therefore, the presence of the eighth inclined portion 951 can curb jumping-out of the discharged medium. When the eighth inclined portion 951 is at a position at which the eighth inclined portion 951 interferes with the eighth operating unit 921 in the parallel state, the eighth paper discharge tray 931 is likely to be unable to be accommodated depending on a position of the eighth operating unit 921, but it is possible to avoid the interference using the eighth interlocking portion 971.

Here, the interlocking between the eighth placement portion 941 and the eighth operating unit 921 may not necessarily performed for an entire displacement portion of the eighth placement portion 941, or may be performed, for example, in a partial displacement portion in which the interference between the lower end of the eighth operating unit 921 and the eighth inclined portion 951 of the eighth placement portion 941 can be eliminated.

Further, a drive source for rotating the gear-with-cam 983 may be, for example, the same as the drive source 161 of the transport roller, or a separate drive source may be included.

The eighth recording device 901 may include, for example, a locking portion that fixes the eighth operating unit 921 at a predetermined inclined position. Detailed description of the mechanism of the locking portion is omitted.

An 8*a*-th recording device 901*a* will be described with reference to FIGS. 48 and 49.

Figure 48:
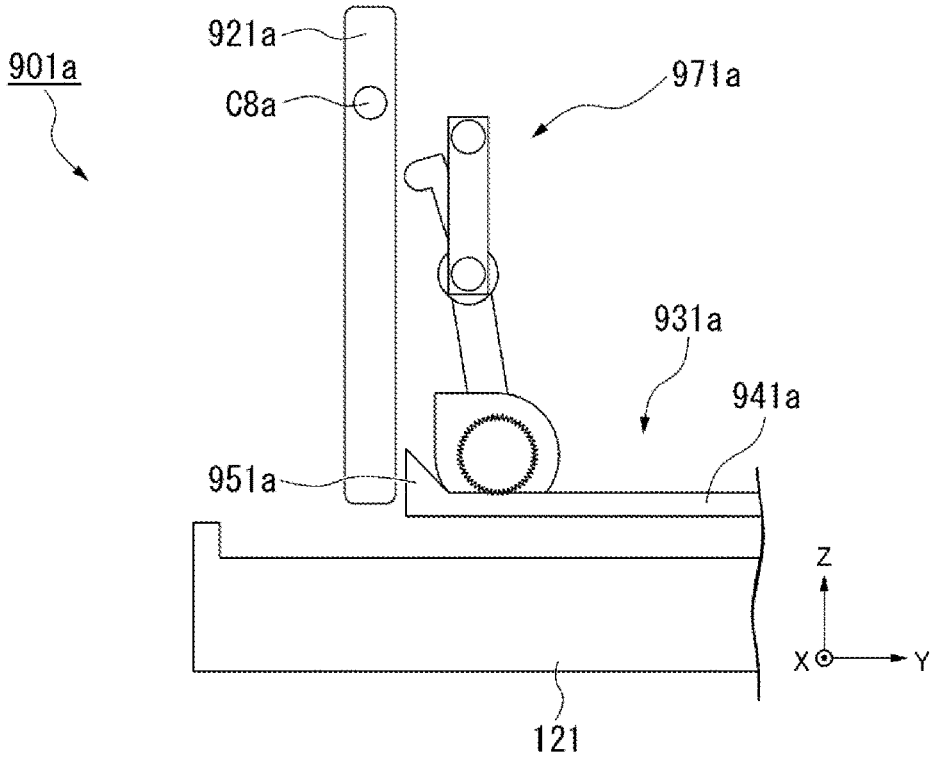
FIG. 48 is a diagram illustrating an example of another positional relationship between an 8*a*-th operating unit and an 8*a*-th paper discharge tray of an 8*a*-th recording device.

FIG. 48 is a diagram illustrating an example of another positional relationship between an 8*a*-th operating unit 921*a* and an 8*a*-th paper discharge tray 931*a* of the 8*a*-th recording device 901*a*.

Figure 49:
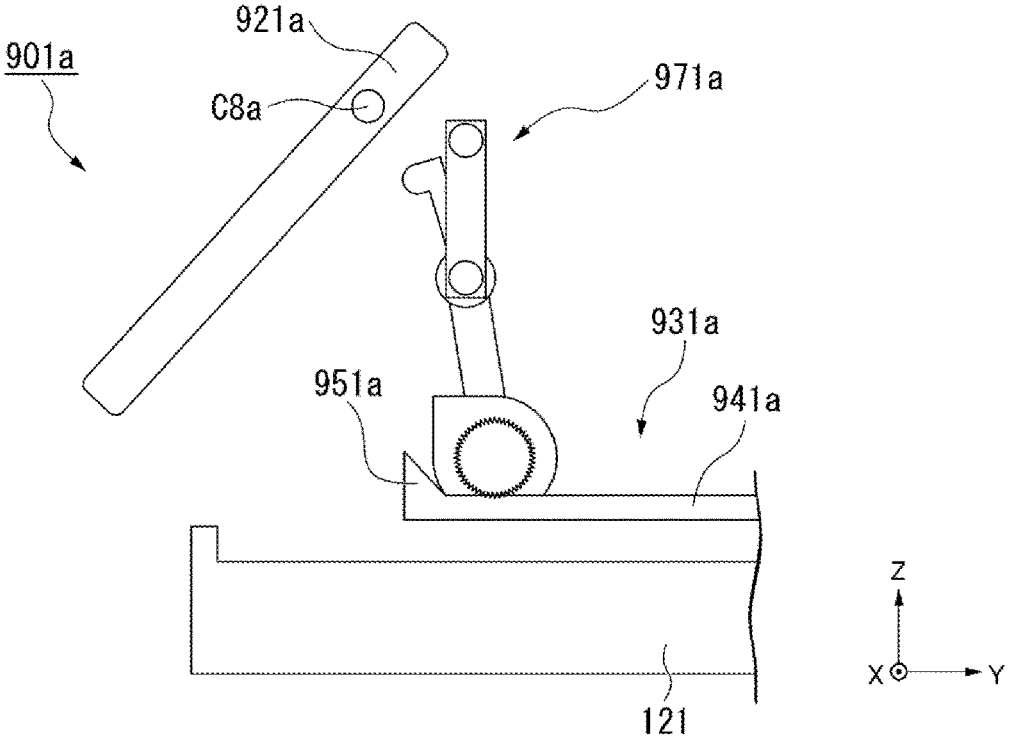
FIG. 49 is a diagram illustrating an example of another positional relationship between the 8*a*-th operating unit and the 8*a*-th paper discharge tray of the 8*a*-th recording device.

FIG. 49 is a diagram illustrating an example of another positional relationship between the 8*a*-th operating unit 921*a* and the 8*a*-th paper discharge tray 931*a* of the 8*a*-th recording device 901*a*.

In FIGS. 48 and 49, XYZ orthogonal coordinate axes similar to those in FIG. 1 are illustrated.

In the examples of FIGS. 48 and 49, only portions regarding the interlocking mechanism between the 8*a*-th operating unit 921*a* and the 8*a*-th paper discharge tray 931*a* of the 8*a*-th recording device 901*a* is illustrated. In the present embodiment, other portions of the 8*a*-th recording device 901*a* are the same as those in the examples of FIGS. 1 to 6, and detailed description thereof will be omitted.

The 8*a*-th recording device 901*a* according to the present embodiment is a modification example of the eighth recording device 901, and differences from the eighth recording device 901 will be described.

A configuration according to the present embodiment may be applied, for example, to each of the first embodiment, the 1*a*-th embodiment, and the second to seventh embodiments.

In FIGS. 48 and 49, the 8*a*-th operating unit 921*a*, the 8*a*-th placement portion 941*a* of the 8*a*-th paper discharge tray 931*a*, and an 8*a*-th interlocking portion 971*a* are illustrated.

Further, in FIGS. 48 and 49, an 8*a*-th operation surface pivoting shaft C8*a* of the 8*a*-th operating unit 921*a*, and an 8*a*-th inclined portion 951*a* of the 8*a*-th placement portion 941*a* are illustrated.

In the example of FIGS. 48 and 49, a lower end of the 8*a*-th operating unit 921*a* can exceed the tip of the cassette 121 in the inclined state of the 8*a*-th operating unit 921*a*.

Although the embodiments have been described in detail with reference to the drawings, the specific configuration is not limited to the present embodiments, and includes design and the like without departing from the gist of this disclosure.

Hereinafter, configuration examples are shown.

A lower configuration example may or may not be applied to a higher configuration example.

Further, a lower configuration example applicable to any one of two or more higher configuration examples may be applied to any one of the two or more higher configuration examples, that is, two or more application examples may occur and configuration examples lower than the lower configuration examples may be applied to any one of the two or more application examples.

Configuration Example 1

A recording device including:

a recording unit configured to perform recording on a medium, a discharge tray from which the medium after recording by the recording unit is discharged, an operating unit configured to be performed an operation related to a device, and a housing configured to accommodate the recording unit, wherein the operating unit is provided to be pivotable, with respect to the first surface of the housing, to a parallel state along a first surface and an inclined state intersecting the first surface, the discharge tray includes a placement portion displaceable to an accommodation position at which the placement portion is accommodated inside the housing, and a use position at which the placement portion protrudes from the first surface of the housing to the outside, and an extension portion configured to be displaceable to a retracted state in which the extension portion is retracted in the placement portion and an extended state in which the extension portion protrudes with respect to the placement portion, the extension portion protrudes to the outside of the housing when the placement portion is at the accommodation position and the extension portion is in the extended state, at least the extension portion in the extended state overlaps the operating unit in the parallel state when viewed in a direction perpendicular to the first surface, and a force in a first direction in which the extension portion is displaced from the extended state to the retracted state is applied when a back surface of the operating unit facing the first surface in the parallel state abuts on a tip of the extension portion.

Here, the configuration of [Configuration Example 1] is applied to, for example, each of the first embodiment, the 1*a*-th embodiment, and the second to fourth embodiments.

Configuration Example 2

The recording device according to [Configuration Example 1], wherein at least one of a surface of the back surface abutting on the tip and a surface of the tip abutting on the back surface intersects the first direction.

Here, the configuration of [Configuration Example 2] is applied to, for example, each of the first embodiment, the 1*a*-th embodiment, and the second to fourth embodiments.

Configuration Example 3

The recording device according to [Configuration Example 1] or [Configuration Example 2], wherein the extension portion is displaceable to the retracted state and the extended state by pivoting about a pivoting shaft.

Here, the configuration of [Configuration Example 3] is applied to, for example, each of the first embodiment, the 1*a*-th embodiment, and the second to third embodiments.

Configuration Example 4

The recording device according to [Configuration Example 3], wherein the abutment portion of the back surface abutting on the tip obliquely protrudes Here, the configuration of [Configuration Example 4] is applied to, for example, the third embodiment.

Configuration Example 5

The recording device according to [Configuration Example 3] or [Configuration Example 4], wherein the extension portion protrudes in a direction intersecting with the discharge direction of the medium in the extended state.

Here, the configuration of [Configuration Example 5] is applied to, for example, the first embodiment and the 1*a*-th embodiment.

Configuration Example 6

The recording device according to [Configuration Example 5], wherein the tip is located at a center of an area in which the medium is discharged, in a width direction intersecting the discharge direction of the medium.

Here, the configuration of [Configuration Example 6] is applied to, for example, the first embodiment.

Configuration Example 7

The recording device according to [Configuration Example 1] or [Configuration Example 2], wherein the extension portion is capable of parallel translation.

Here, the configuration of [Configuration Example 7] is applied to, for example, the fourth embodiment.

Configuration Example 8

The recording device according to any one of [Configuration Example 1] to [Configuration Example 7], further including:

a biasing portion configured to bias the extension portion toward the extended state.

Here, the configuration of [Configuration Example 8] is applied to, for example, each of the first embodiment, the 1*a*-th embodiment, and the second to fourth embodiments.

Configuration Example 9

A recording device including a recording unit configured to perform recording on a medium, a discharge tray from which the medium after recording by the recording unit is discharged, an operating unit configured to be performed an operation related to a device, and a housing configured to accommodate the recording unit, wherein the operating unit is provided to be pivotable, with respect to the first surface of the housing, to a parallel state along a first surface and an inclined state intersecting the first surface, the discharge tray includes a placement portion displaceable to an accommodation position at which the placement portion is accommodated inside the housing, and a use position at which the placement portion protrudes from the first surface of the housing to the outside, and an extension portion configured to be displaceable to a retracted state in which the extension portion is retracted in the placement portion and an extended state in which the extension portion protrudes with respect to the placement portion, the extension portion protrudes to the outside of the housing when the placement portion is at the accommodation position and the extension portion is in the extended state, at least the extension portion in the extended state overlaps the operating unit in the parallel state when viewed in a direction perpendicular to the first surface, the extension portion includes a first extension portion displaced with respect to the placement portion, and a second extension portion pivoting about a shaft portion with respect to the first extension portion, and the shaft extends to be parallel to the first surface.

Here, the configuration of [Configuration Example 9] is applied to, for example, the sixth embodiment.

Configuration Example 10

The recording device according to [Configuration Example 9], wherein at least a portion of the second extension portion pivoting about the shaft portion does not overlap the operating unit in the parallel state, when viewed in a direction perpendicular to the first surface.

Here, the configuration of [Configuration Example 10] is applied to, for example, the sixth embodiment.

Configuration Example 11

The recording device according to any one of [Configuration Example 1] to [Configuration Example 10], further including:

a drive source configured to displace the placement portion to the accommodation position and the use position.

Here, the configuration of [Configuration Example 11] can be applied to, for example, each of the embodiments to which each of [Configuration Example 1] to [Configuration Example 10] can be applied.

Configuration Example 12

The recording device according to any one of [Configuration Example 1] to [Configuration Example 11], wherein the placement portion has an inclined portion inclined so that a downstream portion thereof in the medium discharge direction is directed upward and supports the medium, and the extension portion is retracted in the inclined portion in the retracted state.

Here, the configuration of [Configuration Example 12] can be applied to, for example, each of the embodiments to which each of [Configuration Example 1] to [Configuration Example 11] can be applied.

Configuration Example 13

The recording device according to any one of [Configuration Example 1] to [Configuration Example 12], further including:

an interlocking portion configured to pivot the operating unit according to a displacement of the placement portion, the placement portion has an inclined portion inclined so that a downstream portion thereof in the medium discharge direction is directed upward and supports the medium, and the inclined portion overlaps the operating unit in the parallel state when viewed in a direction intersecting the first surface.

Here, the configuration of [Configuration Example 13] can be applied to, for example, each of the embodiments to which each of [Configuration Example 1] to [Configuration Example 12] can be applied.

Further, a specific example of the configuration of [Configuration Example 13] is shown, for example, in the embodiment of the examples of FIGS. 42 to 47 and the embodiment of the examples of FIGS. 48 and 49.

Configuration Example 14

The recording device according to any one of [Configuration Example 1] to [Configuration Example 13], wherein a placement surface on which the medium is mounted in the placement portion intersects a support surface configured to support the medium in the extension portion.

Here, the configuration of [Configuration Example 14] can be applied to, for example, each of the embodiments to which each of [Configuration Example 1] to [Configuration Example 13] can be applied.

Hereinafter, configuration examples of other aspects are shown.

A lower configuration example may or may not be applied to a higher configuration example.

Further, a lower configuration example applicable to any one of two or more higher configuration examples may be applied to any one of the two or more higher configuration examples, that is, two or more application examples may occur and configuration examples lower than the lower configuration examples may be applied to any one of the two or more application examples.

Configuration Example A

A recording device including:

a recording unit configured to perform recording on a medium, a discharge tray from which the medium after recording by the recording unit is discharged, an operating unit to be performed an operation related to the device, and a housing that accommodates the recording unit, wherein the operating unit is provided to be pivotable, with respect to the first surface of the housing, to a parallel state along a first surface and an inclined state intersecting the first surface, the discharge tray includes a placement portion displaceable to an accommodation position at which the placement portion is accommodated inside the housing, and a use position at which the placement portion protrudes from the first surface of the housing to the outside, and an extension portion configured to be displaceable to a retracted state in which the extension portion is retracted in the placement portion and an extended state in which the extension portion protrudes with respect to the placement portion, at least the extension portion in the extended state overlaps the operating unit in the parallel state when viewed in a direction perpendicular to the first surface, and the extension portion is put into the retracted state when the placement portion is displaced from the use position to the retracting position.

Here, the configuration of [Configuration Example A] is applied to, for example, each of the fifth embodiment and the seventh embodiment.

Configuration Example B

The recording device described in [Configuration Example A], further including a biasing portion that biases the extension portion toward the retracted state, a holding portion that holds the extension portion in the extended state, a switching portion capable of switching a holding portion to a held state in which the extension portion is held and a released state in which the holding of the extension portion is released, wherein, when the placement portion is displaced from the use position to the accommodation position, the switching portion brings the holding portion into the released state.

Here, the configuration of [Configuration Example B] is applied to, for example, the fifth embodiment.

Configuration Example C

The recording device described in [Configuration Example A], further including:

a biasing portion that biases the extension portion toward the retracted state, wherein the discharge tray has a guide portion that can guide an auxiliary tray that supports a special medium, and can support the medium, the guide portion includes a holding portion that holds the extension portion in the extended state, is located at a guide position at which the guide portion guides the auxiliary tray when the placement portion is at the accommodation position, and is located at a support position at which the guide portion supports the medium when the placement portion is at the use position, and the holding portion is able to hold the extension portion in the extended state when the guide portion is at the supporting position, and releases holding of the extension portion when the guide portion is at the guide position.

Here, the configuration of [Configuration Example C] is applied to, for example, the seventh embodiment.

Configuration Example D

The recording device described in [Configuration Example B], wherein the holding portion holds the extension portion when the extension portion is put into the extended state when the placement portion is at the use position.

Here, the configuration of [Configuration Example D] is applied to, for example, the fifth embodiment.

Configuration Example E

The recording device described in [Configuration Example C], wherein the holding portion holds the extension portion when the placement portion is at the use position and the extension portion is in the retracted state.

Here, the configuration of [Configuration Example E] is applied to, for example, the seventh embodiment.

Configuration Example F

The recording device described in [Configuration Example E], wherein the holding portion holds the extension portion when the placement portion is at the use position and the extension portion is in the extended state.

Here, the configuration of [Configuration Example F] is applied to, for example, the seventh embodiment.

Configuration Example G

The recording device according to any one of [Configuration Example A] to [Configuration Example F], further including:

a drive source configured to displace the placement portion to the accommodation position and the use position.

Here, the configuration of [Configuration Example G] can be applied to, for example, each of the embodiments to which each of [Configuration Example A] to [Configuration Example F] can be applied.

Configuration Example H

The recording device according to any one of [Configuration Example A] to [Configuration Example G], wherein the placement portion has an inclined portion inclined so that a downstream portion thereof in the medium discharge direction is directed upward and supports the medium, and the extension portion is retracted in the inclined portion in the retracted state.

Here, the configuration of [Configuration Example H] can be applied to, for example, each of the embodiments to which each of [Configuration Example A] to [Configuration Example G] can be applied.

Configuration Example I

The recording device according to any one of [Configuration Example A] to [Configuration Example H], further including:

an interlocking portion configured to pivot the operating unit according to a displacement of the placement portion, the placement portion has an inclined portion inclined so that a downstream portion thereof in the medium discharge direction is directed upward and supports the medium, and the inclined portion overlaps the operating unit in the parallel state when viewed in a direction intersecting the first surface.

Here, the configuration of [Configuration Example I] can be applied to, for example, each of the embodiments to which each of [Configuration Example A] to [Configuration Example H] can be applied.

Further, specific examples of the configuration of [Configuration Example I] are illustrated in the eighth embodiment and the 8*a*-th embodiment, for example.

Configuration Example J

The recording device according to any one of [Configuration Example A] to [Configuration Example I], wherein a placement surface on which the medium is mounted in the placement portion intersects a support surface configured to support the medium in the extension portion.

Here, the configuration of [Configuration Example J] can be applied to, for example, each of the embodiments to which each of [Configuration Example A] to [Configuration Example I] can be applied.

What is claimed is:

1. A recording device comprising:

a recording unit configured to perform recording on a medium;

a discharge tray from which the medium after recording by the recording unit is discharged;

an operating unit configured to be performed an operation related to a device; and a housing configured to accommodate the recording unit, wherein the operating unit is provided to be pivotable, with respect to a first surface of the housing, to a parallel state along the first surface and an inclined state intersecting the first surface, the discharge tray includes a placement portion displaceable to an accommodation position at which the placement portion is accommodated inside the housing, and a use position at which the placement portion protrudes from the first surface of the housing to the outside; and an extension portion configured to be displaceable to a retracted state in which the extension portion is retracted in the placement portion and an extended state in which the extension portion protrudes with respect to the placement portion, the extension portion protrudes to the outside of the housing when the placement portion is at the accommodation position and the extension portion is in the extended state, at least the extension portion in the extended state overlaps the operating unit in the parallel state when viewed in a direction perpendicular to the first surface, and a force in a first direction in which the extension portion is displaced from the extended state to the retracted state is applied when a back surface of the operating unit facing the first surface in the parallel state abuts on a tip of the extension portion.

2. The recording device according to claim 1, wherein at least one of a surface of the back surface abutting on the tip and a surface of the tip abutting on the back surface intersects the first direction.

3. The recording device according to claim 1, wherein the extension portion is displaceable to the retracted state and the extended state by pivoting about a pivoting shaft.

4. The recording device according to claim 3, wherein a abutment portion of the back surface abutting on the tip obliquely protrudes.

5. The recording device according to claim 3, wherein the extension portion protrudes in a direction intersecting with the discharge direction of the medium in the extended state.

6. The recording device according to claim 5, wherein the tip is located at a center of an area in which the medium is discharged, in a width direction intersecting the discharge direction of the medium.

7. The recording device according to claim 1, wherein the extension portion is configured to translate.

8. The recording device according to claim 1, further comprising a biasing portion configured to bias the extension portion toward the extended state.

9. The recording device according to claim 1, further comprising:

a drive source configured to displace the placement portion to the accommodation position and the use position.

10. The recording device according to claim 1, wherein the placement portion has an inclined portion inclined so that a downstream portion thereof in the medium discharge direction is directed upward and supports the medium, and the extension portion is retracted in the inclined portion in the retracted state.

11. The recording device according to claim 1, further comprising:

an interlocking portion configured to pivot the operating unit according to a displacement of the placement portion, the placement portion has an inclined portion inclined so that a downstream portion thereof in the medium discharge direction is directed upward and supports the medium, and the inclined portion overlaps the operating unit in the parallel state when viewed in a direction intersecting the first surface.

12. The recording device according to claim 1, wherein a placement surface on which the medium is mounted in the placement portion intersects a support surface configured to support the medium in the extension portion.

13. A recording device comprising:

a recording unit configured to perform recording on a medium;

a discharge tray from which the medium after recording by the recording unit is discharged;

an operating unit configured to be performed an operation related to a device; and a housing configured to accommodate the recording unit, wherein the operating unit is provided to be pivotable, with respect to a first surface of the housing, to a parallel state along the first surface and an inclined state intersecting the first surface, the discharge tray includes a placement portion displaceable to an accommodation position at which the placement portion is accommodated inside the housing, and a use position at which the placement portion protrudes from the first surface of the housing to the outside; and an extension portion configured to be displaceable to a retracted state in which the extension portion is retracted in the placement portion and an extended state in which the extension portion protrudes with respect to the placement portion, the extension portion protrudes to the outside of the housing when the placement portion is at the accommodation position and the extension portion is in the extended state, at least the extension portion in the extended state overlaps the operating unit in the parallel state when viewed in a direction perpendicular to the first surface, the extension portion includes a first extension portion displaced with respect to the placement portion, and a second extension portion pivoting about a shaft portion with respect to the first extension portion, and the shaft portion extends to be parallel to the first surface.

14. The recording device according to claim 13, wherein at least a portion of the second extension portion pivoting about the shaft portion does not overlap the operating unit in the parallel state, when viewed in a direction perpendicular to the first surface.

15. The recording device according to claim 13, further comprising:

a drive source configured to displace the placement portion to the accommodation position and the use position.

16. The recording device according to claim 13, wherein the placement portion has an inclined portion inclined so that a downstream portion thereof in the medium discharge direction is directed upward and supports the medium, and the extension portion is retracted in the inclined portion in the retracted state.

17. The recording device according to claim 13, further comprising:

an interlocking portion configured to pivot the operating unit according to a displacement of the placement portion, the placement portion has an inclined portion inclined so that a downstream portion thereof in the medium discharge direction is directed upward and supports the medium, and the inclined portion overlaps the operating unit in the parallel state when viewed in a direction intersecting the first surface.

18. The recording device according to claim 13, wherein a placement surface on which the medium is mounted in the placement portion intersects a support surface configured to support the medium in the extension portion.

* * * * *